US007472499B2

(12) United States Patent
Schmeichel

(10) Patent No.: US 7,472,499 B2
(45) Date of Patent: Jan. 6, 2009

(54) SNOW PLOW HAVING PIVOTING MECHANISM

(75) Inventor: Charles M. Schmeichel, Jamestown, ND (US)

(73) Assignee: Agri-Cover, Inc., Jamestown, ND (US)

( * ) Notice: Subject to any disclaimer, the term of this patent is extended or adjusted under 35 U.S.C. 154(b) by 132 days.

(21) Appl. No.: 11/556,338

(22) Filed: Nov. 3, 2006

(65) Prior Publication Data

US 2007/0151127 A1 Jul. 5, 2007

(51) Int. Cl.
*E01H 5/04* (2006.01)

(52) U.S. Cl. ..... 37/232; 37/231; 37/266

(58) Field of Classification Search ..... 37/232, 37/233, 231, 264, 266, 267; 172/811, 817
See application file for complete search history.

(56) References Cited

U.S. PATENT DOCUMENTS

| | | | | | |
|---|---|---|---|---|---|
| 1,142,677 | A | * | 6/1915 | Darois | 37/218 |
| 1,805,933 | A | * | 5/1931 | Victor | 280/160 |
| 2,231,875 | A | | 2/1941 | Behnke et al. | |
| 2,460,348 | A | * | 2/1949 | Henry | 172/832 |
| 3,098,309 | A | * | 7/1963 | Koch | 37/231 |
| 3,466,766 | A | | 9/1969 | Kahlbacher | |
| 3,477,149 | A | * | 11/1969 | Wagner | 37/233 |
| 3,545,109 | A | | 12/1970 | Boschung | |
| 4,127,951 | A | | 12/1978 | Hatch | |
| 4,249,323 | A | * | 2/1981 | Mathis et al. | 37/232 |
| 4,357,766 | A | | 11/1982 | Croteau et al. | |
| 4,446,639 | A | * | 5/1984 | Bohn | 37/280 |
| 4,680,880 | A | * | 7/1987 | Boneta | 37/236 |
| 4,843,744 | A | | 7/1989 | Jansen | |
| 4,944,104 | A | * | 7/1990 | Kowalczyk | 37/231 |
| 5,044,098 | A | | 9/1991 | Berghefer | |
| 5,075,985 | A | | 12/1991 | Mensch | |
| 5,109,618 | A | * | 5/1992 | Grubler et al. | 37/232 |
| 5,136,795 | A | | 8/1992 | Rosenberg | |
| 5,297,351 | A | | 3/1994 | Cote | |
| 5,509,219 | A | | 4/1996 | Mecca | |
| 5,560,129 | A | | 10/1996 | Rothbart | |
| 5,595,007 | A | * | 1/1997 | Biance | 37/268 |
| 5,706,591 | A | | 1/1998 | Wissmiller | |
| 5,724,755 | A | | 3/1998 | Weagley | |

(Continued)

FOREIGN PATENT DOCUMENTS

| | | |
|---|---|---|
| DE | 3334121 | 4/1984 |

(Continued)

*Primary Examiner*—Thomas A Beach
*Assistant Examiner*—Matthew R Buck
(74) *Attorney, Agent, or Firm*—Moore & Hansen, PLLP

(57) ABSTRACT

A snow plow for attachment to a vehicle, the snow plow including a mounting apparatus having a mounting frame, the mounting frame including at least one mounting upright. The snow plow further including a plow blade. The plow blade has a mold board including a main surface, a rubber scraper proximate the main surface and a retention apparatus constructed and arranged to disengaeably secure the plow blade with the mounting upright; wherein the retention apparatus allows the plow blade to pivot with respect to the mounting upright such that the rubber scraper can pivot away from the mounting upright when the plow blade is in a working orientation and the vehicle moves in a direction rearward from the plow blade.

25 Claims, 36 Drawing Sheets

U.S. PATENT DOCUMENTS 5,743,032 A 4/1998 Vauhkonen
5,909,960 A 6/1999 Jager et al.
5,950,336 A 9/1999 Liebel
5,960,569 A 10/1999 Molstad
5,967,241 A 10/1999 Cross et al.
5,967,553 A 10/1999 Cominsky
6,009,642 A 1/2000 Nugent
6,094,845 A 8/2000 Lela
6,102,131 A 8/2000 Malinowski
6,112,438 A * 9/2000 Weagley ..... 37/270
6,202,328 B1 3/2001 Fulton
6,240,658 B1 * 6/2001 Knutson et al. ..... 37/231
6,240,660 B1 6/2001 Dugas
6,269,557 B1 8/2001 Henks
6,336,281 B2 1/2002 Fulton, III
6,408,548 B1 6/2002 Altheide
6,425,196 B1 7/2002 Weagley et al.
6,453,582 B1 9/2002 Fulton, III
6,470,604 B1 10/2002 Foster et al.
6,574,890 B2 6/2003 Bateman, Jr.
6,612,050 B2 9/2003 Takeuchi
6,618,965 B1 9/2003 Schultz et al.
6,817,118 B2 * 11/2004 Schmeichel ..... 37/232
6,843,002 B1 1/2005 Moffitt
6,957,505 B1 10/2005 Moffitt
6,983,558 B2 1/2006 Haas
7,063,169 B2 * 6/2006 Elliott ..... 172/445.1
7,131,221 B2 * 11/2006 Schmeichel ..... 37/232
7,290,359 B2 * 11/2007 Potak ..... 37/231
2004/0205985 A1 10/2004 Schmeichel
2005/0066554 A1 3/2005 Schmeichel
2007/0056192 A1 3/2007 Schmeichel
2007/0056193 A1 3/2007 Schmeichel
2007/0056194 A1 3/2007 Schmeichel
2007/0056195 A1 3/2007 Schmeichel
2007/0056196 A1 3/2007 Schmeichel
2007/0062071 A1 3/2007 Schmeichel
2007/0062072 A1 3/2007 Schmeichel
2007/0062073 A1 3/2007 Schmeichel
2007/0062074 A1 3/2007 Schmeichel
2007/0084090 A1 4/2007 Schmeichel
2007/0256334 A1 11/2007 Schmeichel
2007/0266600 A1 11/2007 Schmeichel

FOREIGN PATENT DOCUMENTS

DE 3319223 7/1984

* cited by examiner

SNOW PLOW HAVING PIVOTING MECHANISM

RELATED APPLICATIONS

The present application is related to and claims priority to U.S. patent application Ser. No. 10/850,151, filed May 19, 2004; now issued to U.S. Pat. No. 7,131,221, which is a continuation of and claims priority to U.S. patent application Ser. No. 10/404,164, filed Mar. 31, 2003, now issued to U.S. Pat. No. 6,817,118, which claims the benefit of PCT Application No. PCT/US01/47125 for SELF-ADJUSTING SNOW PLOW filed Nov. 12, 2001; wherein each of the aforementioned applications are incorporated herein by reference.

FIELD OF THE INVENTION

The present invention relates to adjustable snow plows for attachment to land vehicles, primarily personal utility vehicles such as pickup trucks and sport utility vehicles.

BACKGROUND OF THE INVENTION

Moving snow off of open ground, streets, sidewalks and parking lots is an age-old problem in less temperate climates where significant snowfall is anticipated during colder periods of the year. For instance, in many parts of Canada and in many northern states in the United States, significant snowfall can be expected during the late fall and early-to-mid winter months, and again in the late winter and even, at times, early spring.

Clearing freshly fallen snow from open ground, parking lots, driveways, sidewalks and roadways, whether these surfaces are paved or not, is a task common to all of these areas that is generally required to make these surfaces safe and passable, both initially and over time if the snow begins to build up after multiple snowfalls. If the snow is allowed to accumulate over a period of weeks, the snow eventually makes the use of these surfaces for both pedestrian and vehicular travel difficult, if not treacherous. Therefore, many devices have been designed and manufactured to remove freshly fallen and accumulated snow from such surfaces.

Municipalities generally use large vehicles with enormous snow plows to clear paved roadways used by the public, and county and state government public works and transportation departments in these areas also generally have a fleet of these kinds of vehicles to clear snow from roadways and from large parking lots on county-owned or state-owned properties.

The purchase and use of such a vehicle by individuals, however, who have a need to move or remove accumulated snow in smaller areas, such as driveways and privately owned parking areas, is less feasible. First of all, the larger vehicles are expensive to purchase and maintain and are, in some cases, dedicated solely to the removal of accumulated snow. It will be appreciated that it would not be cost effective for an individual to purchase, house and maintain such a vehicle for just removing snow from driveways and smaller parking lots during a limited period of the year. Furthermore, these vehicles are difficult to operate and often require significant training or experience operating such vehicles.

For this reason, many inventors have designed and manufactured adjustable snow plows that can be attached to pickup trucks and other vehicles for a period of time during the year when snow removal is required. In this way, the vehicles can be used for other purposes during periods when snow removal is not required.

Many of the snow plows attached to these vehicles, however, are large and heavy and are not easily attached and removed from the vehicles. A number of snow plows have been invented that attempt to address these problems. For instance, Kowalczyk (U.S. Pat. No. 4,944,104) discloses a detachable snow plow assembly that is pivotally attached to a common passenger vehicle. In one embodiment of the invention, the snow plow includes rollers secured within attachment channels attached to mounting uprights to allow the plow blade to ride up and down when the blade comes into contact with irregularities in the surface. The plow blade can also pivot forward along with the mounting uprights in certain embodiments when the vehicle is moving backward allowing the plow blade to pivot forward over the ground. In other disclosures, such as the snow plow assembly disclosed by Rosenberg (U.S. Pat. No. 5,136,795), a trip mechanism is disclosed which allows the lower part of the plow blade to pivot backward when the plow blade comes into contact with relatively immovable objects and the trip mechanism is actuated. Rosenberg also discloses a rubber scraper at the bottom of the plow blade which is secured between two metal plates and oriented at an angle rearward of a vertical orientation. Rubber scrapers are also disclosed on older snow plows, such as the snow plow mold board disclosed by C. H. Wagner (U.S. Pat. No. 3,477,149), which discloses a resilient scraping blade made of rubber. This is a common feature in many snow plows, allowing the rubber scraper to contact the ground and provide a somewhat more forgiving surface with which to contact the ground when the plow is used to remove accumulated snow, but the rubber scraper is generally accompanied by a metal backing.

Although each of these inventions has its own advantages, none of them are easy to attach to or remove from the vehicle. These snow plows also tend to be heavy and cumbersome, and at least somewhat unsightly if one is required, for practical reasons, to keep it attached to the vehicle 24/7 for a period of several months during the snow season.

The present invention provides a more cost effective and attractive snow plow for removing smaller amounts of accumulated snow from driveways and small-to-medium sized parking lots where one individual may wish to use his or her vehicle to remove snow during a relatively limited period of time, while still having use of the vehicle available for other purposes, not involving snow removal, when the snow plow must either be removed from the vehicle and/or placed in a suitable position for non-snow removing transit.

In addition, the prior art snow plows are generally so heavy that they will not ride up when they are on open ground, for instance, but will tear up the ground and remove grass and other plant things often just because of the sheer weight of the plow as it passes along the ground surface. Also, the prior art snow plows are often virtually impossible for a single person to handle, because of the weight associated with these plows; and plows that appear to be relatively light weight, such as the snow plow described by Knutson et al. (U.S. Pat. No. 6,240,658), generally have multiple attachment points and do not appear to be highly effective, durable or marketable.

The present invention provides solutions for these and other problems associated with the prior art devices for removing accumulated snow and methods used to accomplish the same.

SUMMARY OF THE INVENTION

The present invention provides a snow plow for attachment to a vehicle, the snow plow including a mounting apparatus having a mounting frame, the mounting frame including a mounting upright. The snow plow further including a plow blade, the plow blade including retention apparatus constructed and arranged to disengageably secure the plow blade to the mounting upright(s) when the plow blade is in a working orientation for use to plow snow. The plow blade preferably includes a mold board, the mold board preferably being an aluminum extrusion having a hollow core that may be subdivided into cells or compartments. In preferred embodiments, the aluminum extrusion will preferably include at least one attachment channel, preferably a plurality of attachment channels, in which parts of the snow blade can be secured or anchored. Preferably, the snow plow is constructed and arranged to slidably secure the plow blade to the mounting uprights when the plow blade is in use. The plow blade preferably includes first and second attachment channels and the retention apparatus preferably includes at least one retention member anchored in at least one of the attachment channels, preferably in both of the first and second attachment channels.

In certain preferred embodiments, the mounting apparatus further includes an elongated member constructed and arranged to place downward force upon the plow blade when the plow blade is disengageably secured to the mounting uprights during use and the elongated member is a resilient elongated member, preferably a shock cord. In certain embodiments, the self-adjusting snow plow is attached to a vehicle in such a manner to permit the snow plow to make position adjustments when, during use then the vehicle is in motion, a portion of the snow plow comes into contact with a mass of snow or other relatively immovable objects on the ground, upon which the vehicle travels when in motion. The self-adjusting snow plow preferably includes a mounting apparatus for attachment to the vehicle, and a plow blade. The mounting apparatus preferably includes first and second mounting uprights and the plow blade has first and second ends, a top, a bottom, retention apparatus, perhaps a retention member and a rubber scraper, preferably secured to the bottom of the plow blade. In certain embodiments, the retention apparatus will include first and second retention members. In these embodiments, the retention apparatus is generally constructed and arranged to at least partially encircle at least one of the respective mounting uprights when the plow blade is engaged with the mounting apparatus in a working orientation, such that the plow blade is in contact with the ground or objects on the ground. The retention apparatus will preferably include at least one retention member for each mounting upright. The retention members preferably slidably engage the respective mounting uprights when the plow blade is engaged with the mounting apparatus in a working orientation.

When the plow blade alternate and preferred embodiments of the present invention come into contact with a mass of snow or other objects on the ground that are relatively immovable, the retention apparatus, preferably the respective retention members, can slide upward along the respective mounting uprights to enable the respective ends of the plow blade to slide upwardly relative to the mounting upright most proximate to that end of the plow blade. The retention apparatus or retention members, in preferred embodiments, permit the bottom of the plow blade to pivot away from the respective mounting uprights when the plow blade is engaged with the mounting apparatus in a working orientation and the vehicle is in motion in a direction rearward of the plow blade. In certain embodiments, the rubber scraper secured to the bottom of the plow blade is a resilient elastomeric member having a resting orientation in which the rubber scraper extends downwardly and away from the bottom of the plow blade at an angle which extends forward from a plane which extends along a main surface of the plow blade. In certain of these embodiments, the rubber scraper is preferably about an inch thick and extends away from the plow blade at least about three and one-half inches.

It is a primary objective of the present invention to provide a method of clearing accumulated snow from the surface of driveways, parking lots and other similar areas where snow removal is essential during the winter months.

It is an additional objective of the present invention to provide such an apparatus that can be easily mounted and removed from the front end of pickup trucks, sport utility vehicles, all-terrain vehicles and other commonly used personal transit type vehicles, and that the apparatus for mounting the plow blade provides flexibility for mounting the plow blade at different relative heights with respect to vehicles that may stand at different relative heights off of the ground.

It is a further objective of the present invention to provide such an apparatus for snow removal that is much simpler to install and use then other similar devices commonly found in the market today.

It is a further objective of the present invention to provide such an apparatus for snow removal which includes a plow blade which is relatively light and allows an individual person to lift respective ends of the plow blade in order to lower them into position for clearing snow or to lift the respective ends of the plow blade to secure the blade in position for transit, while still providing a durable plow made of materials strong enough to stand up to heavy use during the months in which snow plowing is required.

It is a further objective of the present invention to provide such an apparatus for snow removal that does not require the owner of the vehicle to purchase separate running lights for the vehicle in order to use the self-adjusting snow plow.

It is yet another objective of the present invention to provide such an apparatus for snow removal that easily slides upward on a mounting apparatus to allow the plow blade to go up and over immovable objects encountered during use.

It is a further objective to provide a plow blade that is essentially hinged to the mounting apparatus to permit rapid retreat for the convenience of the user.

It is yet another objective of the present invention to provide such an apparatus for snow removal that allows the operator to drive in reverse after moving snow off of a flat surface, wherein the plow blade is able to "float" freely on a pair of mounting uprights and can slide up and down independently on the mounting upright(s), and wherein the lower portion of the plow blade can pivot forward with respect to the mounting uprights allowing the vehicle to easily draw the plow blade in reverse.

It is yet another objective of the present invention to provide such an apparatus for snow removal that lifts the rubber scraper at the bottom of the plow blade off the ground when the vehicle draws the plow blade in reverse and the lower portion of the plow blade pivots forward with respect to the mounting apparatus.

It is still a further objective of the present invention to provide such a method that does not employ the use of expensive and heavy hydraulic systems that are common used in such devices today.

Although other vehicle accessory connection devices can be used, these objectives are preferably accomplished by the use of a common hitch receiver that is attached to (and extends forward from) the front end of the vehicle that is to be used in the plowing operation. This receiver hitch preferably provides a mounting point for the mounting apparatus, which is preferably accomplished by inserting a tongue of the plow hitch into the hitch receiver and then locking it into place with a pin. This forms a solid mounting for the present invention that allows it to be quickly and easily attached to the front end of any vehicle. A primary advantage of this invention is that it does not require that a user keep the plow assembly on the plow vehicle for the entire season. Its ease of use is also a primary advantage as is its moderate cost.

It is a further objective of the present invention to provide a system for placing downward force on the plow blade when the plow blade is in use, preferably a resilient elongated apparatus for placing downward force on the plow blade as a substitute for constructing the plow blade out of heavy materials which would be difficult for an individual to lift.

It is yet another objective of the present invention to provide a method of placing downward force upon the plow blade during snow plowing operations, preferably a method of providing an elongated member, preferably a resilient elongated member, interconnected between the mounting apparatus and the plow blade such that the elongated member places a sufficient amount of downward force on the plow blade during snow plow operations to improve the usefulness of the plow blade in removing snow during such operations, particularly when the plow blade comes into contact with heavy snows that might otherwise begin to cause the plow blade to ride up on the respective mounting uprights.

It is yet another objective of the present invention to provide an interconnection system for interconnecting the mounting apparatus of the present snow plow to a vehicle that includes a simple swivel apparatus that can pivot horizontally to permit the plow blade to be turned either to the left or to the right of an angle generally perpendicular to the direction of travel of that of the vehicle pushing the plow blade.

It is still another objective of the present invention to provide a mounting apparatus including at least one mounting upright, the mounting uprights preferably including attachment members for securing the plow blade when the plow blade is not in use for snow plowing operations and the vehicle is used for transit purposes. It is a further object to provide attachment members that allow the plow blade to be easily lifted, one end at a time, and secured in the respective attachments members one end at a time, so that a single individual can easily lift the plow blade up into the non-operational use position without assistance.

It is yet another objective of the present invention to provide a plow blade including a mold board having attachment channels in which functional parts of the plow blade may be anchored or secured, preferably by securing anchoring nuts within the attachment channel, or attachment channels, in which to secure reciprocally threaded bolts that anchor or secure the functional parts of the plow blade within the attachment channel or channel, such as retention apparatus, preferably a retention member or retention members, a handle or handles for lifting the plow blade and/or hook apparatus, such as a hook or hooks for interconnecting the plow blade to an elongated member attached to the mounting apparatus to provide a downward force on the plow blade during use for snow plowing operations.

It is yet a further objective of the present invention to provide a plow blade utilizing a mold board including a first and second piece. Preferably, the first and second pieces are interconnected. A two piece construction is more efficient to produce since it requires a smaller die that is available at a greater number of manufacturing facilities.

These and other objectives and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

BRIEF DESCRIPTION OF THE DRAWINGS

In the drawings, in which corresponding reference numerals and letters indicate corresponding parts of the various embodiments throughout the several views, and in which the various embodiments generally differ only in the manner described and/or shown, but otherwise include corresponding parts;

FIG. 23 is a front elevation of an alternate self-adjusting snow plow 110'''; similar to that shown in FIGS. 4 and 22 where the plow blade 130''' is shown in a working orientation and is shown in phantom in further working orientations when one end or the other is raised with respect to the mounting uprights 120''', but the plow blade 130''' includes an alternate retention member 238', which just partially encircles each of the mounting uprights 120''';

FIG. 33 is a perspective view of an optional angle interceptor 311 including a pivoting swivel mechanism in the vehicle connection member 323 of the alternate mounting apparatus 314 shown in FIG. 24;

FIG. 34 is a partially broken away side elevational view of the pivoting swivel mechanism of the optional angle interceptor 311 shown in FIGS. 24 and 33, but showing the side of the pivoting swivel mechanism partially broken away to show the upper and lower structural plates 312*a*, 312*b* through which the pivot bolt 377 and the positioning pin 321 pass to orient the mounting frame 309; and showing a channel for the mounting uprights 320 in phantom;

FIG. 35 is a top plan view of the pivoting swivel mechanism of the vehicle connection member 323 shown in FIG. 33 showing the interconnection member 322 of the mounting frame 309 (shown in phantom) in a generally perpendicular orientation with respect to the direction of travel of the vehicle (not shown) to which the mounting apparatus 314 would be interconnected, with the exception that the angle setting pin 321 is shown in cross-section;

FIG. 38 is a diagrammatic view of the alternate mounting frame 309 shown in FIG. 24 as seen from the front of the vehicle (not shown) to which the mounting apparatus 314 preferably would be secured, when the mounting frame 309 is in a perpendicular orientation as shown in FIG. 35, and showing the plow blade 330 in a raised position, and the preferred resilient elongated member 391 attached only to the mounting frame 309 and showing the plow blade 330 in a working or an operation orientation in phantom;

FIG. 39 is a diagrammatic view similar to that shown in FIG. 38, except that the plow blade 330 is in a lowered working orientation, wherein the retention members 338 are disengageably secured to the mounting uprights 320 for snow plowing operations; and the resilient elongated member 391 is interconnected between the mounting frame and the plow blade 330 creating downward force of the plow blade 330;

FIG. 56A is a side view, which shows the rubber scraper 736 of FIG. 55 in use within a mold board 632 similar to that shown in FIGS. 49, 51 and 52 and showing the rubber scraper 736 slightly flexed as it would be as it moves forward along a ground surface 56 to push snow (not shown) or the like;

DETAILED DESCRIPTION OF THE PREFERRED EMBODIMENTS

Figure 1:
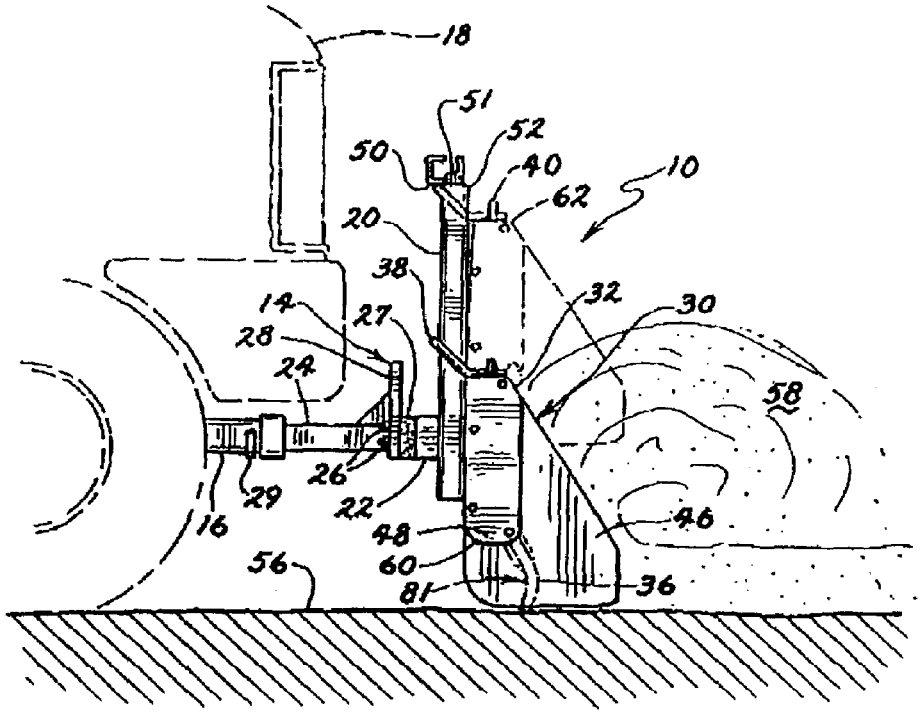
FIG. 1 is a side elevation of an embodiment of the present invention showing a self-adjusting snow plow 10, with the plow blade 30 in a working or operational orientation, attached to a vehicle 18 (shown in phantom); the plow blade 30 is also shown in phantom in an elevated position.
Figure 2:
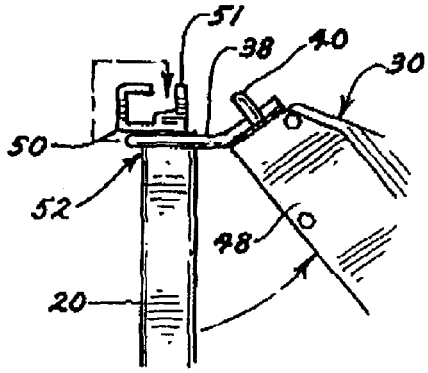
FIG. 2 is a partial side elevation of the self-adjusting snow plow 10 shown in FIG. 1 showing the plow blade 30 in a position in which the bottom (not shown) of the plow blade 30 is pivoted forward so that a retention member 38, secured to the mold board 32 of the plow blade 30, can be disengaged from the mounting upright 20 and placed in the attachment member 51 so that the plow blade 30 can reside in the non-working transit orientation shown in FIG. 3.
Figure 3:
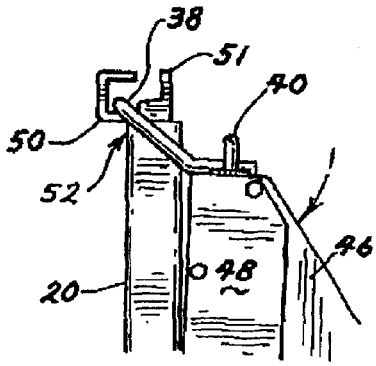
FIG. 3 is a partial side elevation of the self-adjusting snow plow 10 shown in FIGS. 1 and 2, but showing the plow blade 30 in the non-working, transit orientation.

Referring now to the drawings, and more particularly, to FIGS. 1-3, an alternate embodiment of a self-adjusting snow plow 10 of the present invention is shown. The preferred snow plow 10 includes a mounting apparatus 14 and a plow blade 30. The mounting apparatus 14 of this embodiment includes two mounting uprights 20 that are interconnected by an interconnecting member 22. In this embodiment, a hitch tongue 24 is secured to the interconnecting member 22. The hitch tongue 24 is secured to the interconnecting member 22 with a resilient connecting member 27 located between the interconnecting member 22 and a flat connecting plate 28 of the hitch tongue 24. A hitch tongue securing pin 29 secures the hitch tongue 24 in a hitch receiver 16, which is secured to a vehicle 18 (partially shown in phantom in FIG. 1). The resilient connecting member 27 operates in a manner similar to a motor mount and allows the entire snow plow 10 some flexibility when the plow blade 30 is subjected to heavy load forces. Moreover, the connecting member 27 is believed to reduce the shock and vibration in the vehicle 18 due to impacts against relatively immovable objects. The connecting plate 28 is bolted to the interconnecting member 22 by a series of fasteners, preferably bolts 25 secured by nuts 26.

Figure 7:
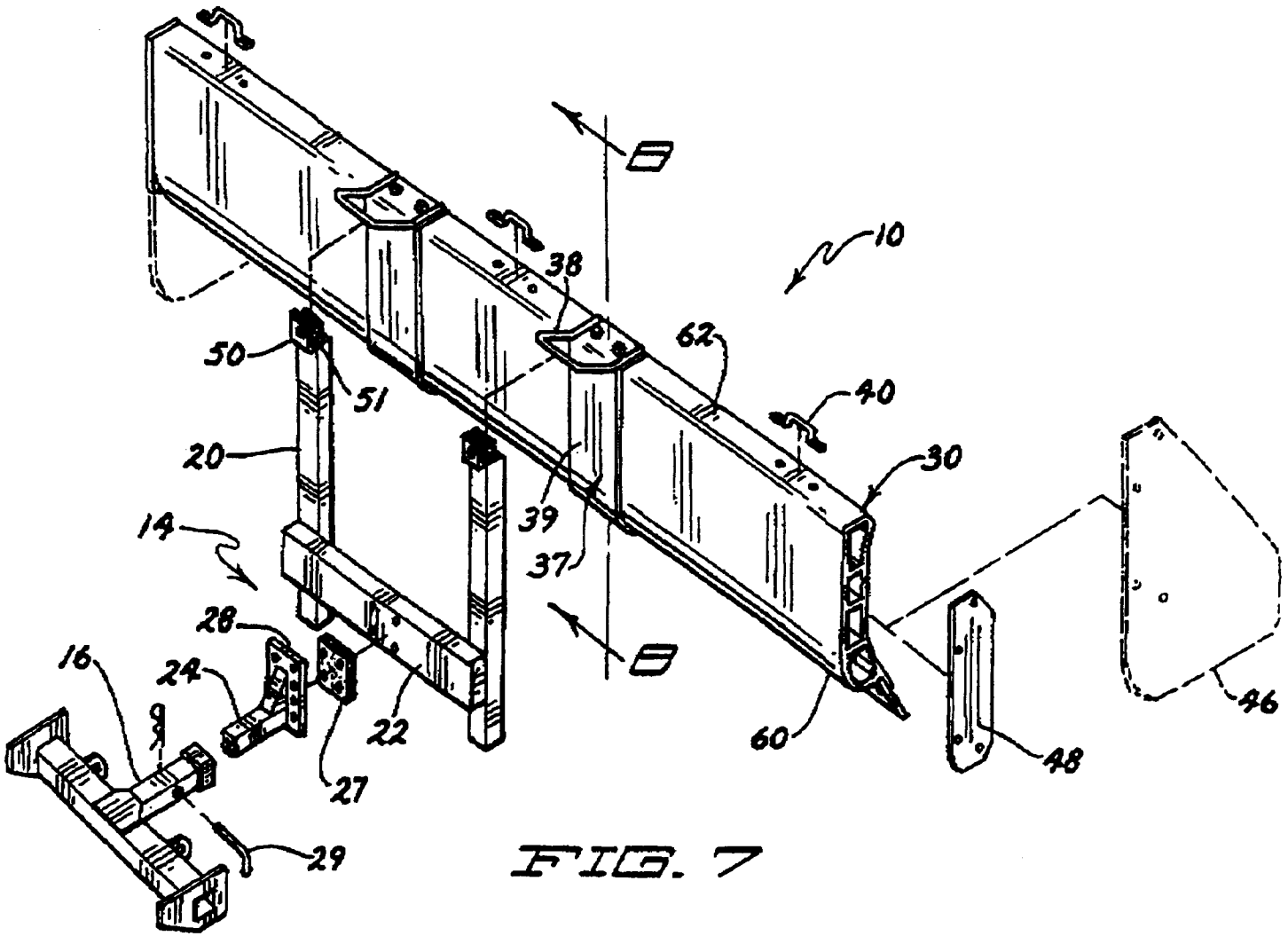
FIG. 7 is an exploded perspective view of the self-adjusting snow plow 10 shown in FIGS. 1-3.
Figure 8:
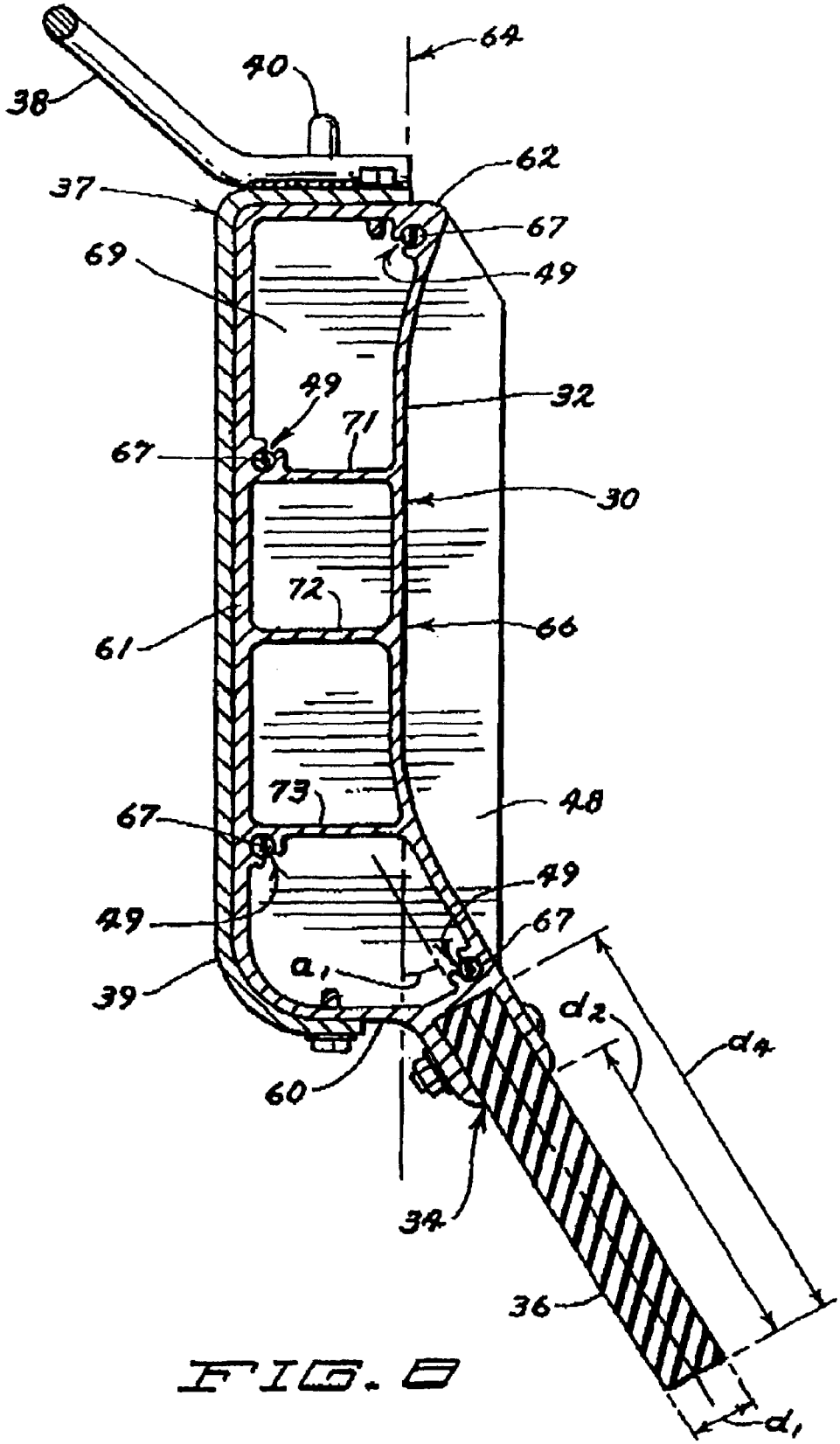
FIG. 8 is a cross-sectional side view of the plow blade 30 shown in FIG. 7 as seen from the line 8-8 of FIG. 7.
Figure 11:
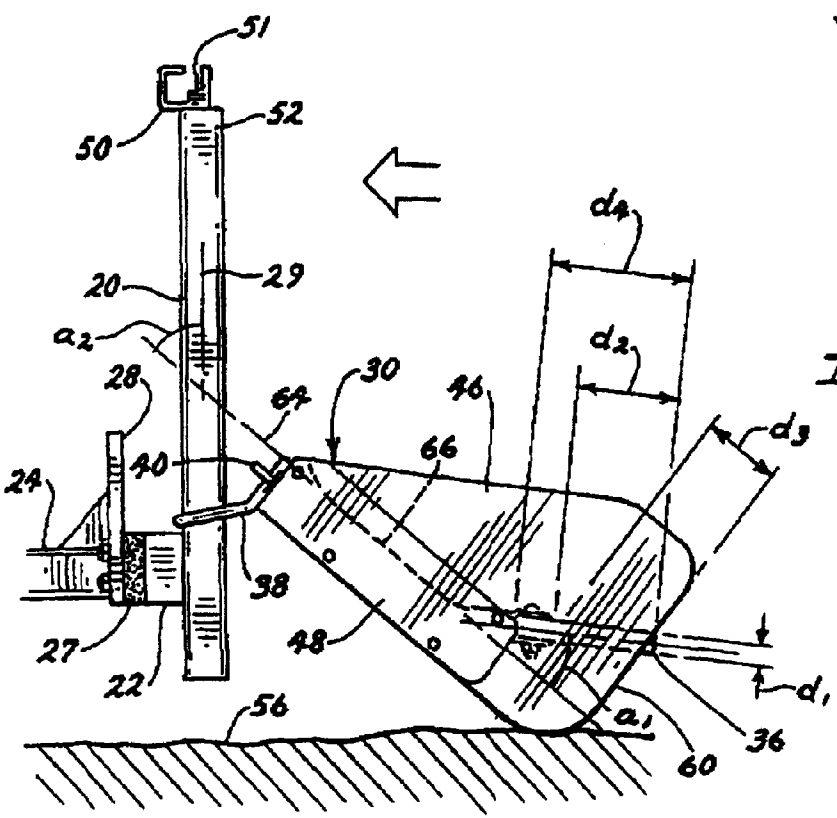
FIG. 11 is a side elevation similar to that shown in FIG. 10, but showing the plow blade 30 shown in FIGS. 1-3 when the vehicle (not shown) moves backward drawing the preferred plow blade 30 with it in a manner which allows the bottom of the plow blade 30 to pivot forward, away from the mounting uprights 20.

Referring now also to FIGS. 7-8 and 11, a preferred plow blade 30 includes a mold board 32 providing a scraper holding channel 34 in which a scraper 36 is secured. In this embodiment, the mold board 32 is a single piece aluminum extrusion, although other materials may be used. The plow blade 30 also includes two retention members 38 and a plurality of lifting handles 40. The plow blade 30 has enlarged end caps 46 secured at each end of the plow blade 30 with fastening elements 49 that extend through blade cap securing plates 48 and into constricted channels 67. In preferred embodiments, the end caps 46 and the rubber scraper 36 are made of resilient elastomeric materials such as hardened natural rubbers and other synthetic materials, which have been used commercially to replace such products. In preferred embodiments, this elastomeric material will be an elastomer such as Styrene-Butadiene Rubbers (SBR), butylene rubbers (copolymers of isobutylene and isoprene), Acrylonitrile-Butadiene rubbers (NBR), neoprene, Thiokol® rubbers or the like; preferably SBR. In the most preferred embodiments 60 Durometer SBR is used. It will be appreciated that the term "rubber", when used to describe the various embodiments of the scraper 36 or the end cap 46, is used in a general sense and is not meant to limit the material used to construct the scraper 36 or the end cap 46 solely to rubber, but that it will also mean the aforementioned elastomers and other like materials.

Referring now also to FIGS. 4-5 and 9-10, a further alternate embodiment of the plow blade 30' is shown in which the end caps 46' are metal sheets the size of and similar to the blade cap securing plates 48 of the embodiment shown in FIGS. 1-3 and 7-8. These end caps 46' do not extend beyond a bottom 60' of the mold board 32'. It will be appreciated that the embodiment shown in FIGS. 1-3, 7 and 11 can be modified by removing the end caps 46 and simply replacing them with the end cap securing plates 48, which take the place of and become the replacements for the end caps 46, as used in the alternate embodiments shown in FIGS. 4-5 and 9-10. With the exception of the respective different end caps 46 and 46', everything else about these embodiments is generally the same.

Figure 6:
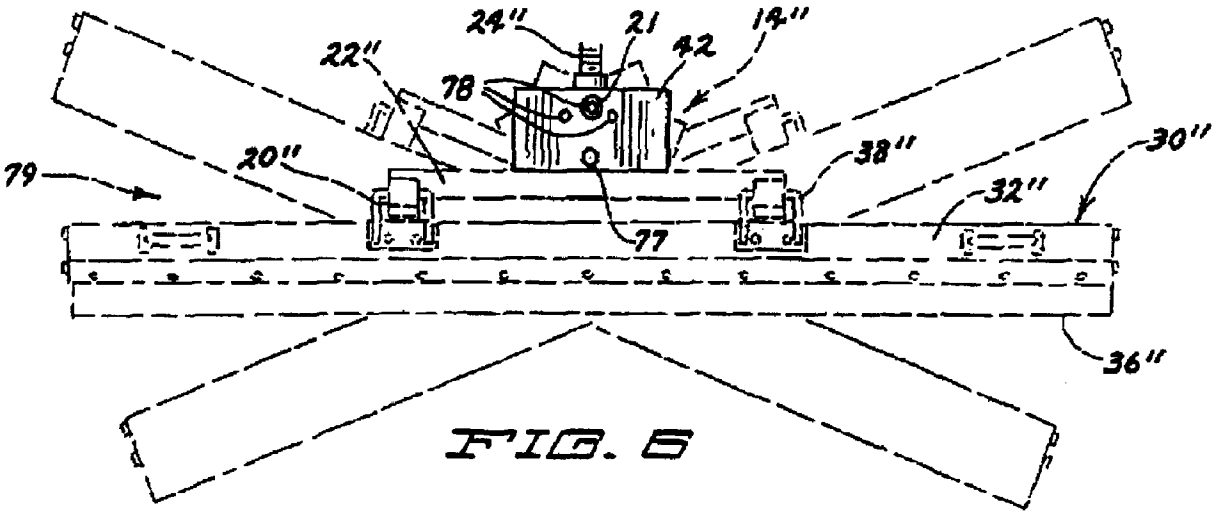
FIG. 6 is a top elevation of a further alternate embodiment of the self-adjusting snow plow of the present invention showing a plow blade 30" in phantom which is the same as that shown in FIG. 5, but showing an alternate mounting apparatus 14" having a pivotal hitch assembly 42 which can be secured to place the plow blade 30" at an angle to a plane perpendicular to a line parallel to a forward direction of the vehicle (not shown)

Referring now also to FIG. 6, a further alternate mounting apparatus 14" is shown in which the mounting uprights 20" are secured to an interconnecting member 22" which is joined to a pair of generally identically shaped, upper and lower parallel plates 42, only one of which is shown, which sandwich and are pivotally connected with an alternate hitch tongue 24" by a pivot pin 77. A removable lock pin 21 is used to secure the plates 42 in one of several positions (as shown in phantom) by removing the lock pin 21 and turning the blade 30" so that holes 78 (shown only in the upper plate shown in FIG. 6) in the respective plates 42 are brought into alignment with a hole in the hitch tongue (not shown).

The plow blade 30' of the second embodiment shown in FIGS. 4-5 and 9-10 has been found to be somewhat more effective than the first embodiment of the plow blade 30 (shown in FIGS. 1-3, 7 and 11), when the plow is pivoted in either direction to push snow to one side or the other of the vehicle 18, because the larger end caps 46 of the first embodiment are not used. This makes it easier for snow to slide off of one end of the plow blade 30', 30" or the other when the plow blade is being pushed forward. It is possible to address this potential enhancement by simply removing the end cap 46 from one end of the preferred plow blade 30, when it is used with the alternate mounting apparatus 14", in which case the end cap 46 at the end which is tilted backwards will be the one which is removed and replaced by the end cap securing plate 48 to permit snow to easily slough off of or away from that end of the plow blade 30, rather than collect snow, which may make plowing operations more difficult.

In FIG. 1, the preferred plow blade 30 is shown in a working orientation in which the retention members 38 encircle the respective mounting uprights 20. As the snow plow 10 is pushed forward and force is applied to the plow blade 30 and the rubber scraper 36, the rubber scraper has a tendency to bend backward due to frictional forces exerted at its lowermost edge, furthest removed from the mold board 32. As shown, the rubber scraper will generally bend at a deflection or pivot point 81 located about half way between the end of the plow blade 30 and the surface being plowed. As will be appreciated, the tendency of the rubber scraper is to return to its undeflected state. In this way, the rubber scraper 36 can have a lifting effect on the plow blade 30, forcing the plow blade and retention member 38 to slide upward along the mounting uprights 20 in a constrained manner until the retention member 38 strikes a catch structure 50 at an upper end 52 of the mounting uprights 20 as shown in phantom in FIG. 1. In alternate embodiments shown elsewhere (see FIGS. 14, 26-28 and 29-30), the upward movement of the retention member 38 relative to the mounting upright is restricted by a retention pin (80 in FIGS. 14 and 82 in FIGS. 26-28 and 29-30), which will limit the upward movement of the retention members 38, so long as the pin or pins are engaged in the respective attachment members 51'''', 351 and 351'.

Figure 4:
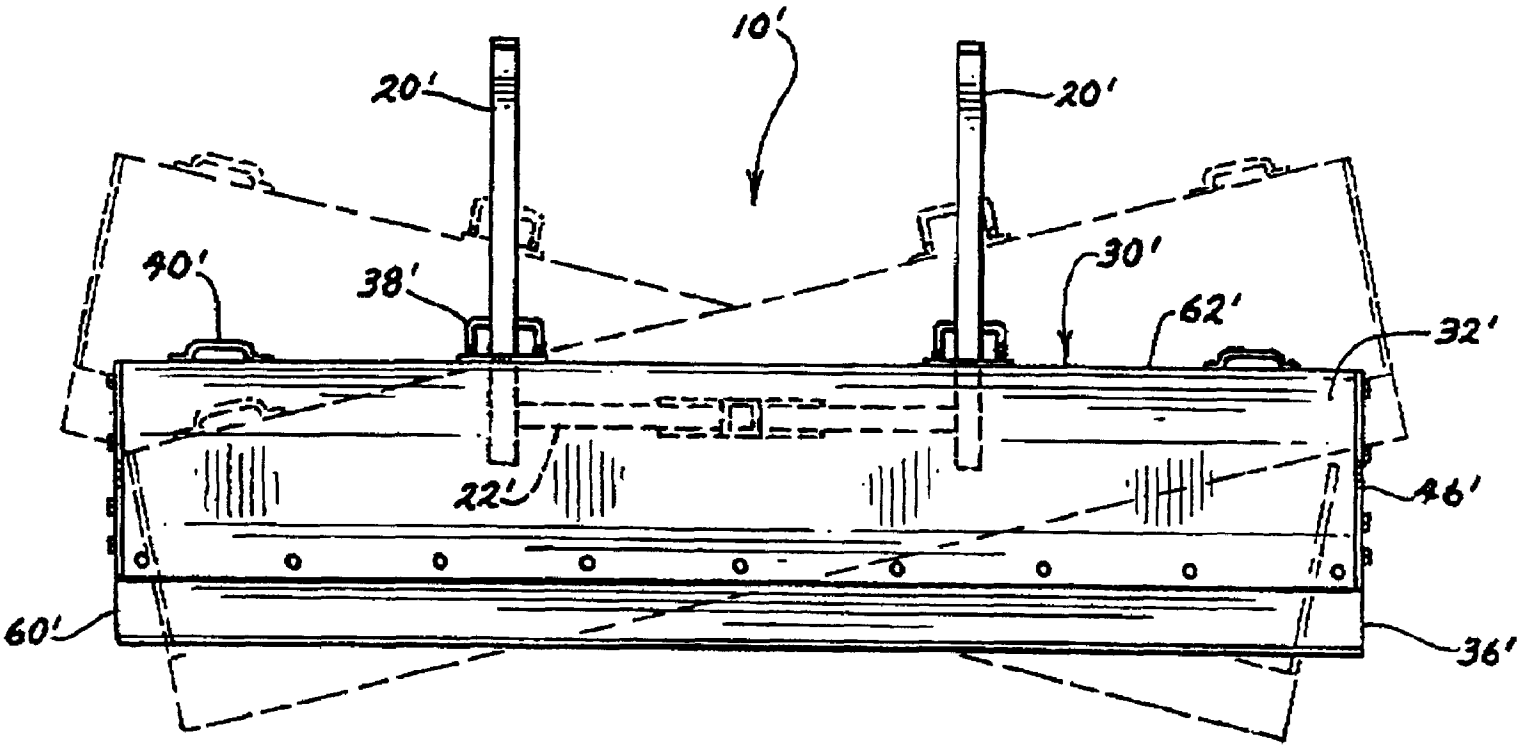
FIG. 4 is a front elevation of an alternate self-adjusting snow plow 10'; the plow blade 30' is shown in a working orientation and is shown in phantom in further working orientations when one end or the other is raised with respect to the mounting uprights 20'.
Figure 5:
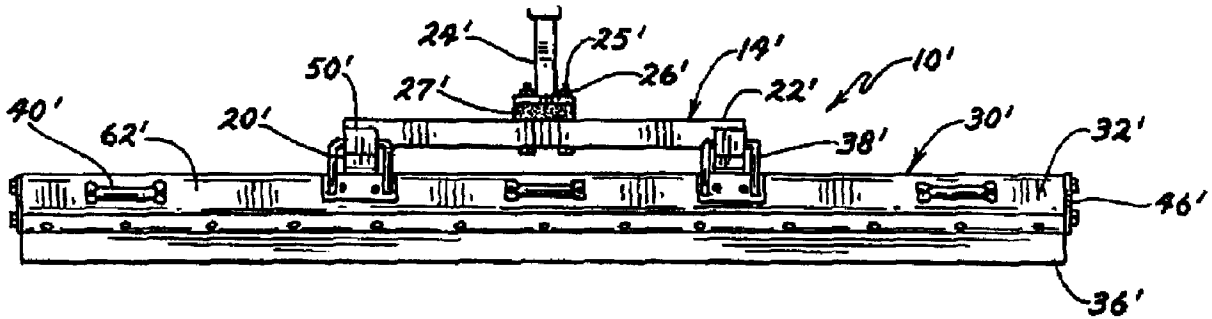
FIG. 5 is a top elevation of the self-adjusting snow plow 10' shown in FIG. 4.
Figure 9:
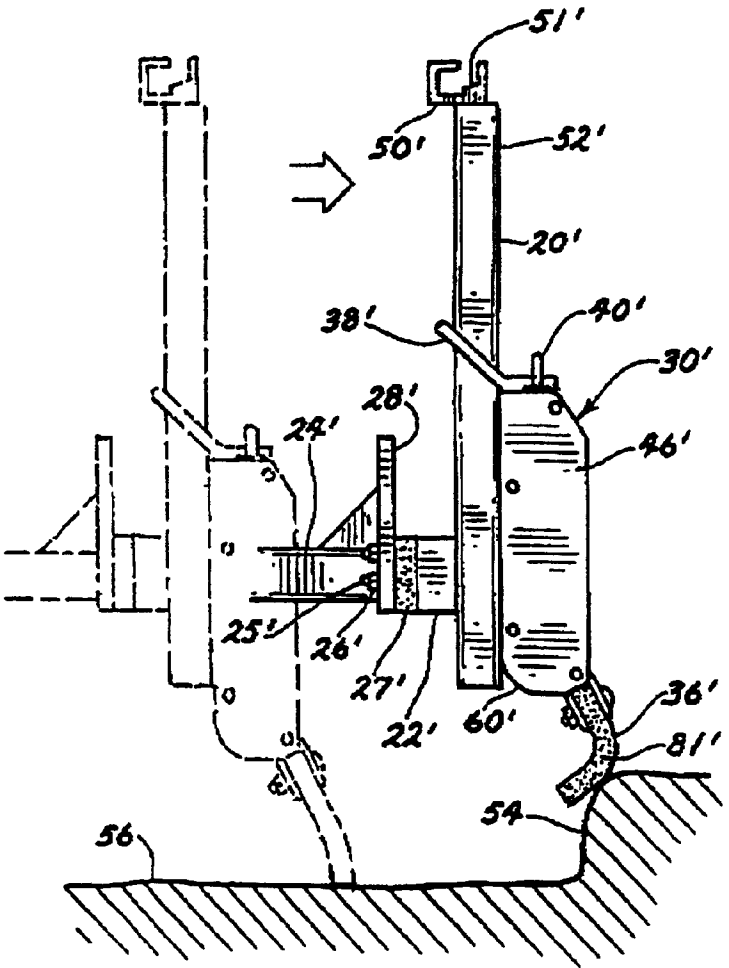
FIG. 9 is a side elevation of the alternate self-adjusting snow plow 10' shown in FIGS. 4 and 5 illustrating how the plow blade 30' slides upwardly with respect to the mounting uprights 20' when it moves forward and comes into contact with a relatively immovable object on the ground 56, wherein the drawing illustrates in phantom the plow blade 30' in a working orientation as it is moving forward toward such a relatively immovable object and also showing the plow blade once it has moved upward with respect to the mounting uprights 20' after the rubber scraper 36' has come into contact with such a relatively immovable object.

Referring now also to FIG. 9, which shows the alternate embodiment shown in FIGS. 4 and 5, it is noted that the retention member 38' will also slide upward in a constrained manner when the rubber scraper 36' comes into contact with a relatively immovable object 54 along the ground 56 such as a curb or the like. As shown in FIG. 1, the rubber scraper 36 will also bend backwards at its lowermost edge when it is pushing a mass of accumulated snow 58.

Figure 10:
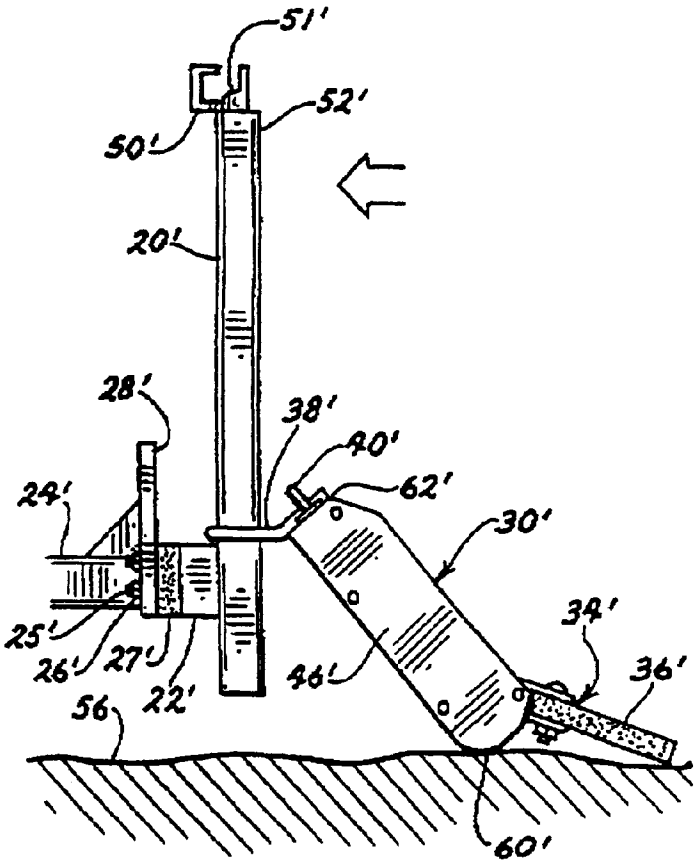
FIG. 10 is a side elevation of the alternate embodiment of the self-adjusting snow plow 10' shown in FIGS. 4-5 and 9 showing how the bottom of the plow blade 30' pivots outward away from the mounting uprights 20' when the vehicle (not shown), to which the self-adjusting snow plow 10' is attached, moves backward drawing the plow blade 30' with the vehicle.

Referring now also to FIG. 10, when the vehicle 18 (not shown) is placed in reverse and the plow blade 30' is drawn backwards, the bottom 60' of the plow blade 30' will naturally pivot away from the mounting uprights 20' because the plow blade 30' is only secured at the top 62' by the retention members 38' which act, in essence, as slideable hinges upon which the plow blades 30, 30' (etc.) of the present invention can move along the length of the mounting uprights, and which can pivot to a limited degree in such circumstance.

Referring now also to FIGS. 8 and 11, in which the first embodiments of the adjustable snow plow 10 and the plow blade 30 are shown, when a vehicle (not shown) goes into reverse and the plow blade 30 is dragged backwards, the retention members 38 allow the plow blade 30 to slide downwardly along the mounting uprights 20. When this occurs, an angle a2 is formed between the plane 29 of the uprights and the plane 64 of the main surface of the plow blade 30. As the angle a2 increases, the rubber scraper 36 is raised above the ground 56 because the end caps 46 extend well beyond the bottom 60 of the mold board 32 and the scraper holding channel 34 provided by the mold board 32 for the rubber scraper 36; this permits snow and gravel and debris to pass below the rubber scraper 36 when the plow blade 30 is dragged backwards. This is advantageous in certain situations where there is a desire not to draw snow backwards with the plow blade 30. When using other devices, it is often necessary to lift the plow blade 30 so as to not draw snow 58 backwards when taking the vehicle in reverse. In this case, however, the extension to the plow blade 30 provided by the end caps 46 raises the bottom of the mold board 32 and the rubber scraper 36, which extends away from the mold board 32 at an angle. Referring now also to FIG. 8, this angle, angle a1, relative to a plane 64 of the main surface 66 (shown in phantom in FIG. 11) of the plow blade 30 is at least about 10°, preferably at least about 20°, more preferably at least about 25°, even more preferably at least about 30°, even more preferably at least about 32° and most preferably at least about 32.5°. In preferred embodiments, the end caps 46 extend below the mold board 32 a distance $d_3$. In preferred embodiments, this distance is at least about 2.0 inches, preferably at least about 2.5 inches, more preferably at least about 3.0 inches, and most preferably at least about 3.5 inches, and even more preferably at least about 4.0 inches.

In preferred embodiments, the rubber scraper 36, 36' is skirtboard rubber which has a thickness, $d_1$, in a range from about 0.5 to about 2.0 inches, preferably about 0.625 to about 1.75 inches and more preferably from about 0.75 inches to about 1.5 inches. In the most preferred embodiments, the thickness of the rubber scraper 36, 36' is about 1.0 inch and it is made of SBR rubber having a durometer hardness of about 6°, although it may be more or less than 60 depending on the nature of the climate of the environment in which it will be used and other considerations, including wear resistance, speed of use and the like. The length of the rubber scraper 36, 36', designated by line $d_4$, is preferably in a range from about 4.0 to about 10.0 inches, more preferably from about 5.0 to about 9.0 inches, even more preferably from about 6.0 to about 8.0 inches. In the most preferred embodiments, the length of the rubber scraper 36, 36' will be about 6.5 inches. In preferred embodiments, the length, $d_2$, of the amount of the rubber scraper 36, 36' which extends beyond the end of the scraper channel 34 of the mold board 32, 32' is preferably from about 3.0 to about 7.0 inches, more preferably from about 4.0 to about 6.0 inches, most preferably about 5.0 inches. In preferred embodiments, the length of the rubber scraper 36, 36' which extends beyond the end of the scraper channel 34 of the mold board 32, 32' is at least about 2.5 inches, preferably at least about 3.0 inches, more preferably, at least about 3.5 inches, even more preferably at least about 4.0 inches, and even more preferably, at least about 4.5 inches, most preferably at least about 5.0 inches.

Figure 12:
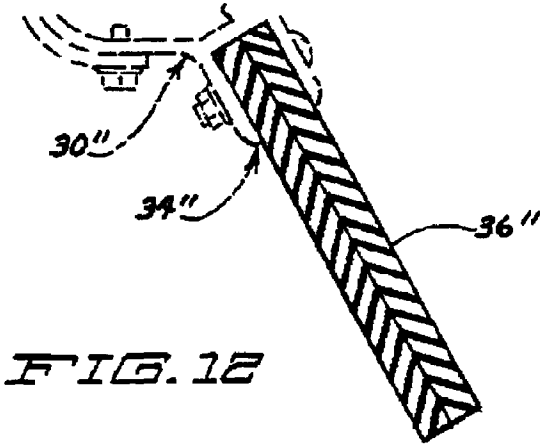
FIG. 12 is a partial side elevation of an alternate plow blade 30" having an alternate rubber scraper 36"

Referring now also to FIG. 12, a further embodiment of the rubber scraper 36'' is shown. In this embodiment, the rubber scraper 36'' is made up of two separate sheets of skirtboard rubber whose top edges are secured to the scraper channel 34' of mold board 32'' in a side by side relation.

Figure 13:
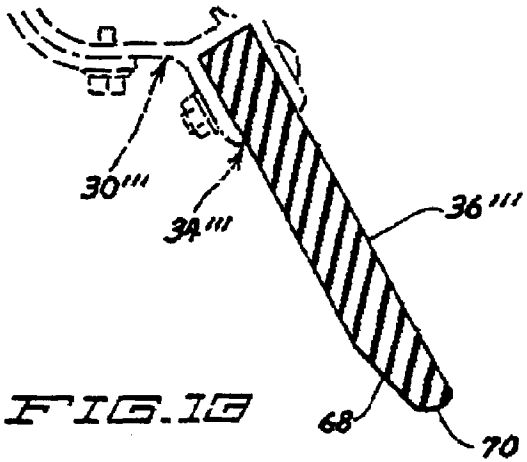
FIG. 13 is a further partial side elevation of an alternate plow blade 30''' showing a further alternate rubber scraper 36'''.

Referring now also to FIG. 13, a further alternate embodiment of the rubber scraper 36''' is shown in which the rear surface of the rubber scraper 36''' includes a slight bevel 68 or chamfer at the lower end or bottom edge 70 of the rubber scraper 36'''.

Referring now again specifically to the first embodiments shown in FIGS. 2 and 3, the plow blade 30 may be moved from a working orientation, similar to that shown in FIG. 1, to a non-working transit orientation or position shown in FIG. 3 by raising one end of the plow blade 30 to the upper end 52 of the mounting upright 20, swinging the bottom 60 of the plow blade 30 outward and away from the mounting upright 20 to permit the retention member 38 to slide back past and over the catch structure 50, and then down into the attachment member 51 where it can be retained as shown in FIG. 3. After this has been done at one end, the same process can be followed to lift the retention member 38 of the opposite end of the plow blade 30 off of the mounting upright 20 so that the retention member 38 can be placed in the attachment member 51 in a manner similar to that shown in FIG. 3. Once both retention members 38 are retained within the respective attachment members 51 at the upper ends 52 of each of the mounting uprights 20, the plow blade 30 will be in a non-working, transit orientation in which the plow blade 30 is not in contact with the ground 56 and the vehicle 18 may be used for purposes other than moving accumulated snow 58 or other materials. Because of the light weight of the plow blade 30, the plow blade 30 can be easily placed in the non-working, transit orientation by an individual.

It is just as easy for an individual to lower the plow blade 30 into a working or operational orientation when it is in a non-working transit orientation. To lower the plow blade 30 into a working orientation, the individual can lift a retention member 38 out of the attachment member 51 at one end, swing the bottom 60 of the plow blade 30 outward so as to generally pivot it away from the mounting upright 20, lift the retention member 38 upwardly and rearwardly out of engagement with the attachment member 51 then lower the retention member 38 over the upper end 52 of the mounting upright 20 and allow the retention member to slide down the mounting upright 20 until the lower extremity of that end of the plow blade 30 comes into contact with the ground 56. Once the first end is in contact with the ground, the user can lift the opposite end in a similar manner, swinging the bottom 60 of the plow blade 30 outwardly so as to pivot the bottom 60 of the plow blade 30 away from the mounting upright 20, so that the remaining retention member 38 can be first of all disengaged from the attachment member 51 and then lowered over the upper end 52 of the mounting upright 20 until the lower extremity of the remaining end of the plow blade 30 comes into contact with the ground 56. At this point, the plow blade 30 will be in a working orientation in which it may be pushed by the mounting apparatus to gather and remove snow or other particulate matter on the surface of the ground 56. In alternate embodiments of the present invention shown in FIGS. 14, 26-28 and 29-30, if the retention pins 80, 83 are removed from the respective attachment members 51"", 351 and 351', it is believed to be especially easy to place the respective retention members in the respective attachment members or remove the respective retention members from the respective attachment members, because once the retention pins 80, 83 are removed, there is no catch member 50, and it is a simple matter to just lift each of the respective ends of the plow blade up and either place them in the respective attachment members or remove them from the respective attachment members and, in the second case, lower that end to the ground. This is especially easy for a single person to accomplish without help from others.

When the plow blade 30 is lowered into the working orientation, it operates simply when the vehicle moves forward and the mounting uprights 20 push the plow blade 30 forward in a manner which will generally cause the resilient rubber scraper 36 to bend in the manner shown in FIG. 1. When the alternate mounting apparatus 14" of FIG. 6 is used to tilt one end of the plow blade 30" back, the mounting uprights 20" still push the blade 30" and the retention members 38" hold the blade 30" in place in front of the mounting apparatus 14".

Referring now especially to FIG. 4, occasionally, the plow blade 30' will encounter greater resistance either to a mass of snow or other relatively immovable objects on one side or the other, causing one end of the plow blade 30' or the other end of the plow blade 30' to ride up on the mounting upright 20' most proximate that particular end of the plow blade 30', as shown in phantom in FIG. 4. Because the preferred retention members 38' have openings 75 which are significantly larger than the mounting uprights 20', the plow blade 30' can ride up on one end or the other until retention member 38' is stopped by the catch structure 50 at the upper end of the respective mounting upright 20 or by a retention pin 80, 83 as shown in other embodiments (See FIGS. 14, 26-28 and 29-30).

It will be appreciated that the retention members 38, 38' are designed and constructed to provide an opening 75 which is large enough to allow a person to lift one end of the plow blade 30, 30' up and disengage the retention member 38, 38' from the respective mounting upright 20, 20' with which it is engaged when it is in a working orientation. At the same time, however, the opening 75 has been designed and constructed to disengageably secure the mold board 32, 32' of the plow blade 30, 30' is a manner which will not allow the retention member 38, 38' to slide all the way to the upper end 52, 52' of the mounting upright 20, 20' without eventually striking the catch structure 50 or a retention pin 80, 83 as shown in other embodiments (See FIGS. 14, 26-28 and 29-30), which will prevent the plow blade 30, 30', 130 from being accidentally disengaged from the mounting uprights 20, 20', 120, 120'.

Figure 14:
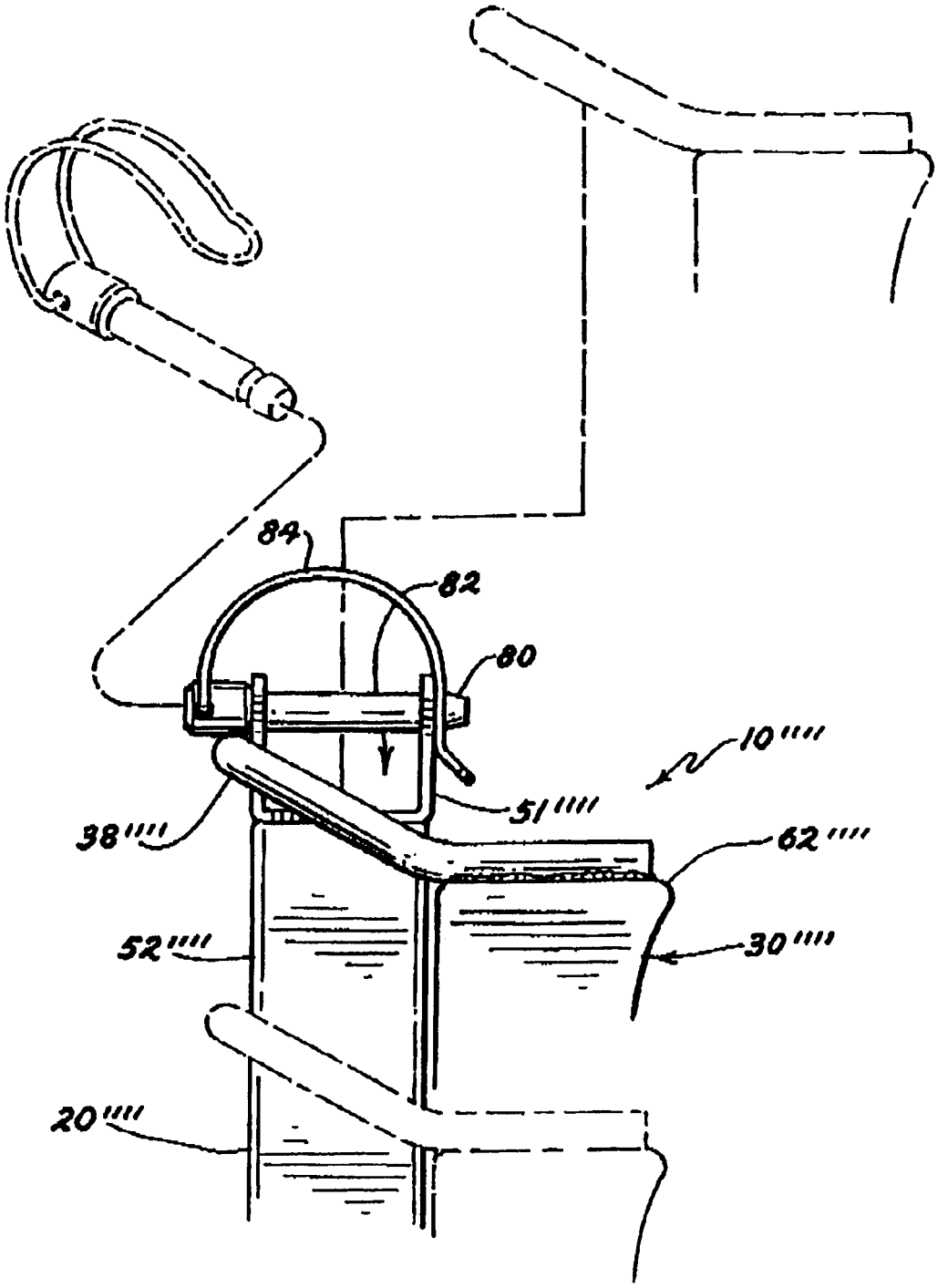
FIG. 14 is a side elevation of a portion of a further alternate embodiment of the present self-adjusting snow plow 10'''' showing an alternate catch structure at the upper end of the mounting upright 20'''' which also includes an alternate attachment member including a removable pin 80 with which to secure the retention member 38'''' within the attachment member 51''''.

Referring now also to FIG. 14, which shows a further alternate embodiment of the snow plow 10"" in which the retention members 38"" are stopped by a retention pin 80 which is secured within an alternate attachment member 51"". In this embodiment, the retention pin 80 must be removed in order to lift the retention member 38"" off of the upright 20"" and position the retention member 38"" within the attachment member 51"". Once the retention member 38"" is positioned within the receiving opening 82 of the attachment member 51"", the retention pin 80 can be inserted through openings (not shown) in respective sides of the attachment member 51"" and secured with a bale or spring wire 84. Although not shown, a spring loaded ball bearing pin (not shown) can also be used in such an attachment member 51"". In this embodiment, the function of the retaining pin 80 makes the need for a catch, such as catch 50 shown in FIGS. 1-3, essentially unneeded so long as the retention pin 80 is in place when the snow plow 10"" is in use.

Figure 15:
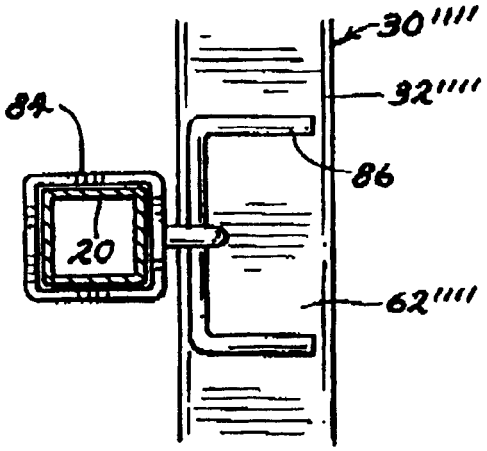
FIGS. 15 and 16 are top plan views of alternate retention members 84, 84.
Figure 16:
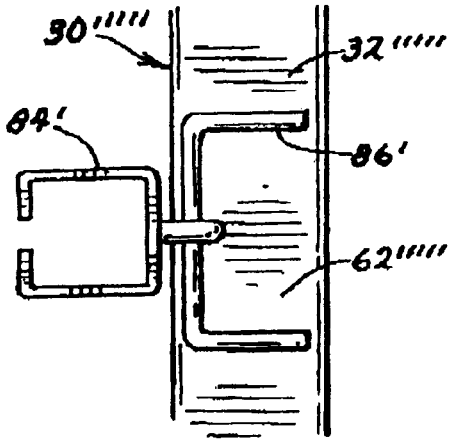
Figure 17:
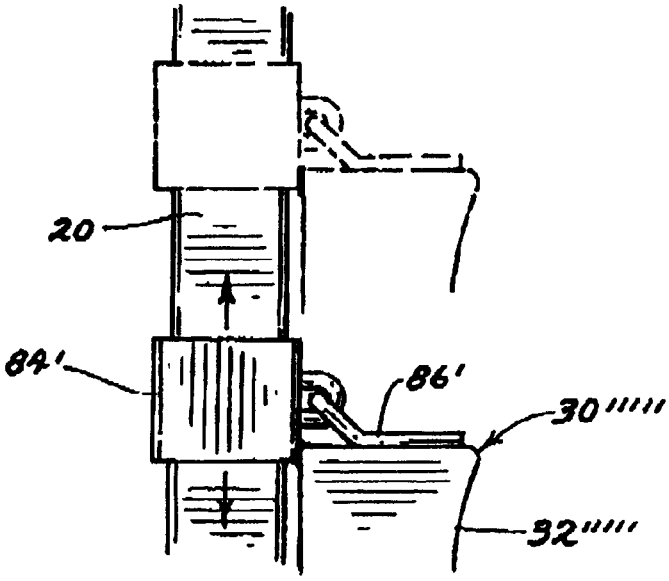
FIG. 17 is a side elevation of the alternate retention member 84' shown in FIG. 16.

Referring now also to FIGS. 15-17, retention members 84, 84' are shown which differ significantly from previously discussed retention members 38, 38', 38", 38'" and 38"" in that they are sleeve-like or collar structures that slidingly engage the mounting uprights in a telescopic, constrained manner. These retention members 84, 84' at least partially encircle the mounting uprights 20 and 20'. As seen in FIG. 15, one retaining member 84 completely encircles the mounting upright 20 and is pivotally interconnected with the alternate mold board 32"" by a securing loop 86, which is welded to the top of the mold board 32"". In FIG. 16, a similar retaining member 84' is shown in which the retaining member 84' only partially encircles the mounting upright.

Figure 18:
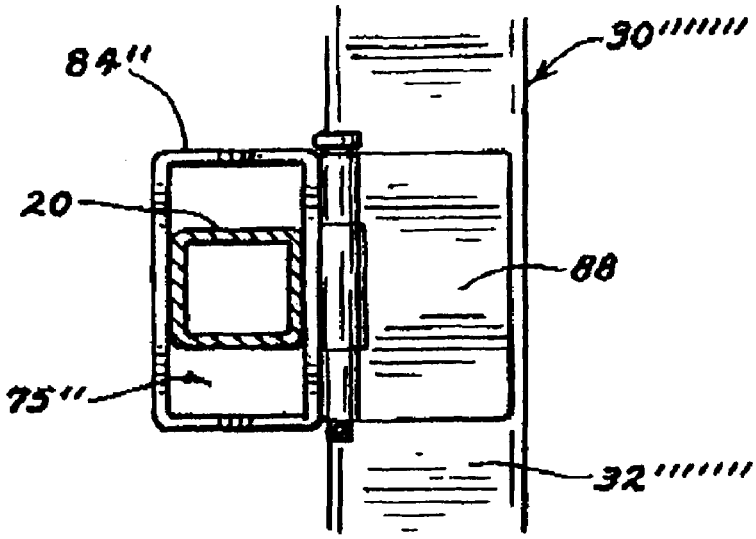
FIG. 18 is a top plan view elevation of a further alternate retention member 84", which is pivotally secured to the alternate plow blade 30'''''.
Figure 19:
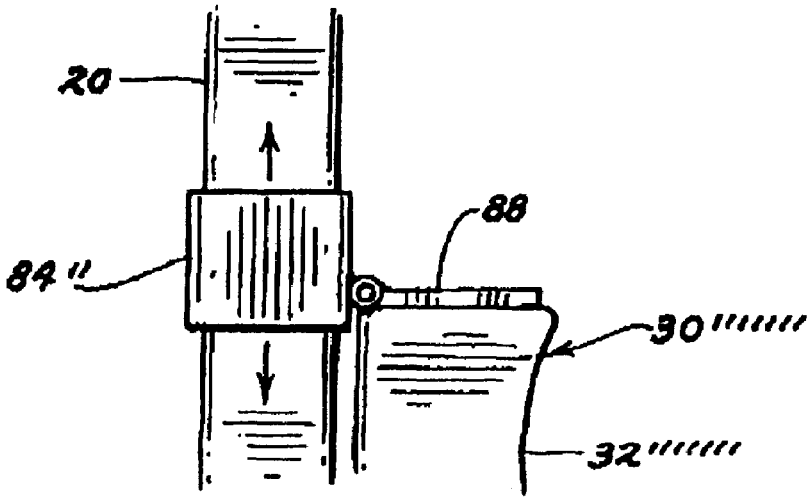
FIG. 19 is a side elevation of the alternate retention member 84" shown in FIG. 18.

Referring now also to FIGS. 18 and 19, a further embodiment of a retaining member 84" is shown, which has a larger opening 75", thereby giving the mounting upright 20 the ability to move not only from side to side within the opening 75" but to be skewed relative to the retaining member 84". Retaining member 84" is pivotally attached to a securing plate 88 which is welded to the alternate mold board 32"". It will be appreciated that the retaining member 84" may also have an slotted side similar to that shown in FIG. 16 for retaining member 84'.

Figure 20:
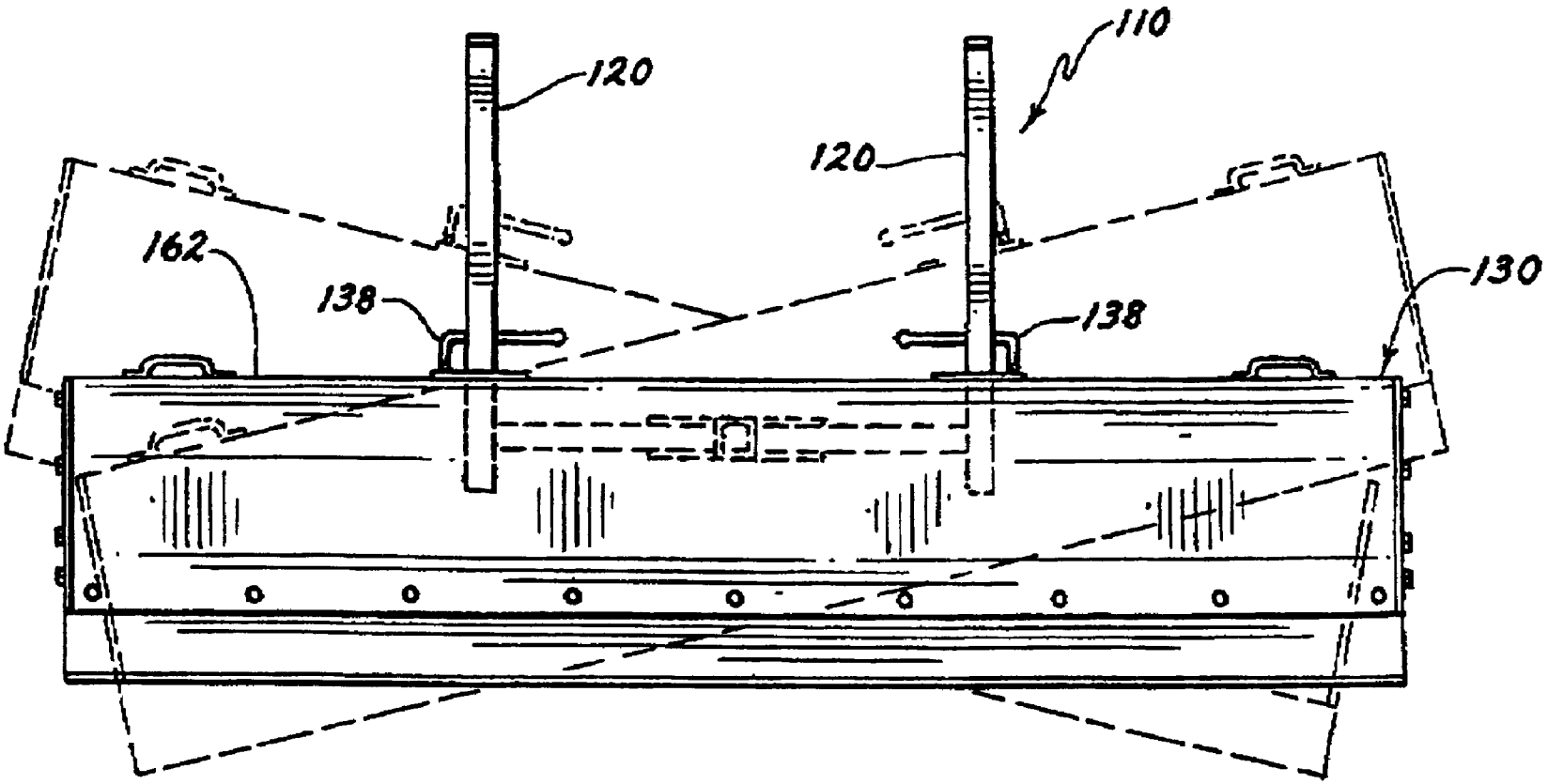
FIG. 20 is a front elevation of an alternate self-adjusting snow plow 110; similar to that shown in FIG. 4 where the plow blade 30' is shown in a working orientation and is shown in phantom in further working orientations when one end or the other is raised with respect to the mounting uprights 20', but the plow blade 130 includes alternate first and second retention members 138, each of which just partially encircles one of the respective mounting uprights 120.
Figure 21:
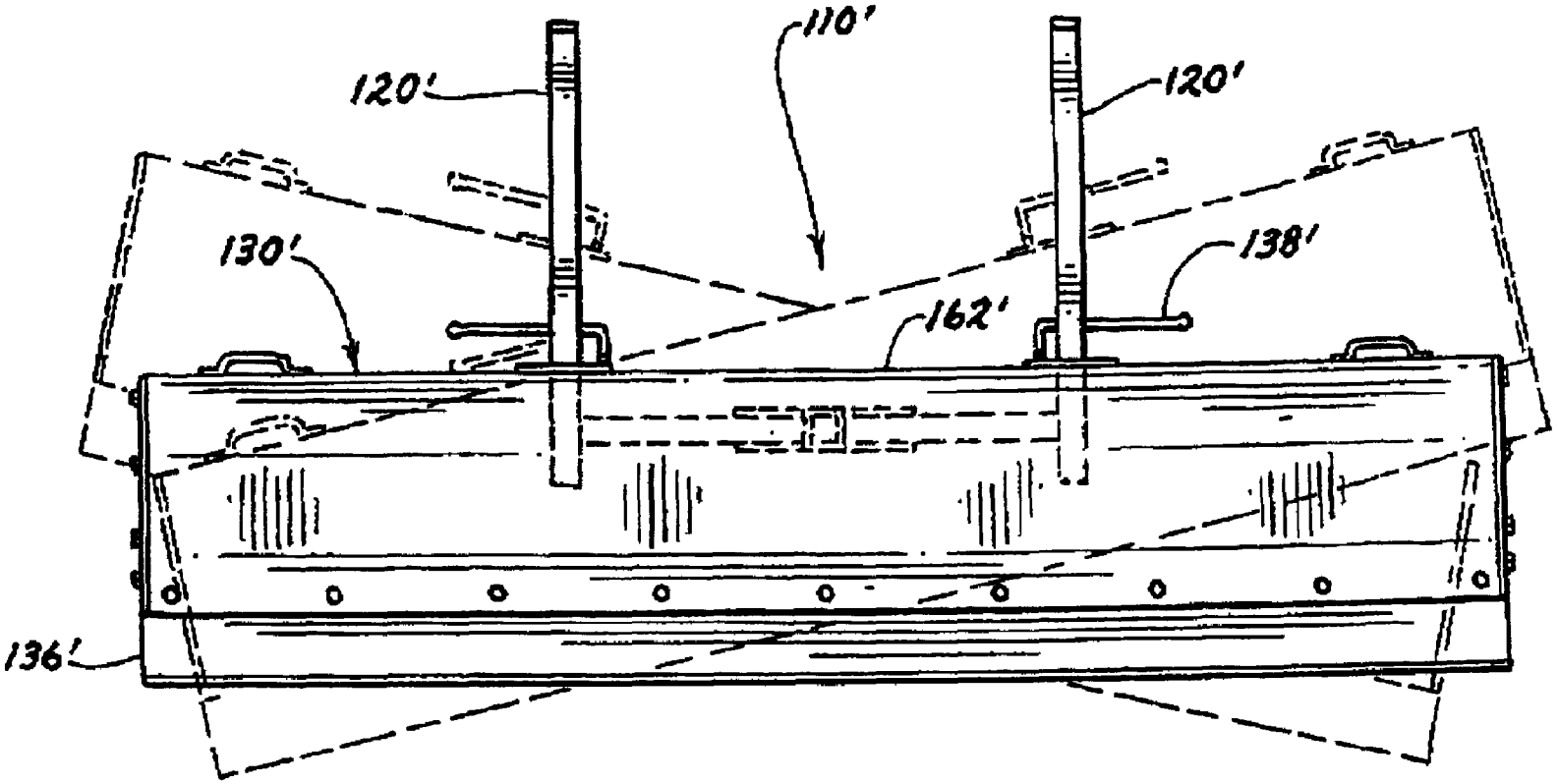
FIG. 21 is a front elevation of an alternate self-adjusting snow plow 110'; similar to that shown in FIG. 4 where the plow blade 130' is shown in a working orientation and is shown in phantom in further working orientations when one end or the other is raised with respect to the mounting uprights 120', but the plow blade 130' includes further alternate first and second retention members 138', each of which just partially encircles one of the respective mounting uprights 120'.
Figure 22:
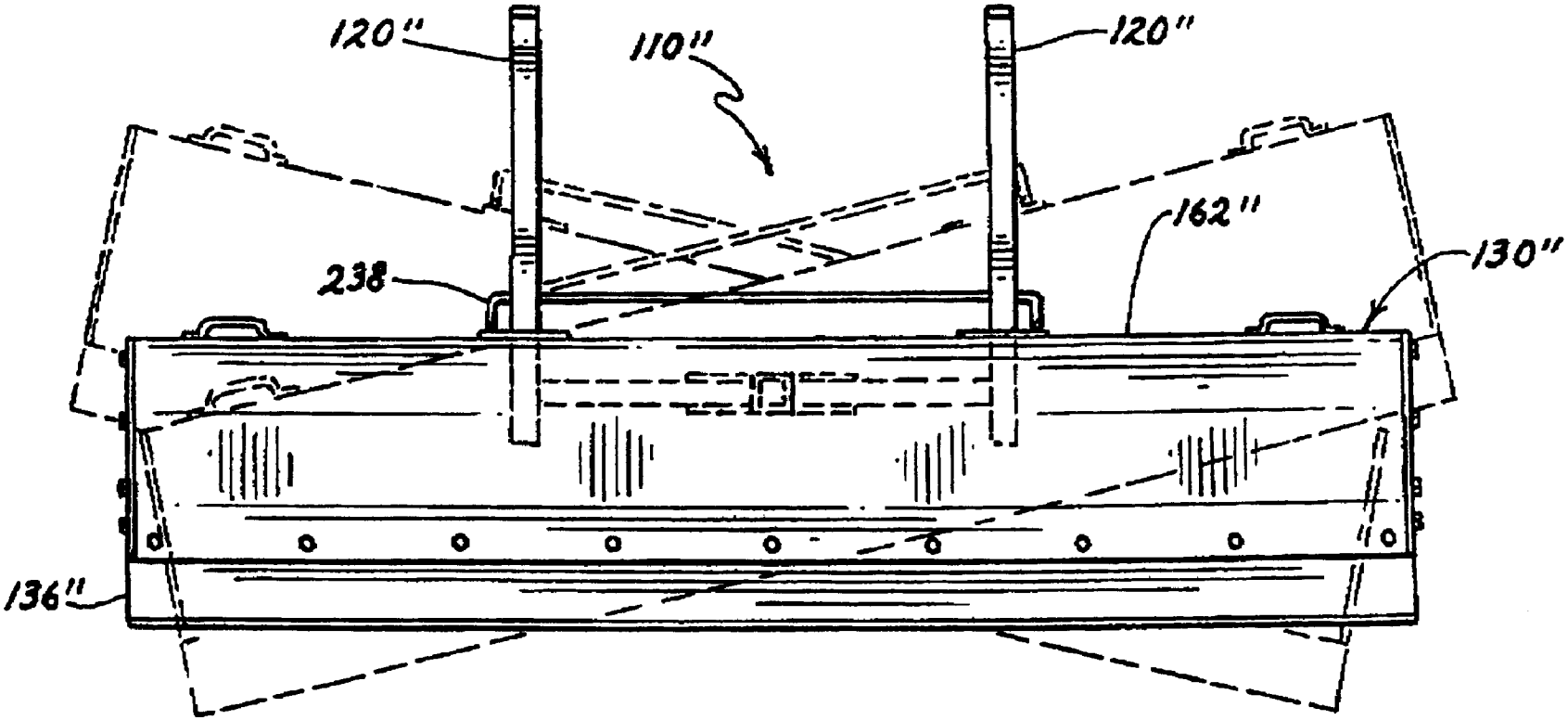
FIG. 22 is a front elevation of an alternate self-adjusting snow plow 110"; similar to that shown in FIG. 4 where the plow blade 130" is shown in a working orientation and is shown in phantom in further working orientations when one end or the other is raised with respect to the mounting uprights, but the plow blade only includes a single retention member 238 which encircles both of the mounting uprights.

Referring now also to FIG. 20, an alternate embodiment of the snow plow 110 is shown having alternate retention members 138 which only partially encircle the mounting uprights 120 when the plow blade 130 is in a working orientation as shown. Referring now also to FIG. 21, a further embodiment to the snow plow 110' is shown having further alternate embodiments of the retention members 138', extending in an opposite direction as compared to that shown in FIG. 20, but once again only partially encircling the mounting uprights 120' when the plow blade 130' is in a working orientation as shown. Referring now also to FIG. 22, a further alternate embodiment of the snow plow 110" is shown in which a single retention member 238 is attached to the plow blade 130". The retention member 238 is shown in a working orientation and encircles each of the respective mounting uprights 120". Referring now also to FIG. 23, a further alternate embodiment of the plow blade 110'" is shown in which a single retention member 238' is attached to the plow blade 130'". The retention member 238' is shown in a working orientation and only partially encircles each of the respective mounting uprights 120'". In each of the aforementioned alternate snow plow embodiments, the plow blade may be disengaged from the respective mounting uprights one mounting upright at a time or, as is also the case with each of the other aforementioned embodiments, the plow blades may be disengaged from the mounting uprights at the same time, if both ends of the plow blade are lifted and disengaged at the same time.

In the aforementioned preferred embodiments, best illustrated in FIGS. 7 and 8, the mold board 32 of the plow blade 30 includes a bottom 60, a rear surface 61, a top 62, and a main surface 66 that define a hollow or space 69. The hollow or space 69 of the hollow-core mold board may be provided with one or more support structures 71, 72, 73, which extend between the main surface 66 and the rear surface 61, and along the width of the plow blade 30. As will be appreciated, the support structures 71, 72, 73, which form compartments or cells within the hollow 69, add strength to the plow blade. It will be appreciated that the mold board can be further strengthened by providing the compartments or cells with filler material such as expanded foam, without departing from the spirit and scope of the invention. Preferably the hollow-core plow blade 30 is extruded aluminum structure. In the most preferred embodiments, the aluminum surface will be clear anodized aluminum which is particularly attractive for consumers. Although the mold board can be extruded into two pieces (see FIGS. 49 and 50) which are subsequently assembled, the preferred embodiment is a one-piece extrusion which saves both on cost for aluminum and on cost for assembling the mold board. In preferred embodiments, the plow blade will weigh less than about 150 pounds, preferably less than about 110 pounds. The entire snow plow 10, including the mounting apparatus will preferably weight about 250 pounds or less, more preferably about 225 pounds or less.

When force is applied to the rubber scraper 36 of the present invention, the bottom of the rubber scraper 36 will bend backwards as shown in FIG. 1 and in FIG. 9 in reference to the alternate embodiment of a plow blade 30'. The rubber scraper 36 will generally bend at a generalized deflection or pivot point 81' which is located just below the lower edge of the scraper channel 34 within the mold board 32. In softer rubber material having a durometer hardness of 40 or 50, the rubber scraper 36 tends to bend more. For that reason, harder rubber material having a durometer of at least about 60, perhaps as much as about 70 or 80, are preferred.

When installing the mounting apparatus 14, it is easiest to install the mounting uprights 20 in a perfectly vertical position as this is easiest to corroborate if a carpenter's level is available for use during the installation. It is possible, however, to install the mounting apparatus so that the mounting uprights 20 are tilted either backward or forward a small amount. This will change the operational characteristics of the snow plow. When, for example, the uprights 20 are installed with a backward or negative tilt, the plow blade 30 will tend to rise somewhat more easily when it comes into contact with immovable objects, including accumulated snow 58 on the ground 56. By contrast, when the uprights 20 are installed with a forward or positive tilt, the plow blade 30 will not rise up on the mounting uprights 20 quite as easily as it will when the mounting uprights 20 are perfectly upright. In certain situations, however, it may be desirable to tilt the uprights 20 forward about two and one-half degrees from vertical. This can cause the rubber scraper 36 to flex to a higher degree and appears to have a shock dampening effect during snow removal. Also, because the mounting uprights 20 are tilted forward, it has an added effect of keeping the plow blade 30 down when it is in use. In certain situations, this is most desirable as a user may be able to obtain superior results when the blade 30 rises somewhat less readily or when the scraper 36 comes under a lower degree of force. In this regard, it is also noted that the rubber scraper 36 should extend outwardly beyond in front of the mold board 32. It is believed that if the rubber scraper 36 were straight up and down, the blade 30 would flex too easily and allow snow 58 to pass under the blade 30 and result in poor snow removal. It will be appreciated that the mounting apparatus can be installed with a forward or backward tilt by providing shims, which can take the form of washers or spacers that can be used with upper and lower sets of fastening elements. It is also noted that when the plow blade 30 is perpendicular to the direction of travel the rubber end caps 46 will tend to bow outwardly beyond the ends of the blade even as great as 90 degrees. This is desirable as it allows the blade to catch more snow when moving it.

An alternative embodiment of the mounting apparatus 14" of the present invention is shown in FIG. 6, in which the angle of the plow blade 30" can be varied in relation to its direction of travel. This embodiment features a pivotally mounted snow plow 79 and allows the user to discharge snow to either side of the plow vehicle. In this embodiment of the invention, the connection of the hitch tongue 24" to the plow blade 30" is facilitated through the use of a pivot plate 42 and a pivot pin 77. The pivot plate 42 which is fastened to the interconnecting member 22" includes an aperture 76 that is configured to receive a pivot pin 77. The pivot pin 77 also passes through a first aperture at the end of hitch tongue 24", which is connected to a vehicle (not shown). As will be understood, the pivot pin 77 enables the pivot plate 42 and its attendant plow blade 79 to rotate or swivel in a generally horizontal plane relative to the hitch tongue 24" and its attendant vehicle.

Additionally, the pivot plate 42 and the hitch tongue 24" are equipped with a plurality of alternate holes or apertures, which, when used in conjunction with a locking pin 21, are used to lock the pivoting plow 79 into positions that push snow straight ahead, as shown in FIG. 6, or to the left or the right as shown in phantom in FIG. 6. In particular, pivot plate 42 includes holes 78 that are configured to receive the lock pin 21, and the hitch tongue 24" includes a second aperture that is configured to receive lock pin 21. In operation the plow blade 30 is rotated about pivot pin 77 until the holes in the pivot plate are aligned with the second aperture in the hitch tongue 24". Once the alignment is achieved, the lock pin 21 is inserted through both the holes and the aperture. This allows the user to employ this embodiment of the present invention in a plurality of orientations. The first of these is to lock the pivoting plow 79 in the position in which the plow blade 30" is generally perpendicular or square in relation to the line of travel. Conversely, to employ the side discharge function, the user simply locks the pin 21 in the desired alternate locking holes 78 to discharge the snow on a desired side of the vehicle (not shown) pushing the snow plow. It will be appreciated that the lock pin 21 need not engage the second aperture in the hitch tongue 24" in order for the plow blade to be secured. The plow blade 79 could also be secured by two lock pins or a U-shaped lock bar whose arms are received by holes 78 and which engage the outer surfaces of the hitch tongue 24". In addition, it will also be appreciated that the plow blade 79 can be secured at angled positions by one lock pin 21 and a portion of the pivot plate structure. In this instance, the lock pin 21 and the pivot plate structure would engage the outer surfaces of the hitch tongue 24".

Referring now also to FIGS. 24, 25A, 25B, and 26-28, a commercial embodiment of the self-adjusting snow plow 310 is shown. The self-adjusting snow plow 310 includes a mounting apparatus 314 having a transition apparatus 323 that is attachable to a mounting frame 309. The transition apparatus 323 includes a hitch tongue 324 which can be received by a hitch receiver 316 (shown in phantom) that is attached to the front of a vehicle (not shown) in a manner similar to that disclosed in relation to the embodiment shown in FIGS. 1 and 7. The transition apparatus 323 also includes a bell-shaped housing or subframe 311, which will be further described below. The bell-shaped housing or subframe 311 is movably interconnected to the hitch tongue 324 by an extension 308 that is pivotally connected to the bell-shaped housing or subframe 311 by a pivot pin 377 in a manner similar to pivot pin connection of FIG. 6, discussed previously. The housing or subframe 311 includes a plate 328 that is secured to the interconnecting member 322 of the mounting frame 309 by a series of bolts 325 secured by a series of nuts 326. The mounting frame 309 includes a pair of mounting uprights 320, preferably 33 inches apart on center, connected by the interconnecting member 322.

The plow blade 330 includes a mold board 332 having upper and lower attachment channels 301, 302, respectively, in which a variety of parts or elements, described below, can be secured or anchored. As shown, the channels have constricted portions and enlarged portions and are configured to be used with conventional fastening elements having elongated bodies terminating with enlarged heads, preferably by a series of complimentary fastening elements, such as, for example, threaded bolts 303 received by a series of reciprocally threaded nuts 304, preferably square or hex-headed nuts. As will be appreciated the channels are sized to slidingly receive the enlarged portions of the fastening elements and include oppositely facing flanges that form a constriction or slot. In addition, the channels are preferably sized so that the flats of the enlarged heads contact the side walls 401 and 402, 403 and 404 of channels 301 and 302, respectively, and the fastening element is prevented from axial rotation. Alternatively, a square or hex head of a threaded bolt can be secured in the channel and the nuts can be used to secure the respective parts to the bolt. In this regard, it will be appreciated that while threaded bolts and reciprocally threaded nuts are preferred, other fastening mechanisms known in the art may be used to secure the various parts of the present invention to the plow blade.

The plow blade 330 also includes end caps 346 and end plates 348 similar to those described in relation to the embodiments disclosed in relation to FIGS. 1-3, 7-8 and 11. In addition, a pair of guide shafts 387 are secured to the respective ends of the mold board 332, preferably with a pair of fasteners, one of which is normally used to secure the end plate 348 and the end cap 346 in a constricted channel 349 in the extruded aluminum mold board (see FIGS. 25A and 25B), which also illustrate a preferred rubber scraper 336 similar to those disclosed in relation to the first embodiment of the present invention disclosed in FIGS. 1 and 7-8, as well as the scraper channel 334 in the mold board 332 in which the rubber scraper 336 is secured.

Although a two piece or multiple piece aluminum extrusion can be used to form the mold board 332, (see for example FIGS. 49 and 50) a single piece aluminum extrusion may be more efficient and to provide a more cost effective structure in so far as no assembly is required. On the other hand, a two piece construction may be more efficient and cost effective in so far as it can use smaller, less expensive dies that can be integrated into more manufacturing facilities. The mold board 332, shown without any attachments in FIG. 25B, is the most preferred embodiment of the mold board. It comprises a bottom 331, a mold board or main surface 332, a top 333, and a rear surface 335. It also includes a series of internal support structures 353, 354, 355 that strengthen the mold board 332 by extending between and connecting the rear wall 335 and the main surface of the mold board 332, just as the internally reinforcing support structures in the earlier embodiments strengthen the mold board 32 of FIG. 8, which has been previously disclosed. In general, with regard to the support structures of the previously discussed embodiments, the support structures are shown as being parallel to each other. However, this need not be the case in order to practice the invention. For example, the support structures may be angled relative to each other.

The plow blade 330 disclosed in FIGS. 24, 25A, 25B and 26-28 includes two lifting handles 340 on opposite ends of the mold board 332, anchored in the upper attachment channel 301, two retention hooks 341, also secured in the upper attachment channel, but placed closer to the middle of the mold board 332, and two retention apparatus assemblies 337, each including a retention member 338 welded to a retention plate 339 that is anchored to the mold board by fastening elements such as threaded bolts 303 secured to reciprocally threaded nuts 304. As shown, the threaded nuts 304 are received in attachment channels 301 and 302, and serve as attachment points for threaded bolts 303. It will be appreciated, however, that the positions of the nuts and bolts may be reversed, if so desired, without departing from the spirit and scope of the invention.

Figure 24:
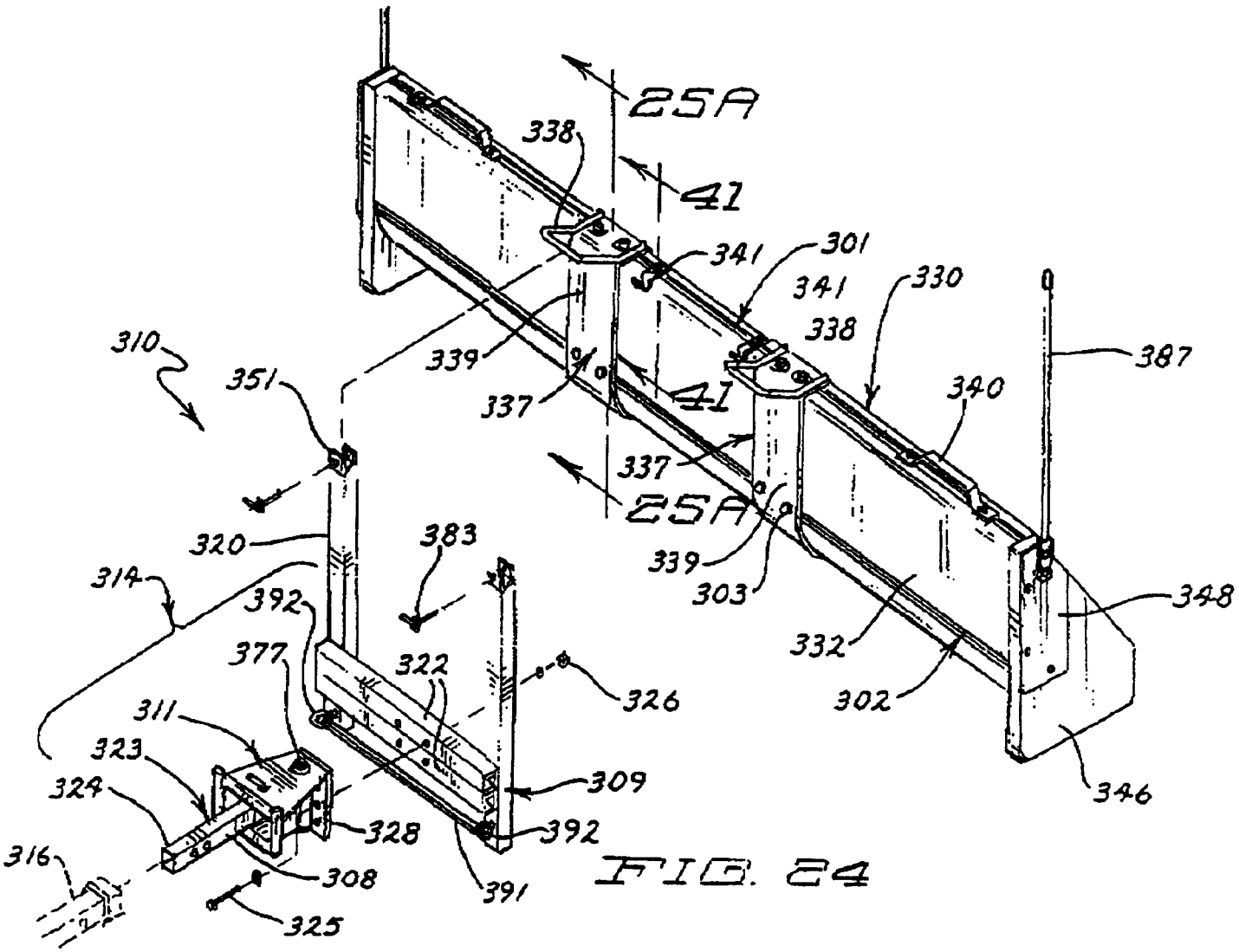
FIG. 24 is an exploded perspective view, similar to that shown in FIG. 7, but showing a new embodiment of the snow plow 310 of the present invention having an extruded aluminum mold board 332 having attachment channels 301, 302; and showing another alternate mounting apparatus 314 having a pivotal swivel apparatus 311 for pivoting the mounting frame 309 with respect to the direction of travel of the vehicle (not shown) in a manner somewhat similar to the manner in which the alternate mounting apparatus 14", shown in part in FIG. 6, functions, but in a different way; and also providing alternate mounting uprights 320 having alternate attachment members 351, and also showing engagement apparatus (e.g. retention hook 341) for engaging to the plow blade 330, a resilient elongated member 391, secured to the alternate mounting apparatus 314 when the plow blade 330 is in a working orientation for use during snow plowing operations.

In preferred embodiments, the snow plow apparatus 310 can be provided with a mechanism or a device that is constructed and arranged to exert a downwardly biasing force on the plow blade 330, when the plow blade 330 is secured to the mounting apparatus 314 in a working or operational orientation. It is believed that this downwardly biasing force will improve snow removal operations in certain circumstances that cause the plow blade 330 to ride up on the mounting uprights 320 of the mounting frame 309. In FIG. 24, a preferred mechanism or device 391 is shown for exerting such a downwardly biasing force on the plow blade 330, namely an elongated tensioning member 391, that will be described in greater detail below. Preferably, the elongated tensioning member 391 is secured to the mounting frame 309 using fastening elements 392 such as eye-bolts or hooks. It is then stretched over the retention hooks 341 on the mold board 332 to exert the downwardly biasing force on the plow blade 330 when the plow blade is in a working orientation. It will be appreciated that other mechanisms and devices could be used to provide such a downwardly biasing force on the plow blade 330 such as, for instance, compression or tension spring elements connected between the mounting frame 309 and the mold board 332, free weight members securable to the mold board 332, or combinations thereof and the like. Furthermore, in alternate embodiments, it is envisioned that an alternate elongated tensioning member could be first attached or secured to the mold board and then secured to the mounting frame to place a downwardly biasing force on the plow blade.

Figures 25A, 25C:
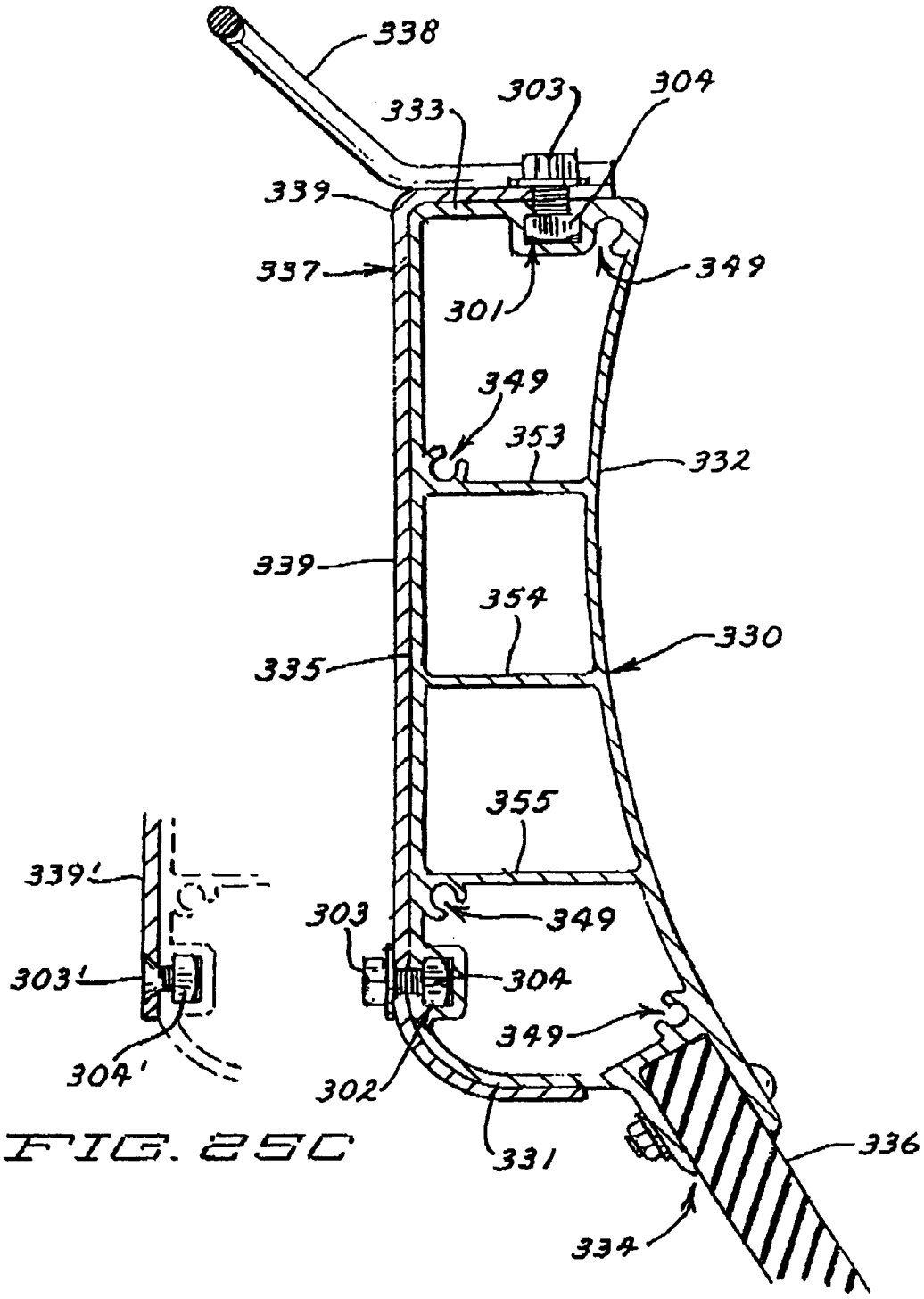
FIG. 25A is a cross-sectional side view of the alternate plow blade 330 of the improved snow plow 310 shown in FIG. 24, as seen from the line 25-25 in a manner similar to that shown in FIG. 8 for the embodiment shown in FIG. 7.
FIG. 25C is a view similar to that shown in FIG. 25A, but showing only a portion of the plow blade 330 that is changed to shorten the metal plate 339' to which the retention member is welded and to provide a counter-sunk screw 303' that secures into the nut 304' in the attachment channel 302, rather than a bolt and washer as shown in the embodiment shown in FIG. 25A.
Figure 25B:
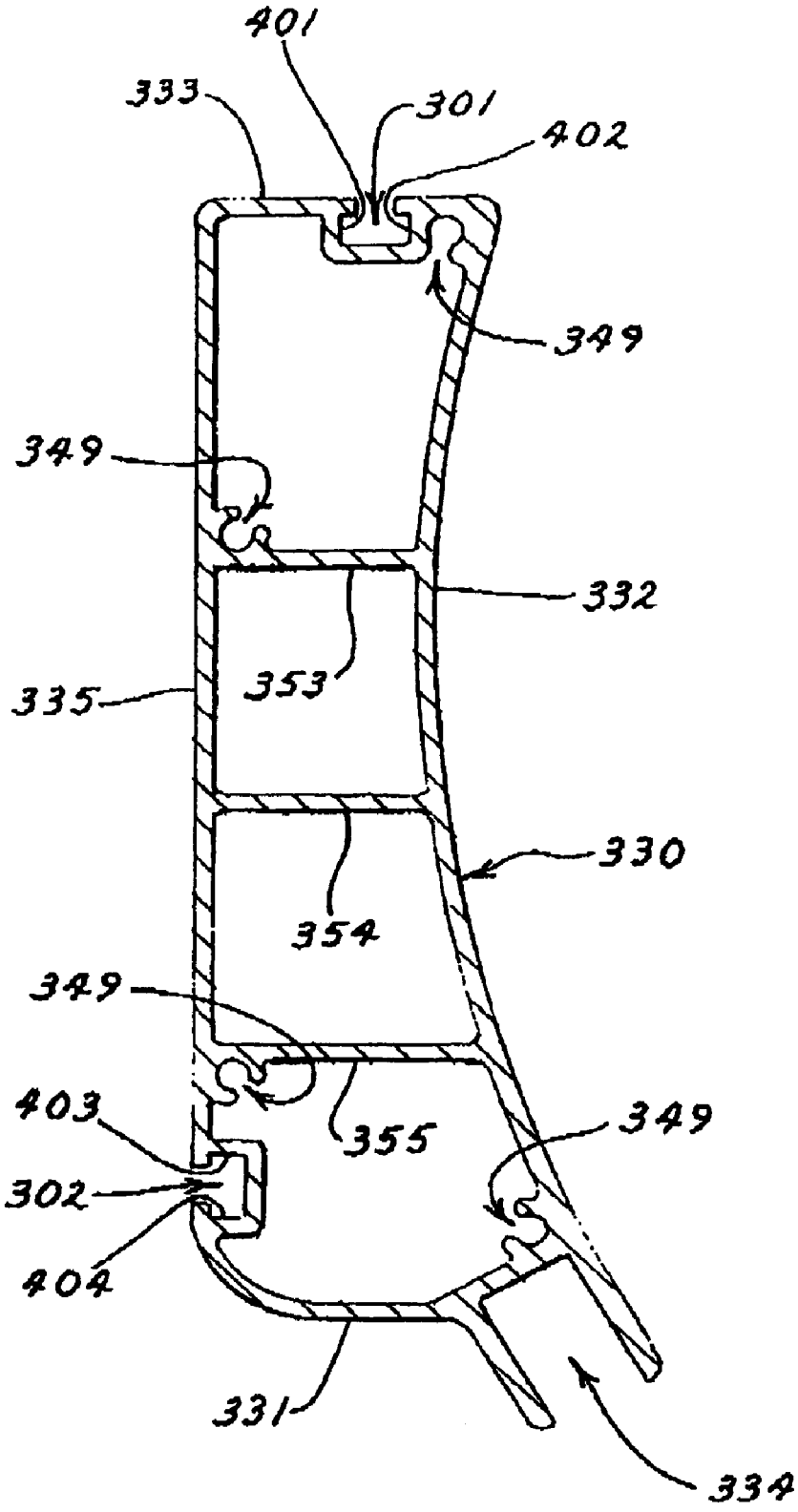
FIG. 25B is a cross-sectional side view just like that shown in FIG. 25A, except that only the mold board 332 is shown and all the other parts of the plow blade 320 shown in FIG. 25A have been removed to show the attachment channels.

Referring now also to FIG. 25C, an alternate retention plate 339' is shown in part where it differs from the alternate retention plate 339 shown in FIGS. 24, 25A and 25B, only in that it is truncated at the bottom 331 of the mold board 332 and does not extend as far as the retention plate 339 shown in FIG. 25A. The alternate retention plate 339' is more cost effective, due in part to lowered tolerance requirements associated with fabrication because it omits the bend that would otherwise mimic the bend in the bottom 331 of the mold board. The alternate retention plate 339' uses one or more counter sunk threaded bolts 303' shown in FIG. 25C having a conical head to secure the lower portion of the retention plate 339' in the lower channel 302.

Figure 26:
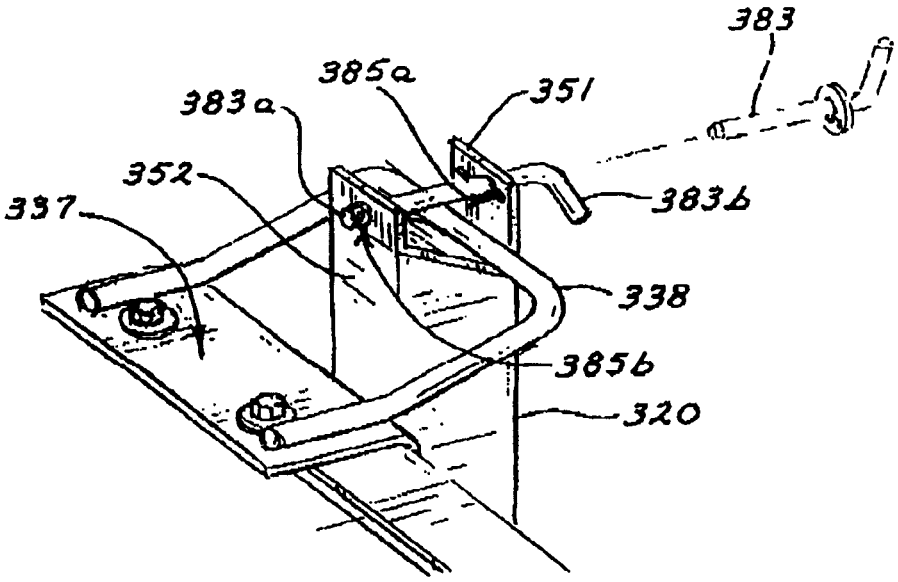
FIG. 26 is a perspective view of a portion of the alternate snow plow 310 shown in FIG. 24, but from a different perspective than that of FIG. 24; one that is slightly less elevated and from about 180 degrees from the view shown in FIG. 24 in a horizontal plane, and showing a retention member 338 of the alternate plow blade 330 engaged in the mounting upright 320 of the alternate mounting apparatus and also showing an additional securing pin 383 in phantom, in an orientation in which it would have to reside in order to be either inserted or removed from an alternate securing pin slot 385*a* of the alternate attachment member 351 shown in this Figure.
Figure 27:
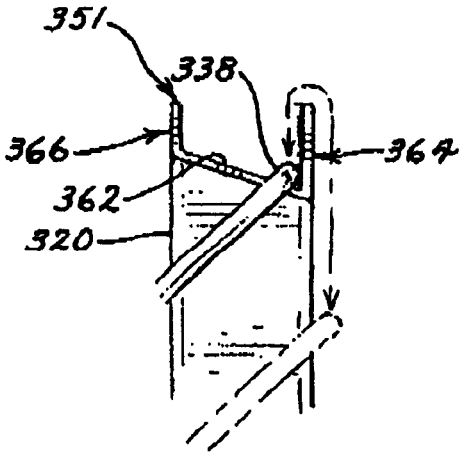
FIG. 27 is a partial side elevational view of elements of the alternate snow plow 310 shown in FIG. 24, that are shown in FIG. 26, with the exception that the securing pin 383 is removed and the retention member 338 is shown in phantom in a transitional orientation in which the retention member 338 would occasionally pass through when the plow blade 330 is either placed in or removed from a resting, non-operational, or transit position, and the retention member 338 is either placed in or removed from the attachment member 351, before or after being in a working or operational position similar to that shown in FIGS. 1 and 9.
Figure 28:
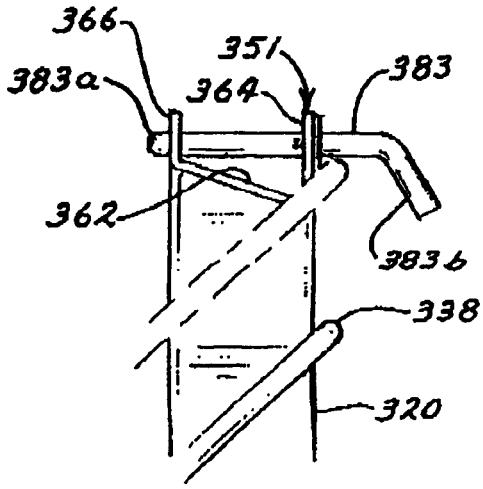
FIG. 28 is a partial side elevational view similar to FIG. 27, but showing the securing pin 383 in an engaged position in the attachment member 351 of the alternate mounting upright 320 and the retention member 338 in solid line, but showing movement of the retention member 338 in phantom to a raised position.
Figure 29:
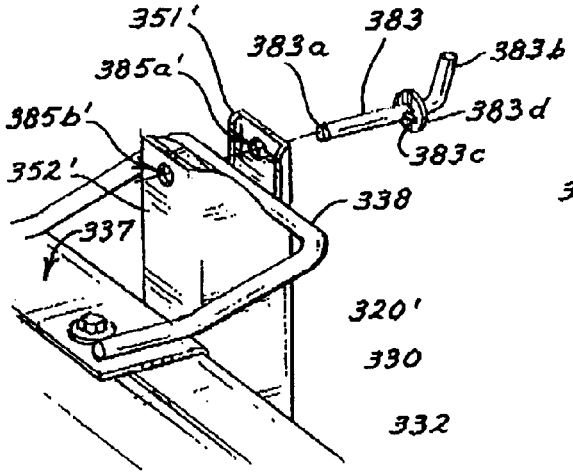
Figure 30:
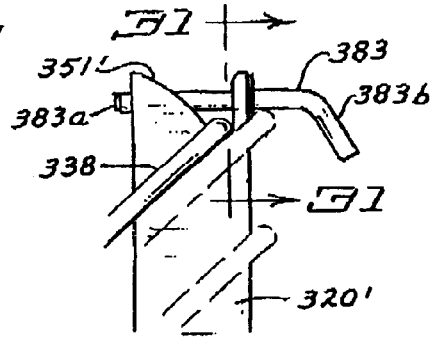
FIG. 30 is a side elevational view, similar to that shown in FIG. 27, but showing the alternate mounting upright 320' and attachment member 351' shown in FIG. 29, and showing the securing pin 383 in the receiving slot 385*a'*, with additional retention members 338 shown in phantom to demonstrate how the securing pin 383 can limit the upward movement of the retention member 338 along the mounting upright when the retention member 338 is slideably secured on the mounting upright 320' and is not within the attachment member 351'.

Referring now with particularly to FIGS. 26-28, the alternate mounting uprights 320 include an alternate attachment member 351 that is secured to the top 352 of each of the mounting upright 320. As shown in the figures, the attachment member 351 includes a base 362, a first arm or end wall 364 and a second arm or end wall 366 and, the retention member 338 can be secured between the arms 364, 366 of the attachment member 351 by a retention pin 383 that is inserted through a slotted aperture 385*a* and an aperture 385*b* located in arms or end walls 364 and 366, respectively. The retention member 338 can only be removed from the attachment member 351 if the retention pin 383 is disengaged from the attachment member so that the retention member 338 can be lifted up and over the tops of the arms. As will be understood, if the retention member 338 is lifted up and over arm or end wall 366, that portion of the plow blade will be completely disengaged from that particular mounting upright. Whereas if the retention member is lifted up and over arm or end wall 364, the plow blade can then be lowered into a working orientation as the retention member 338 slides down along the outer extremity of the mounting upright 320. As shown particularly in FIG. 28, the retention member 338 is slidingly constrained to move freely along the exterior of the mounting upright 320, but it is limited if the retention pin 383 is inserted in the apertures 385*a*, 385*b* of arms 364, 366 of the attachment member 351. In this way, if the plow blade 330 travels upward along the mounting upright 320, its upward travel along the mounting upright will be limited by the handle portion 383*b* of the retention pin 383 that will stop the retention member's upward travel when the retention member 338 comes into contact with the retention pin 383.

Figure 29:
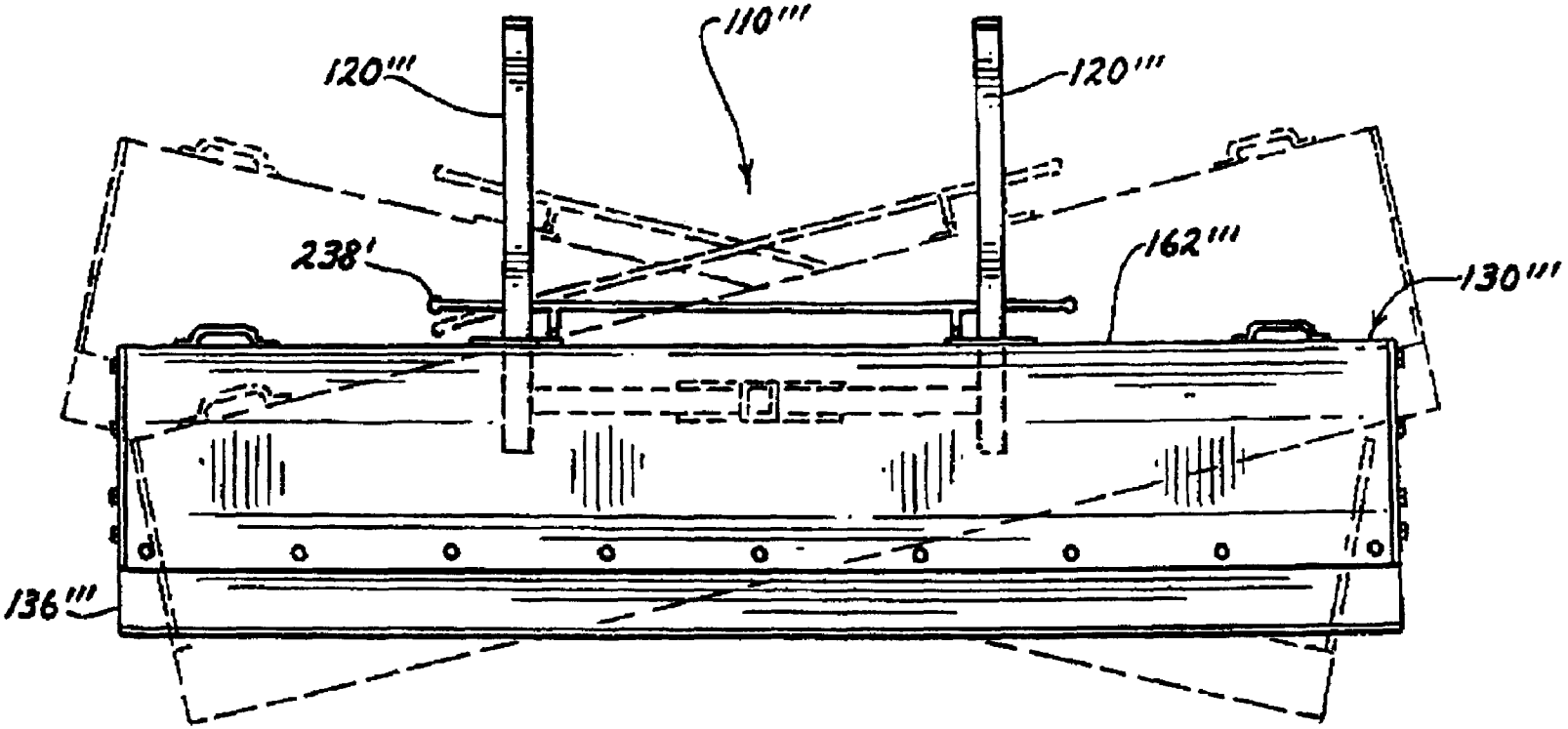
FIG. 29 is a partial perspective view of a further alternate mounting upright 320', shown in a manner similar to that shown in FIG. 26, but showing yet another embodiment of the mounting upright 320' having an attachment member 351' cut into the upper portion of the mounting upright 320', and showing the securing pin 383, in a partial exploded view, out of the securing pin receiving slot 385*a'* in an orientation that will permit it to be inserted in the slot 385*a';*
Figure 31:
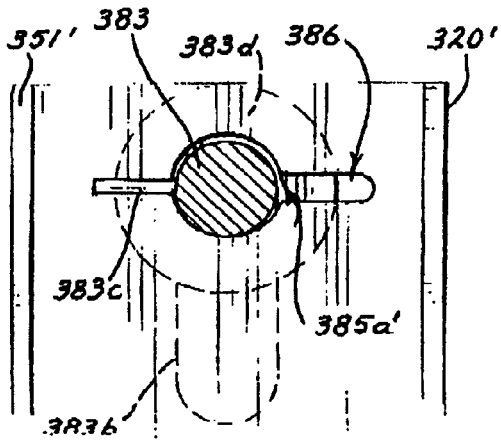
FIG. 31 is a front elevational view taken from line 31-31 of FIG. 30, showing a cross-section of the securing pin 383 and showing the pin 383 in place in the receiving slot 385*a*' as shown in FIG. 30, and showing the handle 383*b* of the securing pin 383 in hidden line, behind the upper portion of the mounting upright 320', pointing in a downward, resting position.
Figure 32:
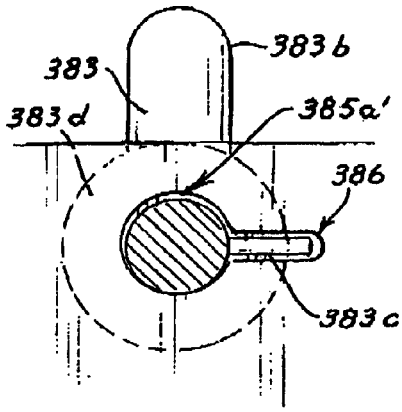
FIG. 32 is a view similar to that shown in FIG. 31, but showing the handle 383*b* of the securing pin 383 in an upright position, or orientation, in which it must reside in order to be effectively inserted or removed from the pin receiving slot 385*a*' of the alternate attachment member in the upper portion of the alternate mounting upright.
Figure 9B:
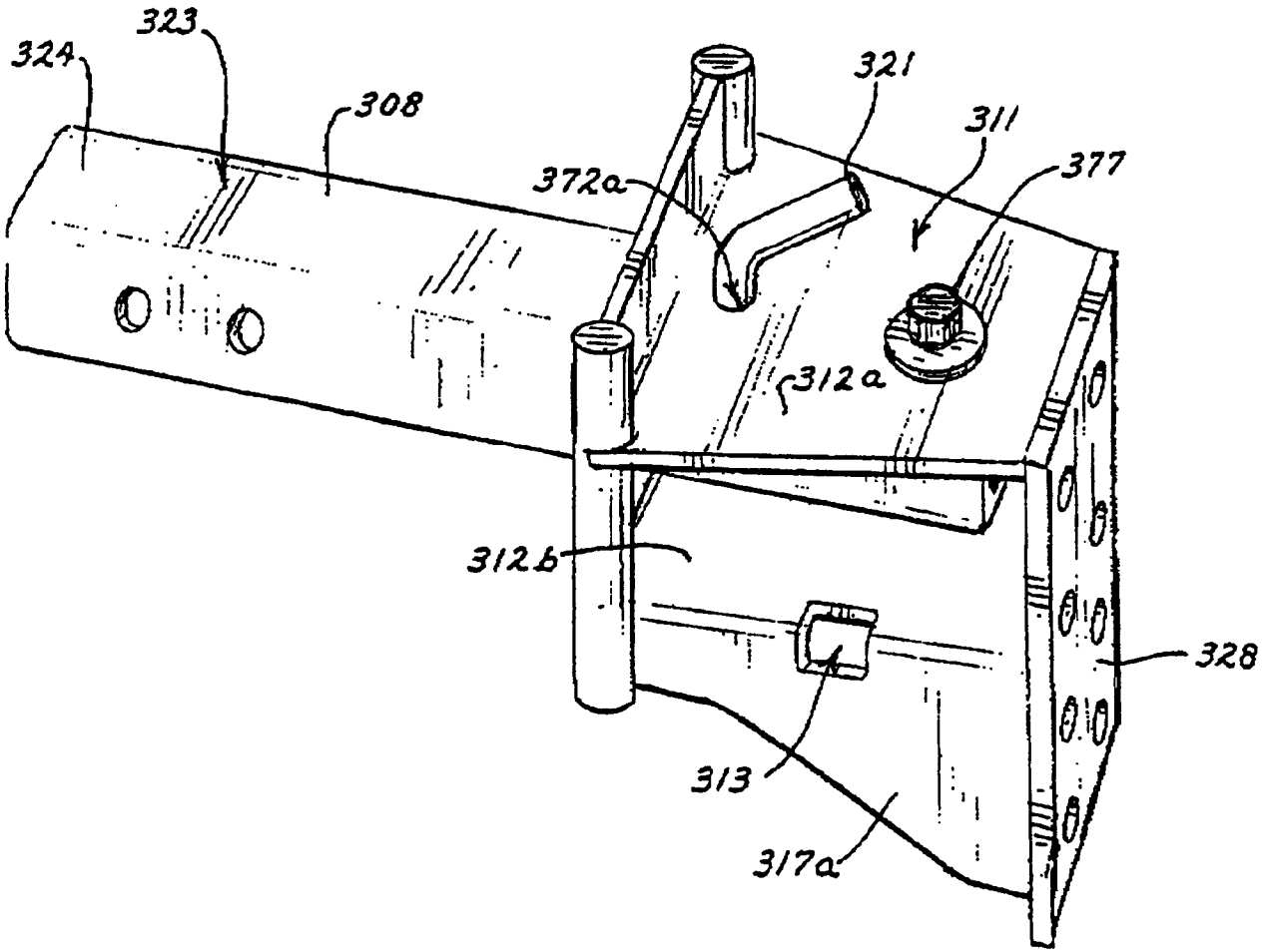
Figure 95:
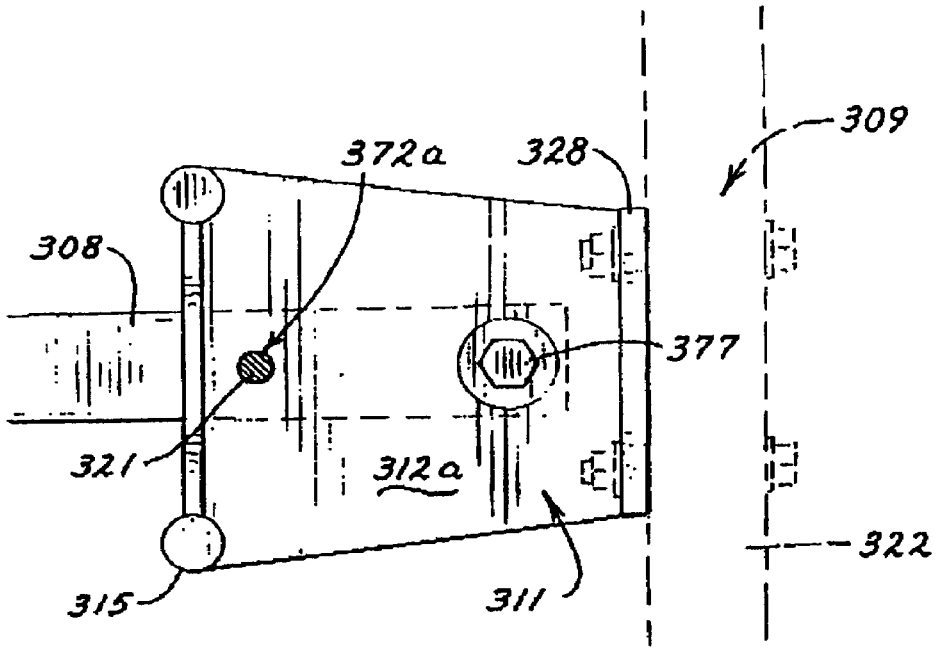
Figure 94:
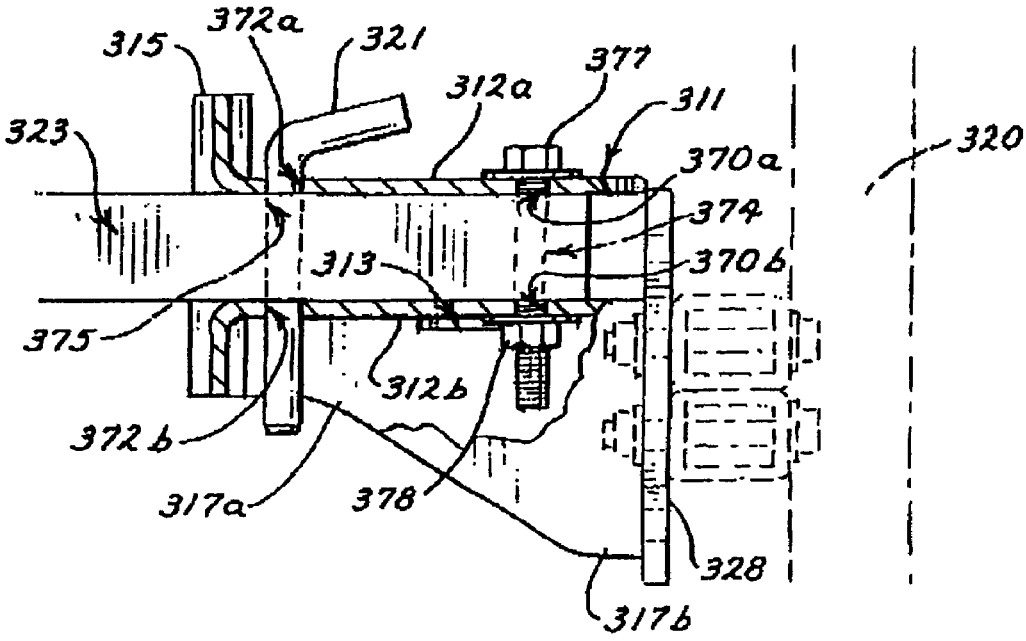

Referring now also to FIGS. 29-32, a further alternate embodiment of the attachment member 351' is shown as a cut away in the upper portion 352' of a further alternate mounting upright 320'. The retention pin 383 can be inserted into a pair of retention slots or apertures 385*a*' and 385*b*' and passed through end walls of the attachment member 351' so that the end 383*a* of the retention pin 383 passes through a receiving opening or apertures 385*b*' on the opposite side of the attachment member 351' in a manner that is the same as the manner in which the retention pin 383 is inserted in the previously described attachment member 351 shown in FIGS. 24 and 26-28. In each case, the retention pin 383 is insertable into the retention slot 385*a*' when the retention pin handle 383*b* is in an upright position as shown in FIGS. 29 and 32 and in phantom in FIG. 26. The end 383*a* of the retention pin 383 is then passed through the retention slot or slotted aperture 385*a* and then through the receiving opening or aperture 385*b*'. It will be appreciated that the handle 383*b* of the pin 383 has sufficient weight so that it will be drawn by gravity to a downward position, 180° from the upward position shown in FIG. 29 and FIG. 32.

As shown in FIGS. 31 and 32, the retaining pin 383 is able to be inserted into the retaining pin receiving slot or slotted aperture 385*a*' when the retaining pin resides in an upright position, as shown in FIG. 32. In this position a securing arm 383*c* of the retaining pin 383 will pass through a slot 386 extending horizontally outward from the center of the retaining pin receiving slot or aperture 385*a*' to accommodate passage of the securing arm 383*c* of the retaining pin 383. Once the retaining pin 383 passes far enough into the slotted aperture 385*a*' and the receiving opening aperture 385*b*' so that the stop plate 383*d* of the retention pin is contacts the exterior of the plate or end wall of the attachment member 351', the securing arm 383*c* will be positioned within the interior of the attachment member 351 or 351' with sufficient leeway to allow the handle 383*b* to turn downward under the force of gravity or otherwise so that the securing arm 383*c* will hold the retaining pin 383 within the slotted aperture 385*a*, 385*a*' and the receiving apertures opening 385*b* and 385*b*'. Once in place, the force of gravity will maintain the handle 383*b* in a downward position so that the retaining pin 383 will be retained within the slotted aperture 385*a*, 385*a*' and the aperture 385*b*, 385*b*' until the handle 383*b* of the retaining pin 383 is turned upward so that the retaining pin 383 can be removed from the aperture 385*b*, 385*b*' and the slotted aperture 385*a*, 385*a*'. Also, as noted elsewhere, the retaining pin 383 will act to limit the upward travel of the retention member 338 along the outer extremity of the mounting upright 320, 320' when the plow blade 330 is forced to travel upward along the mounting upright.

Referring now also to FIGS. 33-37, the optional bell-shaped housing or subframe 311 is interconnected with the mounting frame pins shown in FIG. 24 by a series of threaded bolts secured to reciprocally threaded nuts 326, shown in FIG. 24; and to the front of a vehicle in a manner similar to that shown in FIG. 7 for the first embodiment, where a hitch tongue 24 similar to hitch tongue 324 shown in FIG. 33 can be secured to a hitch tongue receiver 16, similar to hitch tongue receiver 316 shown in FIG. 24. The transition apparatus 323 includes the hitch tongue 324 and a hitch tongue extension 308 with apertures 374, 375, and which is pivotally connected at aperture 374 to the subframe 311 by pivot pin 377. The transition apparatus 323 can pivot if the lock pin 321 is removed from engagement with the apertures 372*a* and 372*b* of subframe 311 and aperture 375 of the hitch tongue extension 308. As shown in FIG. 34, the subframe 311 has an upper plate 312*a* and a lower plate 312*b*. Each of the respective upper and lower plates have a pair of openings or apertures, that are vertically aligned so that, for instance, an opening 372*a* for receiving the lock pin 321 in the upper plate 312*a* is directly above and aligned with a similar opening 372*b* in the lower plate 312*b* so that the lock pin 321 can be inserted into both openings without difficulty. Furthermore, the remaining openings 370*a*, 370*b* in respective upper and lower plates 312*a*, 312*b* are also vertically aligned so that they can receive a pivot pin 377 which is preferably a threaded bolt, and which is secured below the lower plate 312*b* by a threaded nut 378. It will be appreciated that the subframe 312 has open sides between the upper plate 312*a* and the lower plate 312*b*. This design is especially helpful to permit snow, ice, water, sand and the like to escape from the area between the respective plates so that it won't interfere with the movement of the hitch tongue extension 308, through which the pivot pin 377 extends.

The structure of the subframe 311 may include a drain opening 313 in the lower plate 312*b* so that, if the subframe 311 is turned upside down 180° from the orientation shown in FIG. 33, water, snow, ice, sand and the like which could otherwise accumulate between side walls or gussets 317*a*, 317*b* and the bottom plate 312*b* will be able to fall through the drain opening 313 to limit collection of such materials above the lower plate 312*b* that will be, in effect, the upper plate when the subframe 311 is turned upside down. It will be appreciated that the subframe can be used in either of these two orientations and that the plurality of both apertures in the flat plate 328 of the mounting apparatus 314 will facilitate placement of the subframe at various heights with respect to the mounting frame 320 so as to accommodate vehicles having hitch tongue receivers that will connect at various heights above the ground given the varying characteristics of the wide variety of vehicles to which such a hitch receiver may be attached. In this way, the plurality apertures in the flat plate 328 allow the subframe 311 to have significant versatility for attachment of the mounting apparatus at various heights were attached in anticipation of attachment to a number of vehicles to which a hitch tongue receiver is secured.

It is generally believed that it is desireable to position the mounting frame 309 from about 8 to about 10 inches above the ground in order to have suitable clearance for the plow blade 330 when the plow blade 330 is engaged with the mounting uprights 320 in a working orientation. If the separation between the mounting frame 309 and the ground 56 is greater than about 10 inches the plate 328 can be disconnected from the interconnecting member 322 and rotated 180 degrees about its length, before reconnecting the plate 328 to the interconnecting member 322 to decrease separation between the mounting frame 309 and the ground 56. If the separation needs to be increased, the bolts 325 can be disconnected from the nuts 326 and the plate 328 can be separated from the interconnecting member 322, adjusted for height by realigning the plate 328 with the interconnecting member 322 so that the bolts 326 can secure the mounting frame 309 to the subframe 311 in a manner that allows the mounting frame to be repositioned with respect to the ground 56.

Figure 36:
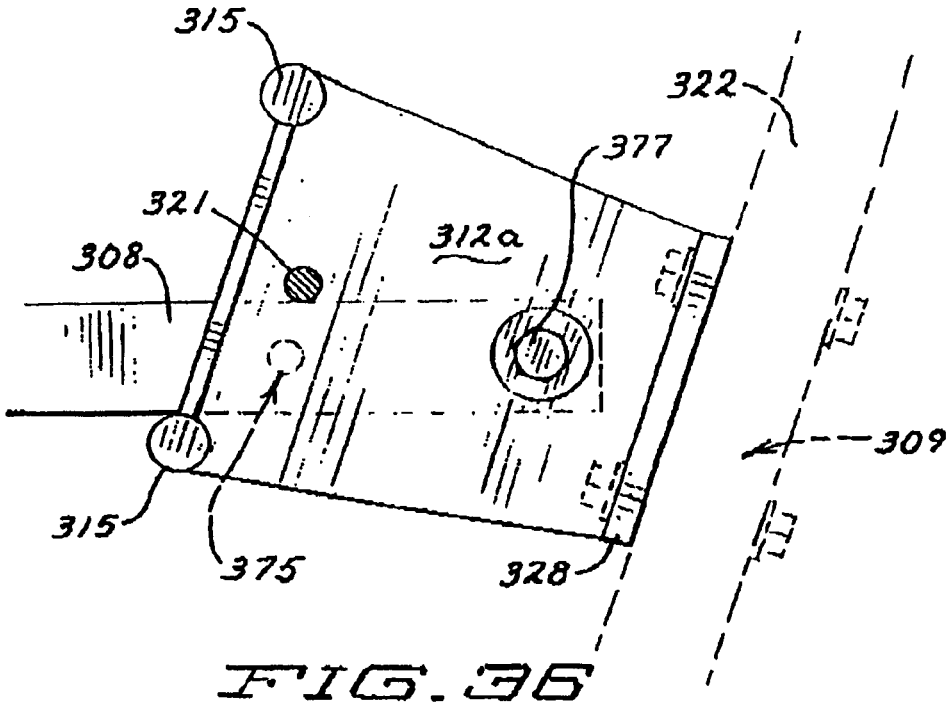
FIG. 36 is a top plan view similar to that shown in FIG. 35, but showing the mounting frame 309 (shown in phantom) turned to the right from the perpendicular orientation shown in FIG. 35.
Figure 37:
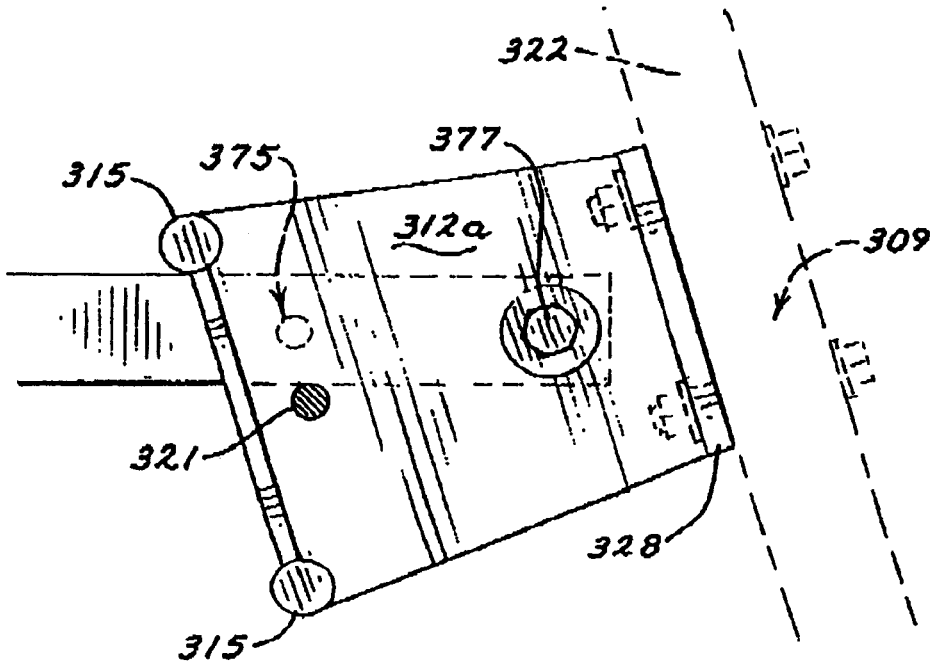
FIG. 37 is a top plan view similar to that shown in FIG. 35, but showing the mounting frame 309 (shown in phantom) turned to the left with respect to the perpendicular orientation shown in FIG. 35.
Figure 98:
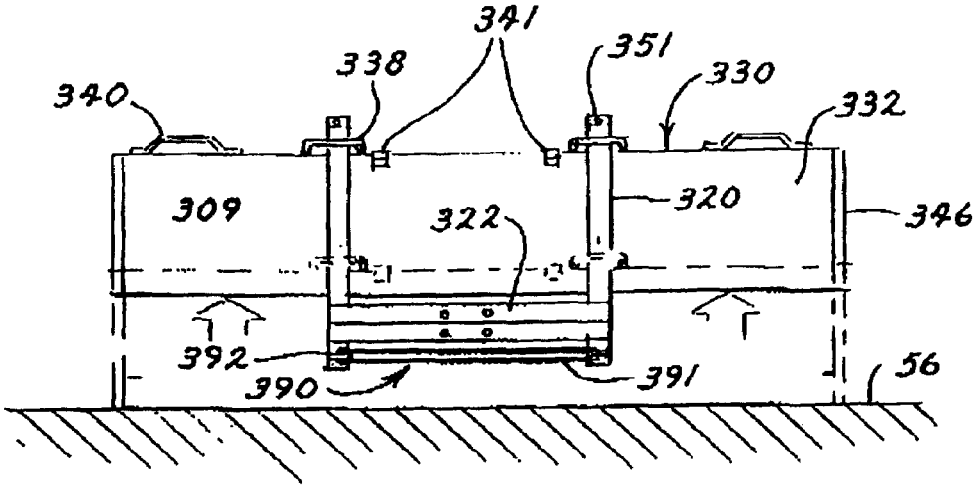
Figure 99:
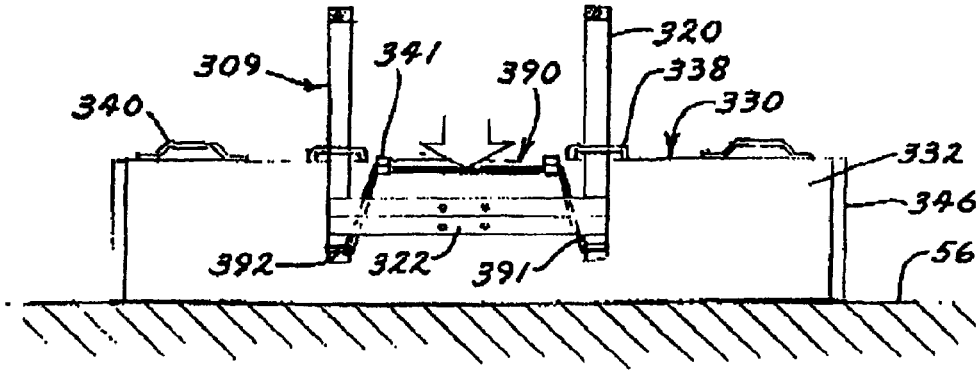

It will be appreciated that the mounting frame 309 will stand generally perpendicular to the direction of movement of a vehicle when the hitch tongue extension 308 is locked in the position shown in FIG. 35 by the lock pin 321. Referring now especially to FIGS. 36 and 37, if the lock pin 321 is removed from the lock pin receiving openings in the upper plate 312*a* the hitch tongue extension 308 and the lower plate 312*b*, the hitch tongue extension 308 can pivot with respect to the frame 311 through a generally horizontal plane until the hitch tongue extension 308 comes into contact with a limiter column, post or frame element 315 on either side of the aligned pin receiving openings 372*a*, 372*b* in the upper and lower plates 312*a*, 312*b*. It will be appreciated from a review of FIGS. 35-37 that the limiter columns or posts 315 allow the hitch tongue extension 308 to pivot just far enough to permit the lock pin 321 to hold the hitch tongue extension 308 in a position either to the left or the right of the aligned lock pin receiving openings 372*a*, 372*b* in the upper and lower plates 312*a*, 312*b* so that the lock pin 321 can hold the hitch tongue extension 308 in position with respect to the upper and lower plates 312*a*, 312*b* so that the mounting frame 309 can be held at an angle to the left or to the right of a position perpendicular to the forward movement of a vehicle pushing the adjustable snow plow apparatus of the present invention, so that the plow blade 320 can be held at an angle to the forward motion of the self-adjusting snow plow that is greater or less than 90° and allows snow gathered in front of the plow blade 320 to be pushed off to one side or the other of the path of a vehicle pushing the plow blade.

Referring now also to FIGS. 38-39, the present invention includes a mounting apparatus 314 (see FIG. 24) having a mounting frame 309, the mounting frame 309 including two interconnected mounting uprights 320; the snow plow retention apparatus 338, preferably including at least one retention member 338, preferably two retention members 338, constructed and arranged to disengageably secure the plow blade 30, 330 to the mounting uprights 20, 320 for constrained motion during use; and an elongated member 390, preferably a resilient elongated member 391 constructed and arranged to exert downward force upon the plow blade 30, 330 when the plow blade 30, 330 is disengageably secured to the mounting uprights 20, 320 during use and the elongated member 391 is interconnected between the plow blade 30, 330 and the mounting apparatus 14, 314. In an alternate embodiment of the elongated member shown in FIGS. 38 and 39, the elongated member is a resilient shock cord 391 or bungee cord that is preferably stretched or pre-loaded to extend between two eyebolts 392 each of which is preferably secured to a bottom portion of the mounting frame 309 in the manner shown in FIG. 38 (see also, FIG. 24). The pre-loaded shock cord is capable of placing a downward force upon the plow blade 330 when the shock cord 391 is further stretched to engage retention hooks 341 secured to the mold board 332 as previously described. By stretching the shock cord 391, which is secured to the bottom of the mounting uprights 320 in the embodiment shown in FIG. 38, a significant amount of downward force can be exerted upon the plow blade when it is in a working orientation as shown in FIG. 39.

Figure 41B:
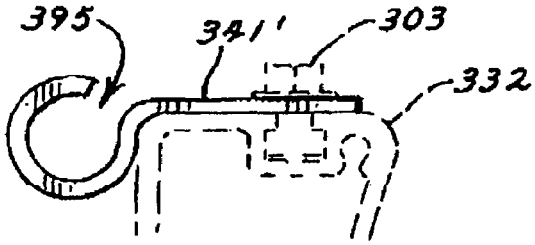
FIG. 41B is a view similar to that shown in FIG. 41A, except that a further alternate attachment hook 341' is shown.
Figure 41A:
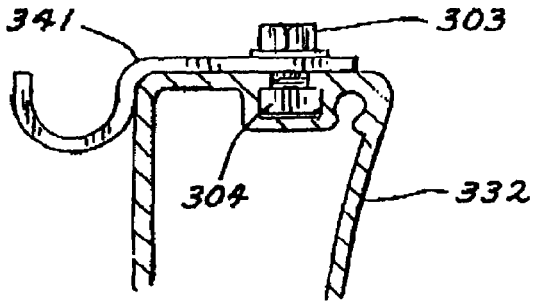
FIG. 41A is a cross sectional view of an upper portion of the plow blade 330 shown in FIG. 24 as seen from the line 41-41, but showing an alternate attachment hook 341 secured in the upper attachment channel 301 of the alternate plow blade 320 shown in FIG. 24.
Figure 42:
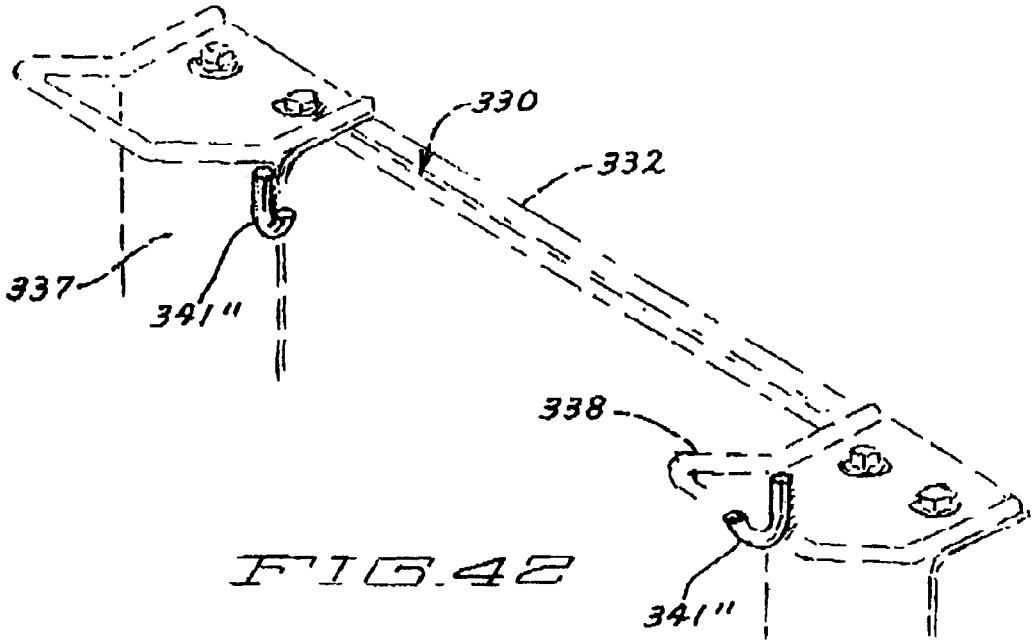
FIG. 42 is a perspective view of an alternate hook apparatus 341" secured to a mold board 332 similar to that shown in FIG. 24.
Figure 43:
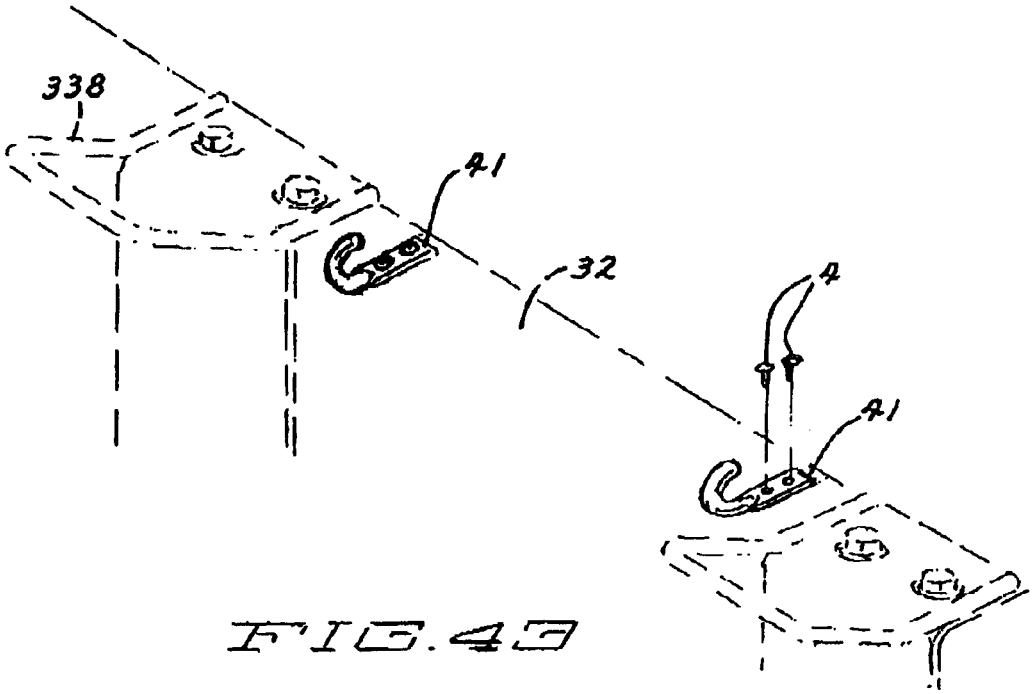
FIG. 43 is a perspective view similar to FIG. 42, but showing a further alternate hook apparatus 41 fastened to a mold board 32 similar to that shown in FIG. 7 and showing the screws 4 used to secure one of the two alternate attachment hooks 41 exploded away from the mold board 32 on one side.

Referring now also to FIG. 41A, the retention hooks 341, shown also in FIGS. 24, 38 and 39, are preferably made of a sheet of material (preferably steel) having a thickness of about one eighth of an inch, a length of about six to eighteen inches, and a width of from about a half an inch to about an inch and a quarter, preferably about three quarters of an inch to about an inch, most preferably about an inch wide. Referring now also to FIGS. 41B, 42 and 43, further embodiments of the retention hooks 341', 341" and 41 are shown. The retention hook 341' shown in FIG. 41B turns to more than 270° and leaves a relatively small opening 395 through which to pass the elongated member 391 within the retention hook 341'. The retention hooks 341" shown in FIG. 42 are made of one-quarter inch wire stock (preferably steel) that have been formed into a U-shape or J-shape and which have been welded to the retention apparatus assembly 337 that is secured to the mold board 332 as previously described. Referring now also to FIG. 43, a pair of standard hooks 41 may also be used when secured to a mold board 32 such as that shown in FIG. 43 which is similar to that shown in FIGS. 7 and 8. The retention hooks 41 are secured to the mold board 32 with a pair of fastening elements such as screws 4.

Figure 40:
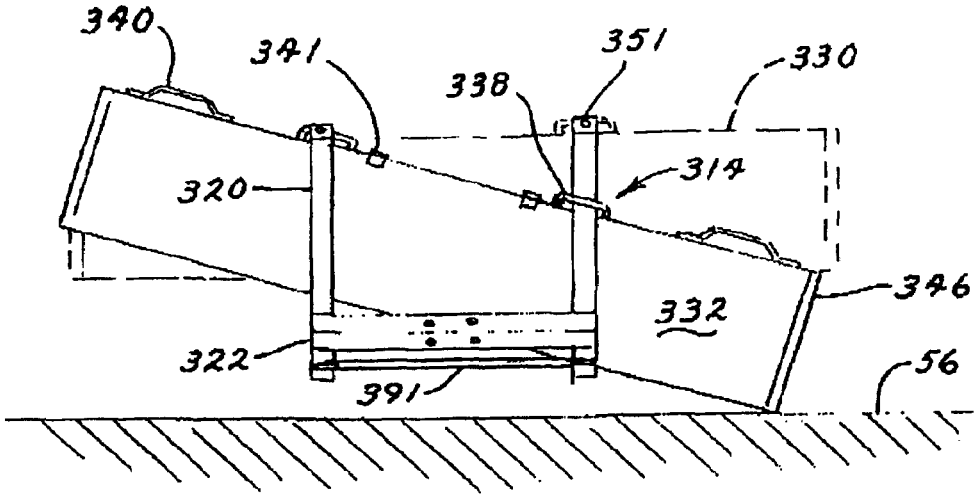
FIG. 40 is a diagrammatic view similar to that shown in FIG. 38, except that one end of the plow blade 330 is disengaged from the attachment member 351 and is disengageably secured to the mounting upright 320 and resting on the ground 56, and the plow blade 330 is shown in phantom in the non-working or transit orientation.
Figure 44:
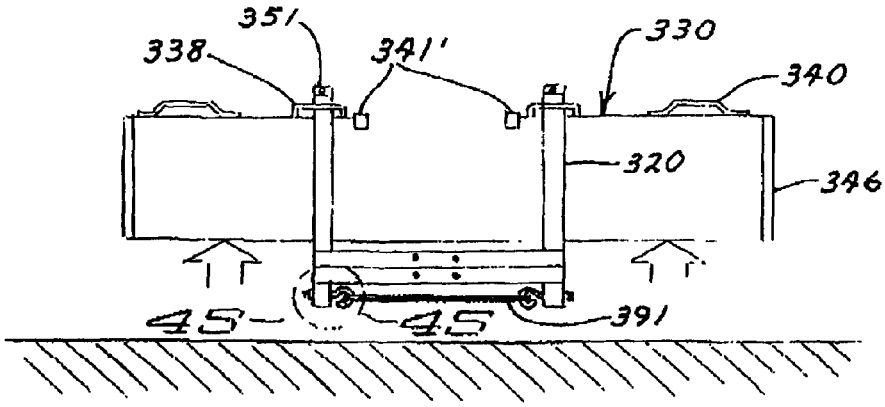
FIG. 44 is a diagrammatic view of the alternate mounting frame shown in FIG. 4, similar to that shown in FIG. 38, except that alternate attachment hooks 341, like that shown in FIG. 41B, are secured in the upper attachment channel 301 of the alternate plow blade 330 and the resilient elongated member 391 is attached to three-quarter turn eyebolts 396 secured to the inside of a bottom portion of the respective mounting uprights 320.
Figure 45:
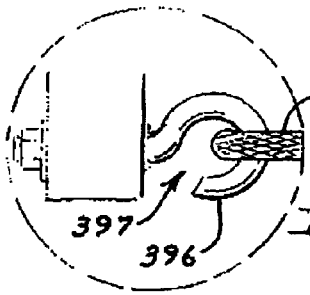
FIG. 45 is an enlargement 45-45 of the respective three-quarter turn eyebolts 396 secured to the respective mounting uprights 320, to which the resilient elongated member 391 is attached.
Figure 46:
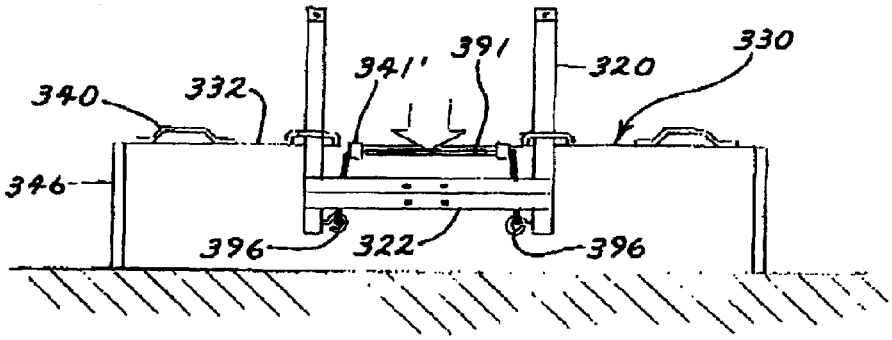
FIG. 46 is a diagrammatic view similar to that shown in FIG. 39, except that the three-quarter turn eyebolts 396 shown in FIGS. 44 and 45 are used to engage the resilient elongated member 391 to the mounting frame 320 and the resilient elongated member 391 is engaged to the alternate attachment hooks 341' shown in FIGS. 41B and 44.

Referring now also to FIGS. 44-46, a preferred downward force generating system is disclosed in which a resilient elongated member 391 is disengageably engaged with a pair of three-quarter turn eyebolts 396 secured to a lower portion of the mounting uprights 320 and retention hooks 341' such as those shown in FIG. 40 which are attached to the plow blade 330. In this preferred embodiment, the resilient elongated member 391 may be engaged and disengaged from the mounting uprights and the mold board through the gaps 397 and 395 the three-quarter turn eyebolts 396 and each of the three-quarter turn retention hooks 341' (see FIG. 41*b*). In this way, the elongated retention member 391 can be easily replaced and may be removed for storage when not in use. Because the climates in which snow plows are used experience significant fluctuations in temperature, having a disengageable resilient elongated member 391 is likely to increase the ability of the owner to store the elongated member 391 at moderate temperatures that are less likely to advance deterioration and increase its working life as opposed to being exposed to either high or low temperatures, which would tend to shorten its working life. As shown in FIGS. 44-46, the three-quarter turn eyebolts which include openings 397 similar to the openings 395 of retention hooks 341' are oriented downward so that the openings 397 face away from the openings 395 of retention hooks 341' when the plow blade 330 is in the working orientation shown in FIG. 46. This permits the rapid attachment and removal of the resilient elongated member 391 in a manner that is not disruptive of normal use of the snow plow 310.

It will be appreciated that the elongated member 391 can be any resilient member that can be stretched in order to preload the elongated member so that the elongated member can exert a downward force on the plow blade 330 when the elongated member 391 is engaged with elements of the mounting apparatus 314 and elements of the plow blade 330 that are positioned with respect to each other in a manner placing the engagement elements of the mounting apparatus below the engagement elements of the plow blade when the plow blade is in a working orientation as shown in FIG. 46. Because the plow blade is necessarily a relatively light piece of equipment, which can be easily handled by consumers, it can ride up on the mounting uprights 320 in a manner that makes it difficult to move large amounts of snow under certain circumstances. Rather than increase the weight of the plow blade 330 to a point where it would make the plow blade more difficult for an individual to manipulate, it is believed that it is advantageous to provide a resilient elongated member 391, such as those disclosed, that can be engaged between the mounting apparatus and the plow blade to create a downwardly biasing force on the plow blade 330 during snow plowing operations when the plow blade 330 is in a working or operational orientation.

It will be appreciated that any elongated member that has some elasticity and can stretch and has the ability to exert a force upon an object to which it is connected, or more particularly between two objects between which it is connected, can be used, notably materials that are used to make shock cords, bungee cords and the like. In addition, elongated members that have only a partial length or perhaps a plurality of partial lengths that are resilient may certainly be used in the place of a single long elongated member that is resilient and therefore stretchable throughout its entire length. In addition, using a plurality of elongated members, interconnected with only a single engaging element on each of the structures to be interconnected, e.g., the mounting apparatus 314 and the plow blade 330, may also be used. In this regard, it will be appreciated that the only requirement of the engagement of the resilient elongated member or members is that they are interconnected between the mounting apparatus 314 and the plow blade 330, when the plow blade 330 is in the working orientation. It will be appreciated that springs, rubber bands, and other resilient devices may be substituted for the preferred resilient elongated member 391 disclosed in the drawings. The preferred resilient elongated member 391 will be a shock cord having a diameter of from about an eighth of an inch to about an inch, preferably from about three eighths of an inch to about a half an inch, more preferably about a quarter of an inch in diameter. Extensible or resilient cord material or straps of any kind, springs and other elongated materials that can be stretched or preloaded to create a force that can be arranged to exert a downwardly biasing force on the plow blade 330 when the elongated material is interconnected between the mounting apparatus 314 and the plow blade 330 may be used as a resilient elongated member 391 of the present invention. It will be appreciated that multiple resilient elongated members may also be used and the arrangement for interconnecting the plow blade 330 and the mounting apparatus 314 may take any conceivable configuration.

Figure 47:
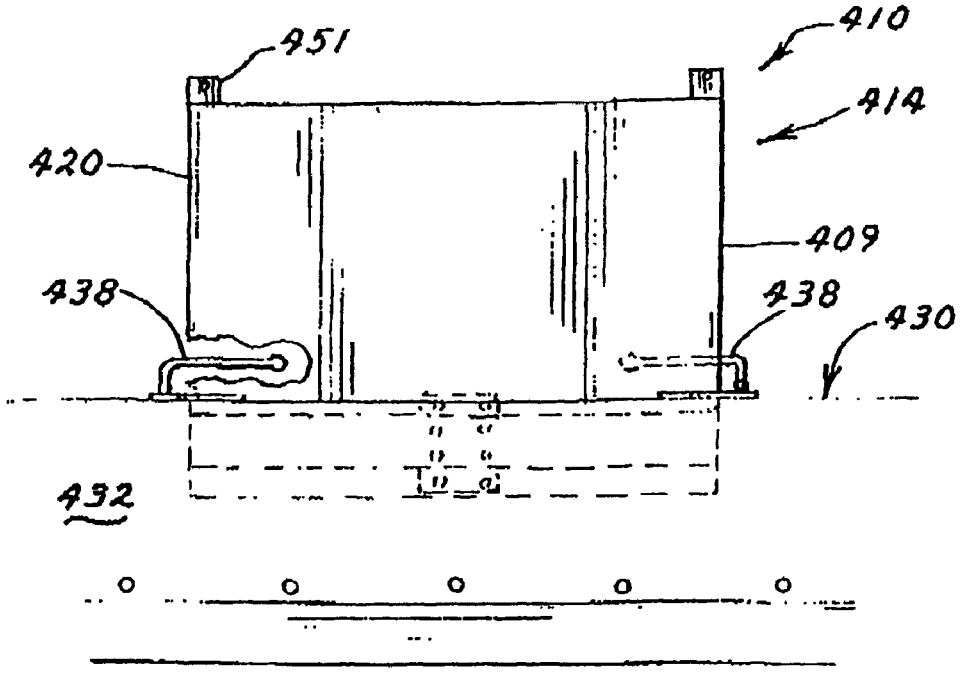
FIGS. 47 and 48 are front elevations of an alternate mounting apparatus 414 (which is partially broken away in FIG. 47) of the present invention shown with alternate plow blades 430, 430' that are partially shown, except that alternate retention members 438 and 438' that are shown partially in phantom, as are parts of the mounting apparatus 414.
Figure 48:
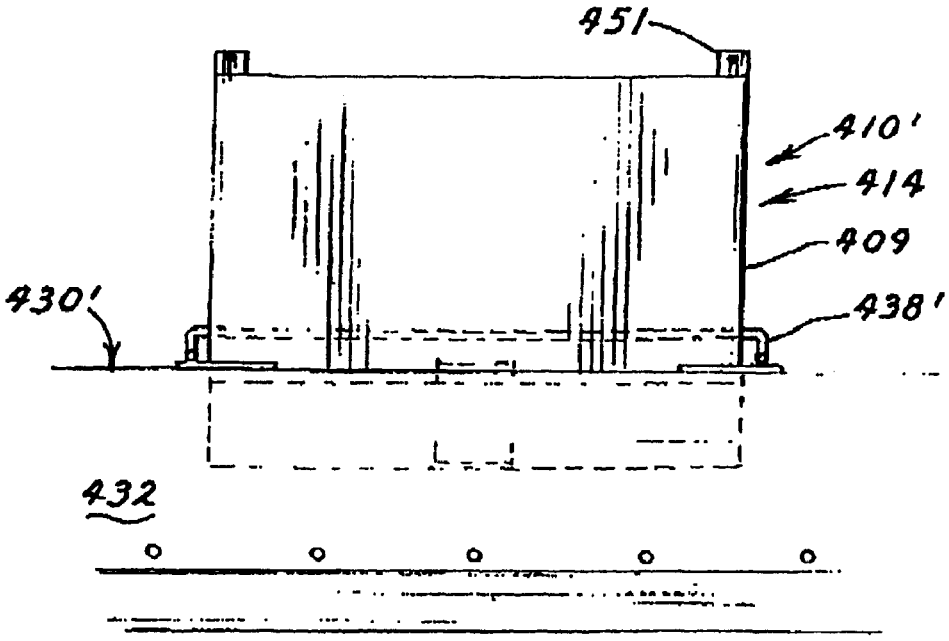

Referring now also to FIGS. 47 and 48, in certain alternate embodiments, the mounting apparatus 414 of the self-adjusting snow plow 410 will include a mounting frame 409 having a single mounting upright 420, as shown in these Figures. In FIG. 47, the plow blade 430 includes a pair of retention members 438, similar to those shown in FIG. 20, that slideably constrain and/or disengageably secure the plow blade 430 to the single mounting upright 420. In FIG. 48, the plow blade 430' includes a single retention member 438', similar to that shown in FIG. 22, that slideably constrains and/or disengageably secures the plow blade 430' to the single mounting upright 420.

Referring now also to FIG. 40, because of the light weight of the preferred plow blade, it is relatively easy for an individual to either lift the plow blade 330 from the working orientation, when the plow blade 330 is resting on the ground 56, or to lower the plow blade 330 to a working position from a non-working orientation similar to that shown in phantom in this Figure. To move the plow blade 330 from the working orientation when the plow blade 330 is engaged with the mounting frame 309 (see, for example, FIG. 24), an individual can start from a position similar to that shown in FIG. 46 and lift one end of the plow blade using a lifting handle 340, after disengageably the elongated member 391 from the plow blade 330, to raise the plow blade 320 high enough to disengage the retention member 338 from the mounting upright 320 on one side of the mounting apparatus 314 and then place the retention member 338 in the attachment member atop the mounting upright 320 on that side of the mounting apparatus 314 so that the plow blade is in a position, similar to that shown in solid line in FIG. 40, in between a non-working, transit orientation and a working orientation. To place the plow blade 330 in the non-working, transit orientation, the individual can then go to the other end of the plow blade 330 and lift that end, disengaging the second retention member 338 from the mounting upright 320 on that side of the mounting apparatus 314 and placing the second retention member 338 in the attachment member 351, so that the plow blade 330 is in the non-working orientation shown in phantom in FIG. 40. In preferred embodiments, the steps to lower the plow blade 330 from the non-working, transit orientation to the working orientation are just the reverse. First, the retention member 338 engaged with the attachment member 351 on one side of the mounting apparatus is disengage and the retention member is engaged for constrained motion along the mounting upright 320 on that side of the mounting apparatus 314 and the end of the plow blade 330 approximate that side of the mounting apparatus 314 is allowed to rest on the ground, so that the plow blade 330 is oriented in the manner shown in solid line in FIG. 40. Then the individual can go to the other end of the plow blade and lift it to disengage the second retention member 338 from the attachment member 351 approximate that side of the mounting apparatus 314 and then engage the retention member 338 for constrained motion along the mounting apparatus 320 and lower the second end of the plow blade 330 to the ground.

Referring now again to FIG. 24, the guide shafts 387 on each side of the plow blade are constructed and arranged to provide the operator of a vehicle pushing the plow blade 330 with markers with which to create a sight line to assist in snow plowing operations.

It will be appreciated that the plow blades of the present invention will have many lengths for different purposes. For instance, snow plows for small four wheeled vehicles such as ATV's and the like may be anywhere from three and a half to six and a half feet, preferably four feet, five feet, or six feet in length. Similarly, the length of the snow plows made for larger vehicle such as trucks, SUV's and the like may be from six and a half to ten and a half feet, preferably seven feet, eighth feet, eight and a half feet, nine feet or even ten feet long. In preferred embodiments, the retention member 38, 338, or slide hinge as it is sometimes called, is preferably made from wire stock (preferably steel) that is from about three eighths to about five eighths inches in diameter, preferably about one half inch in diameter. The retention members 38, 338 are attached to respective retention plates that are formed from sheet stock. Preferably, the sheet stock is steel having a thickness of about an eighth of an inch, to which a retention member may be welded.

Referring now to FIG. 24 and FIG. 25A, the nuts 304, placed in the attachment channels 301 and 302 are preferably square (having four external flat surfaces), although hex-headed nuts can also be used. In preferred embodiments, the plow blade of the present invention may be easily assembled by factory workers or even consumers who purchase the snow plow in kit form for assembly at home or at the consumer's workshop. It will be appreciated that the preferred aluminum extrusion shown in FIG. 24, does not require any drilling or placement of openings for fasteners. Although not shown, the end caps 346 as well as the cap plates 348 can be predrilled, as well as the cap plates 348. The guide shafts 387 or sight guides can also come with predrilled holes so that fasteners can be used to secure the guide shafts 387 to the sides of the plow blade proximate the end caps 346 and the end plates 348.

Figure 49:
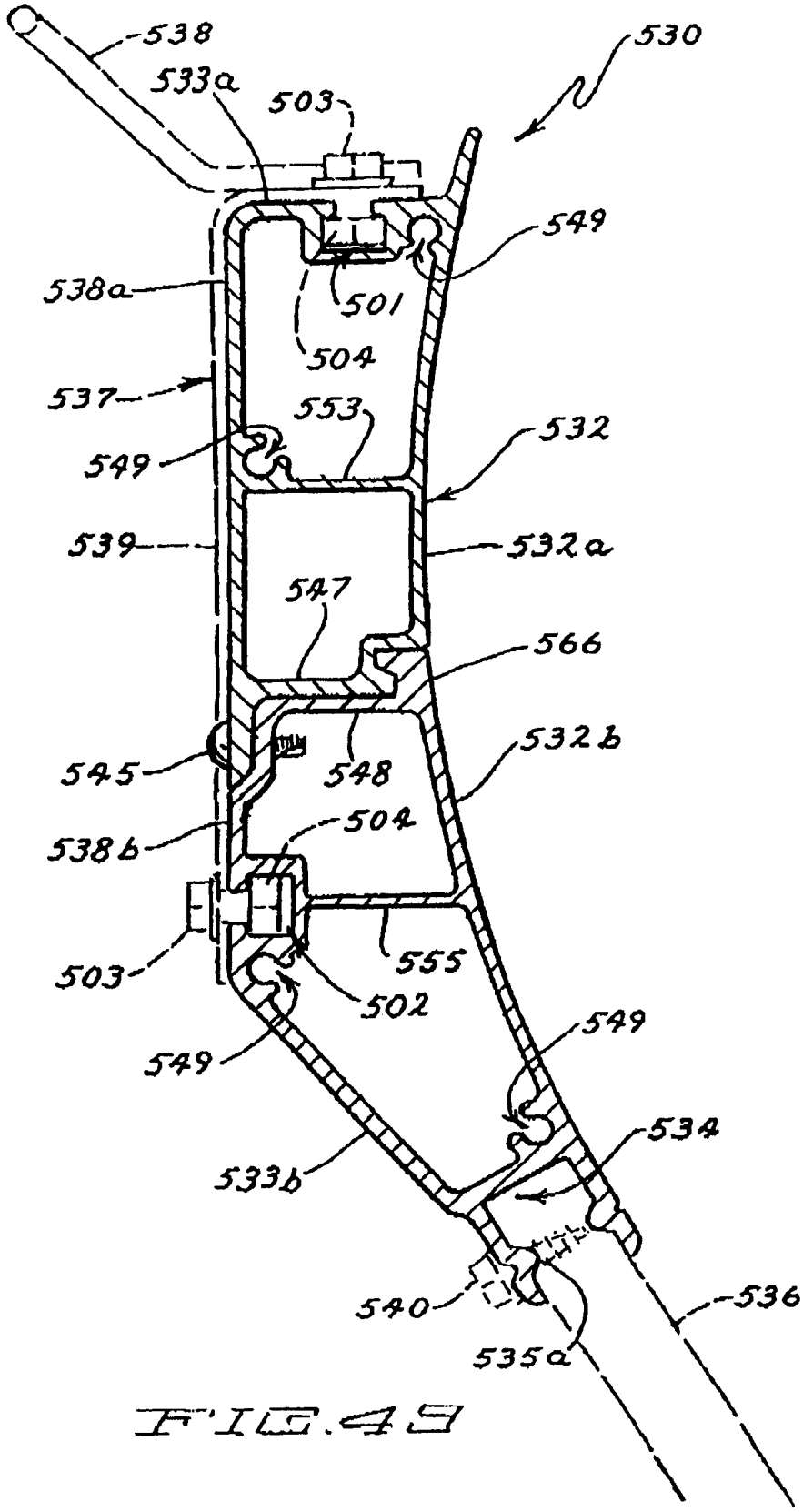
FIG. 49 is a cross-sectional view of the plow blade 530 similar to that of FIG. 8 except that in this embodiment, the mold board 532 includes first and second pieces 532*a*, 532*b;*
Figure 50:
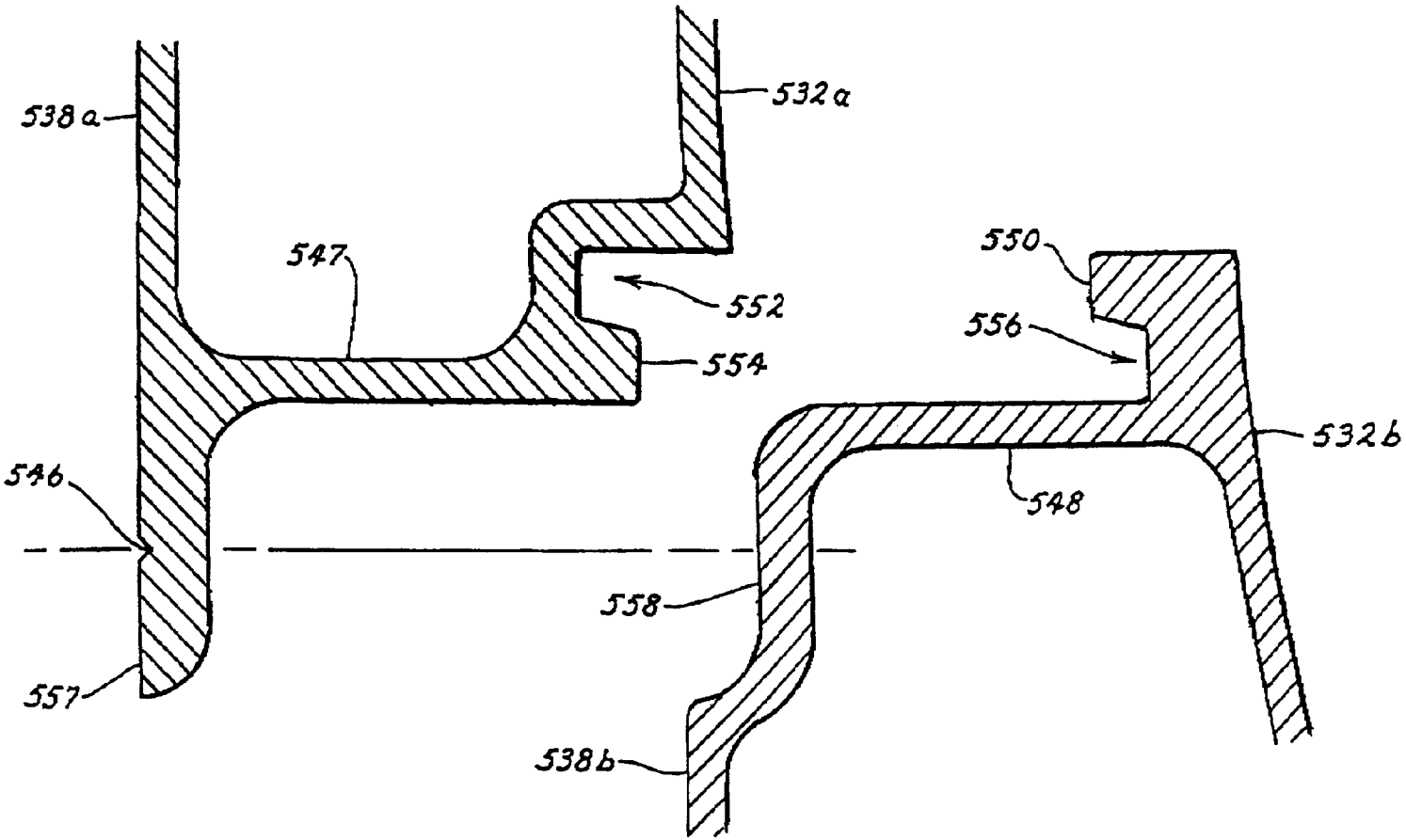
FIG. 50 is a partial, cross-sectional, exploded side elevational view of first and second pieces 532*a* and 532*b* of the mold board 532 shown in FIG. 49.

Referring also now to FIG. 49, depicting an alternate embodiment of a snow plow blade 530 similar to the hollow core plow blade shown in FIG. 8. In this embodiment, the mold board 532 has a first piece 532*a* and a second piece 532*b*. As with the previously discussed mold boards, the first or upper mold board piece includes a main or front surface 532*a*, a top surface 533*a*, a rear surface 538*a* and a bottom surface 547, which form a hollow or space that can be compartmentalized by a support structure 553. In addition, the lower or second mold board piece includes constricted channels 549 that are configured to receive fastening elements such as screws. Similarly, the second or lower mold board piece 532*b* includes a main or front surface 532*b*, a top surface 548, a rear surface 538*b* and a bottom surface 533*b*, which form a hollow or space that can be compartmentalized by a support structure 555. In addition, the upper or first mold board piece includes constricted channels 549 that are configured to receive fastening elements such as screws. The two pieces 532*a*, 532*b* include edges that are complimentary shaped to one another to form a tight, interlocking joint and which are further secured together with one or more fasteners 545, such as a screw or the like that is received in screw hole (not shown) in a groove 546, shown in FIG. 50, in the first mold board piece 532*a*. It will be appreciated that the screw can be replaced by other types of fasteners and other kinds of screws, as well, most noticeably, a self-tapping screw that can be screwed directly into the groove 546, without first creating a pilot hole to accept the screw. FIG. 50 is a partial, exploded view of the preferred joint configuration created by the edges of the two mold board two pieces 532*a*, 532*b*, as also shown in FIG. 49. The second piece of 532*b* is preferably secured to the first piece 532*a* by engaging an engaging lip 550 on an upper portion of the second piece 532*b* with a lip-receiving slot 552 on a lower portion of the first piece 532*a*. The lip and the slot are provided with angled engagement surfaces, which facilitate alignment and initial engagement of the pieces 532*a*, 532*b*. The angled surfaces of the lip and slot also serve to form the tight, interlocking joint by drawing the pieces 532*a*, 532*b* together in a camming action as the plow blade is assembled. As the engaging lip 550 engages the lip-receiving slot 552, a slot-defining lip 554, located immediately below and partially defining the slot 552, engages a second slot 556 located below the engaging lip 550 on the second piece 532*b*. At the same time a flange 557 that extends from the rear surface 538*a* to a point below the bottom 547 of the first or upper piece 532*a* engages a recess 558 in rear surface 538*b* adjacent the top 548 of the second or lower piece 532*b*. In preferred embodiments, more than one screw, similar to the screw 545 shown in FIG. 49, can be used to secure the first piece 532*a* to the second piece 532*b*, although these screws are not required because the mold board pieces 532*a*, 532*b* can be held together by retention apparatus assemblies 537, one of which is shown in phantom in FIG. 49. The retention apparatus assemblies 337 are secured side-by-side, in a manner similar to that shown in FIGS. 8 and 24, in respective attachment channels 501, 502 similar to those shown in FIG. 25A, but in the first and second pieces 532*a*, 532*b*, by threaded bolts 503 (shown in phantom) secured to reciprocally threaded nuts 504 (shown in phantom) in the respective attachment channels 501, 502.

Figure 51:
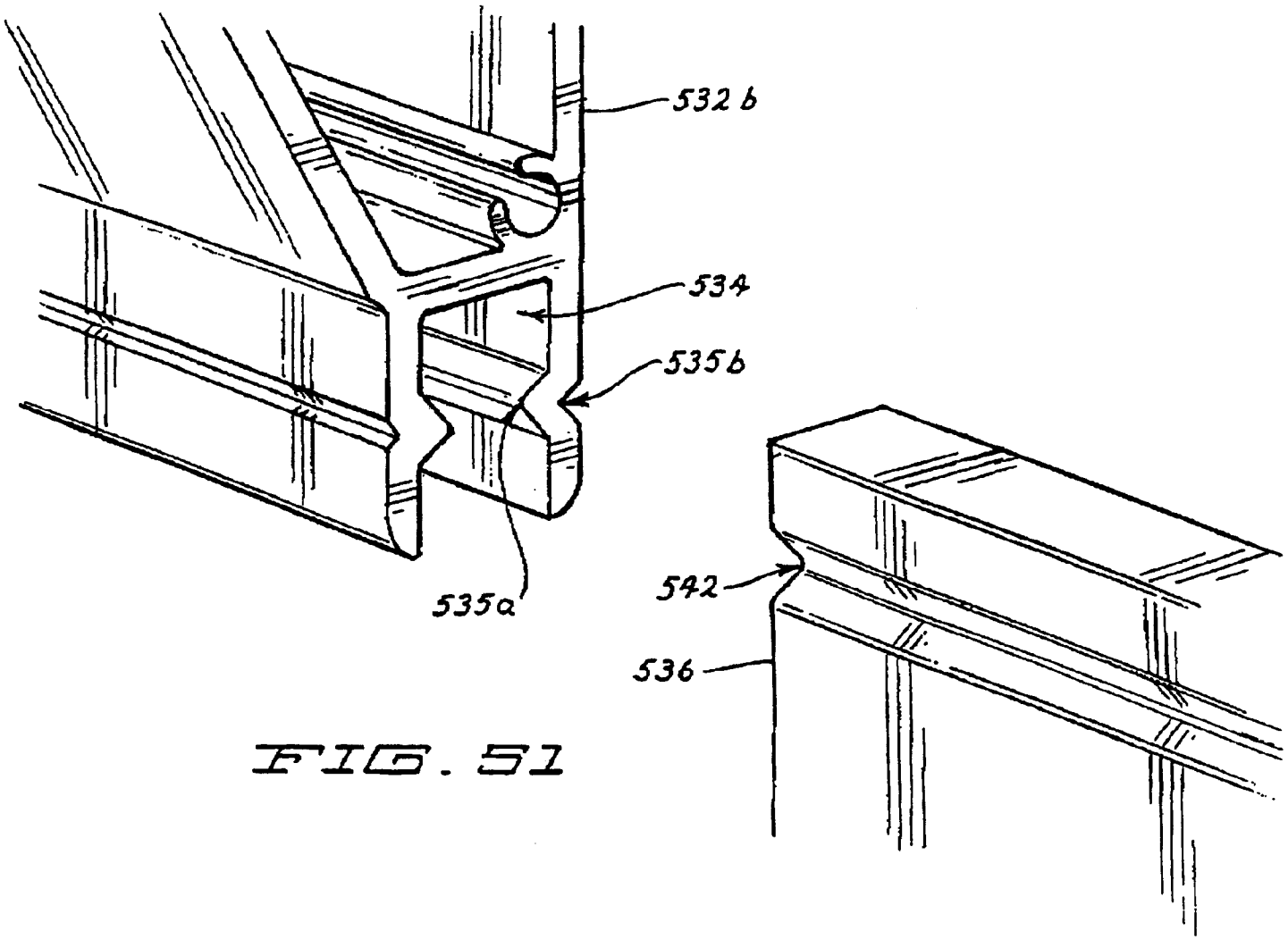
FIG. 51 is a partial, exploded view of the scraper holding channel 534 and rubber scraper 536 of FIG. 49 depicting a possible configuration wherein the scraper mates with the scraper holding channel.

Referring now also to FIG. 51, a partial, exploded view is shown of a preferred configuration of a rubber scraper 536 and a scraper holding channel 534 further illustrating their complementary shapes and how they are interconnected to better secure the scraper 536 within the channel 534. There are many other complimentary shapes that are possible, such as the configuration shown in FIG. 8, where there are no ridges, or ones where there are a series of ridges on each side. Offset ridges are also possible, but these will require the rubber scraper to be "sided", or to have "sidedness", which is less desirable from a point of view of ease of assembly. Other shapes may also be employed, so long the channel provides some point of restriction that restrains the rubber scraper from downward movement out of the channel. Preferably, the scraper holding channel and rubber scraper will be shaped such that the rubber scraper 536 is sufficiently gripped within the scraper holding channel 534, even if a fastener is not used. One end of the rubber scraper 536 is positioned within the channel 534 by sliding it into channel 534, from the side position shown in FIG. 51, so that the two ridges 535*a* on either side of the channel 534, which partially define the channel 534, accept the rubber scraper 536. As the channel 534 accepts the rubber scraper 536, grooves 542 on either side of the preferred rubber scraper 536 slide over respective ridges 535*a*. While the rubber scraper 536 can be, and preferably will be, sized to require a friction fit within the channel 534, it is preferred that the force required to position the scraper 536 within the channel 534 will be that which can be provided with a somewhat forceful push or a series of pushes or shoves given by an assembly worker, or a light tapping with a hard rubber mallet (not shown). Once the preferred rubber scraper 536 is in place within the channel 534, as shown in phantom in FIG. 49, the complimentary grooves 542 and ridges 535*a* act to secure the rubber scraper 536 in place against downward movement. As the rubber scraper either shrinks over time due to aging of the rubber material or shrinks due to cold temperatures, the ridges 535*a* aid in preventing the rubber scraper 536 from being dislodged out of the scraper holding channel 534 in a downward direction. To further secure the rubber scraper 536 within the scraper holding channel 534, a fastener or a plurality of fasteners of known types and technologies, may be used. In the embodiment shown in FIG. 49, the rubber scraper 536 is further secured with a self-tapping screw 540 (shown in phantom) that is inserted through an inflection point 535*b* that runs horizontally across the outside of the mold board 532 on each side, opposite each of the respective ridges 535*a*. The self-tapping screw 540 is screwed into and through the mold board 532 and through the scraper holding channel 534 at the grooves 542. In other embodiments (not shown), the screw can extend through the other side of the mold board 532 at the opposing ridge 535*b*, and secured with a nut (not shown).

Figure 52:
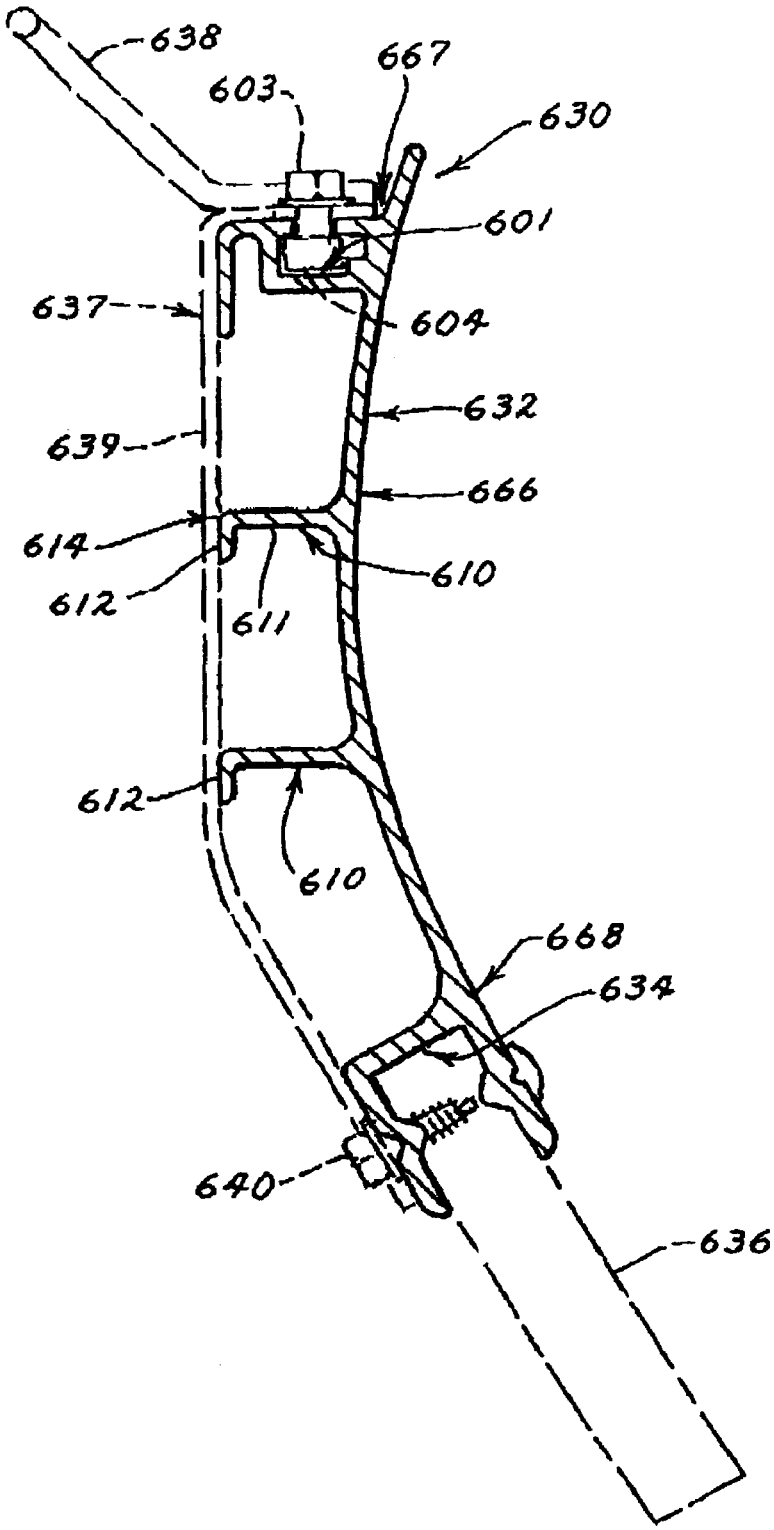
FIG. 52 is a cross-sectional side elevational view of a further preferred embodiment of the plow blade 630, having similarities to the plow blade shown in FIG. 8, but having only support members 610, 611 having surfaces that engage the front 666 of the mold board 632 from the back when pushing against metal plates 639 (one of which is shown in phantom)

Referring also to FIG. 52, this figure illustrates a further preferred embodiment of a plow blade 630 for a further ATV snow plow apparatus (not shown), the plow blade (630) having one piece mold board 632 having only a main surface 666 and no rear support surface other than a modified retention apparatus 637 (shown in phantom), which includes two metal plates 639 or straps (one of which is shown in phantom), one on each side of the mold board 632, to which retention members 638 (shown in phantom) are secured, preferably, welded together. The alternate preferred plow blade 630 is intended for use with smaller land vehicles, such as an all terrain vehicle (ATV), a "four-wheeler" or the like. In this embodiment, the single-piece mold board 632 has a main surface 666, a top 667, and a bottom 668. The bottom 668 defines a scraper holding channel 634, similar to that shown in FIG. 49, in which a scraper 636 (shown in phantom) may be inserted and secured in a manner similar to that for the embodiment described above in relation to FIGS. 49-51. It will be appreciated, however, that this type of scraper is not a requirement and that other scrapers described herein may also be used. The modified retention apparatus assembly 637 (shown in phantom) is secured to the top 667 of the mold board 632 by a threaded bolt 603 (shown in phantom) that is secured to a nut 604 (shown in phantom) within an upper attachment channel 601 in the mold board 632 in a manner similar to that described in relation to FIGS. 25A and 49-51, except that there is no lower attachment channel to which to further secure that retention apparatus assembly 637. Instead, the metal plates 639 will be positioned up against support structures 610 and 611 that extend rearwardly from the main surface 666 or the front 666 of the mold board 632 and preferably secured at the bottom of the mold board 632 by a pair of self-tapping screws 540, one of which is shown in phantom. In preferred embodiments, the support structures 610, 611 will have feet 612 that turn generally about 90° from the support structures 610, 611 as shown in FIG. 52, so that a force receiving surface 614 is provided on the distal end of each of the feet 612 of the support structures 610, 611 to receive and distribute force generated against the metal plates 639 when the vehicle (not shown) presses the mounting apparatus (not shown) against the plow blade 630 to clear snow (not shown) in essentially the same manner as described above in relation to other embodiments of the snow plow apparatus. The force receiving surface 614 of each support structure 610, 611 will extend in a generally perpendicular orientation thereto and the support structures 610, 611 will extend to the main surface or front 666 of the mold board 632. In the preferred embodiment illustrated in FIG. 52, the mold board 632 includes a plurality support structures 610, 611 each including a foot 612 that provides a force receiving surface 614. In preferred embodiments, each support structure 610, 611 will be generally parallel to one another extending away from the front 666 and at least one of the support structures 610, 611 is preferably generally perpendicular to the front 666. In the preferred embodiment shown in FIG. 52, the metal plates 639 abut against the force receiving surfaces 614 of the feet 612 of the support structures 610, 611 to provide a generally flat pushing surface for the mounting uprights of the mounting frame. In alternate embodiments for light duty vehicles, it will be appreciated that all or almost all of the metal parts of the preferred embodiments could be made of synthetic or natural polymeric materials or other materials other than aluminum and/or steel. Many of these materials are extrudable as is aluminum and its alloys. A preferred rubber scraper 636 (shown in phantom) is secured in a preferred scraper holder channel 634, similar than shown in FIGS. 49 and 51. The rubber scraper 636 is secured to the mold board 632 with two self-tapping screws 640, one of which is shown in phantom. The screws are spaced apart along an inflection point on the back of the mold board similar to that discussed in relation to FIGS. 49 and 50.

Figure 53:
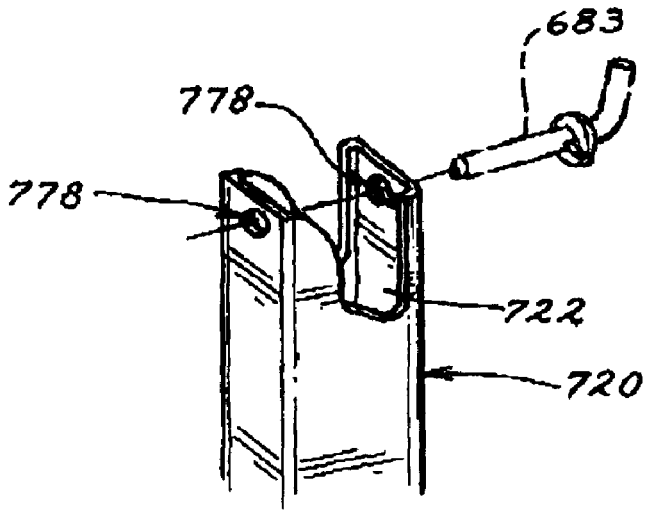
FIG. 53 is a partial, perspective view of an alternate embodiment of the top of a mounting upright 720 and a corresponding pin (shown in phantom)
Figure 54:
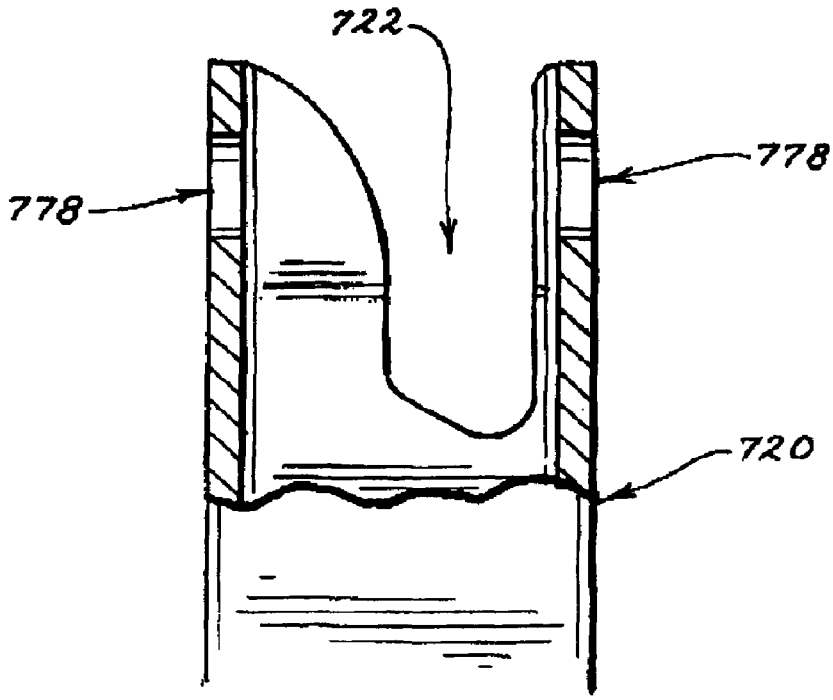
FIG. 54 is a partially broken away, partial side elevated view of the mounting upright 720 of FIG. 53.

Referring now also to FIGS. 53-54, a further embodiment of a mounting upright 720 is illustrated for a further embodiment of a mounting frame (not shown) having two mounting uprights. The mounting upright 720 is one of two uprights of the type shown in FIGS. 7 and 24, but having an integrally formed slot 722 in which a retention member (not shown) may be inserted. The mounting upright 720 further includes two apertures 778 for receiving a pin 683 (shown in phantom in FIG. 53). When inserted, the pin 683 (shown in phantom) can secure one of the retention members (not shown) in the slot 722, in a manner similar to that described in relation to pin 383 shown in FIGS. 26-32, so that the plow blade (not shown) cannot rise above the pin 683 and become disengaged from the mounting upright 720 when secured within the respective slots 722 of two mounting uprights and in a non-working transit orientation similar to that described in relation to FIG. 3.

Figure 55:
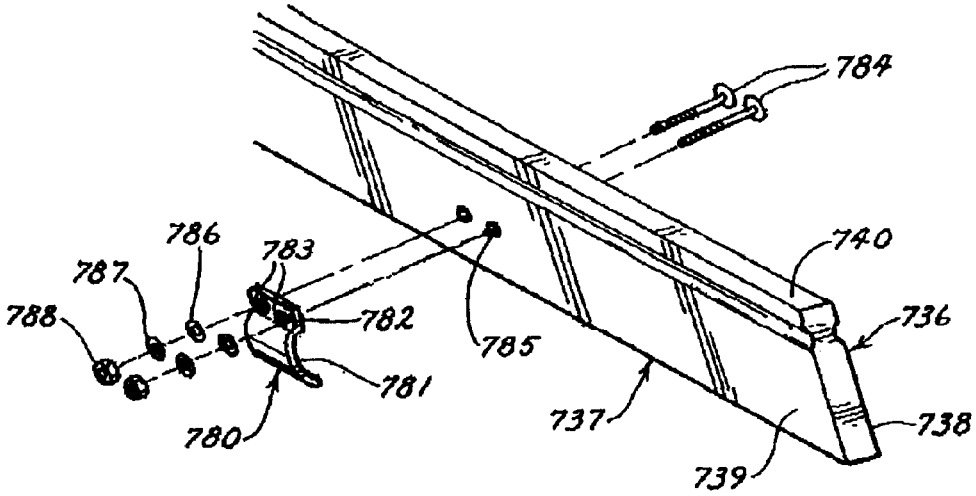
FIG. 55 is a partial perspective view of a preferred rubber scraper 736 having a skid bracket 780 that protects a rear edge 737 of the bottom of the rubber scraper when the rubber scraper is pulled backwards as shown in FIG. 56B.
Figure 56A:
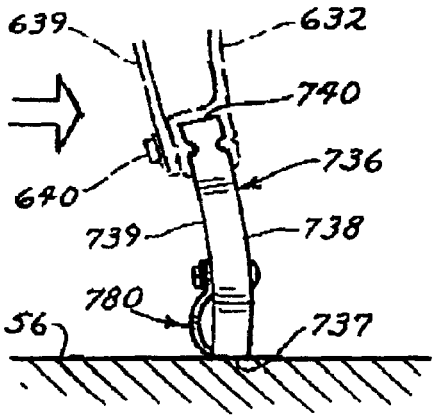
Figure 56B:
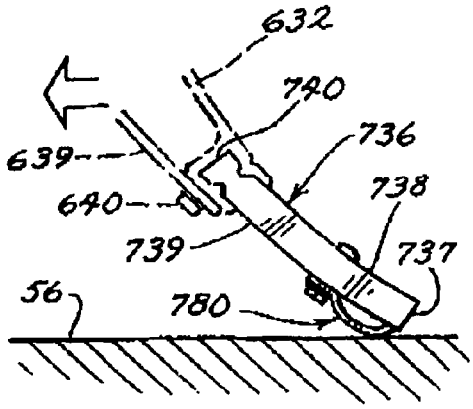
FIG. 56B is a side view of the preferred rubber scraper 736 within the mold board 632 shown in FIG. 56A, but showing the rubber scraper lying somewhat flat and being flexed forward somewhat as it would be when the mold board 632 and the rubber scraper 736 are pulled backward along the ground surface 56, showing that the skid brackets 780 elevate the rear edge 737 of the bottom of the preferred rubber scraper 736 and, thereby, protect the rear edge 737 from wear when pulled along the ground surface 56.

FIGS. 55, 56A and 56B, illustrate a preferred rubber scraper 736 that will be used primarily with a preferred embodiment of the mold board 632 shown in FIG. 52. The preferred rubber scraper 736 is similar to that shown in phantom in FIGS. 49 and 52 and shown partially in FIG. 51 in that it includes a bottom edge 737, a front surface 738, a rear surface, 739, a top edge 740, and side edges, except that the rubber scraper is equipped with a plurality of removably attachable skids 780 (preferably two), one of which is shown in each of FIGS. 55, 56A and 56B. Each skid includes a body portion 781 and a flange 782 having one or more apertures 783. Preferably, the body portion 781 is configured to project rearwardly from the rear surface of the scraper 736 and arranged so that when the scraper is being pushed forwardly against a surface 56 (as in FIG. 56*a*) the skid 780 does not interfere with the operation of the scraper, and when the plow and the scraper are being dragged in a direction rearward of the plow blade, the exterior surface of the skid 780 lifts the bottom 737 of the scraper 736 above the ground surface 56 (see FIG. 56*b*). Each skid 780 is preferably removably attached to the rear surface 739, of the rubber scraper 736 by a pair of threaded bolts 784 which pass through openings 785 in the rubber scraper 736 to secure the skid 780 when the bolts pass through a flat washer 786, and a lock washer 787 before being secured in a reciprocally threaded nut 788.

Preferably, the body 781 of the skid 780 has an arcuately shaped, rearwardly facing surface. It will be appreciated that the rear surfaces of the skids 780 will protect the bottom edge 737 of the rubber scraper 736 when the rubber scraper 736 is dragged backward along the ground surface 56 as shown in FIG. 56B, while the skids 780 will have only incidental, limited contact with the ground surface, as shown in FIG. 56A, when the rubber scraper 736 is pushed forward as will occur when the preferred rubber scraper 736 is employed with a snow plow apparatus including the further preferred mold board 632 and the preferred rubber scraper 736.

It will be appreciated that the materials used and described in the present application are only preferences and that the present self-adjusting snow plow apparatus (including the ATV snow plow apparatus) may be made of many different materials and of materials having a wide variety of thicknesses and sized dimensions.

Figure 57:
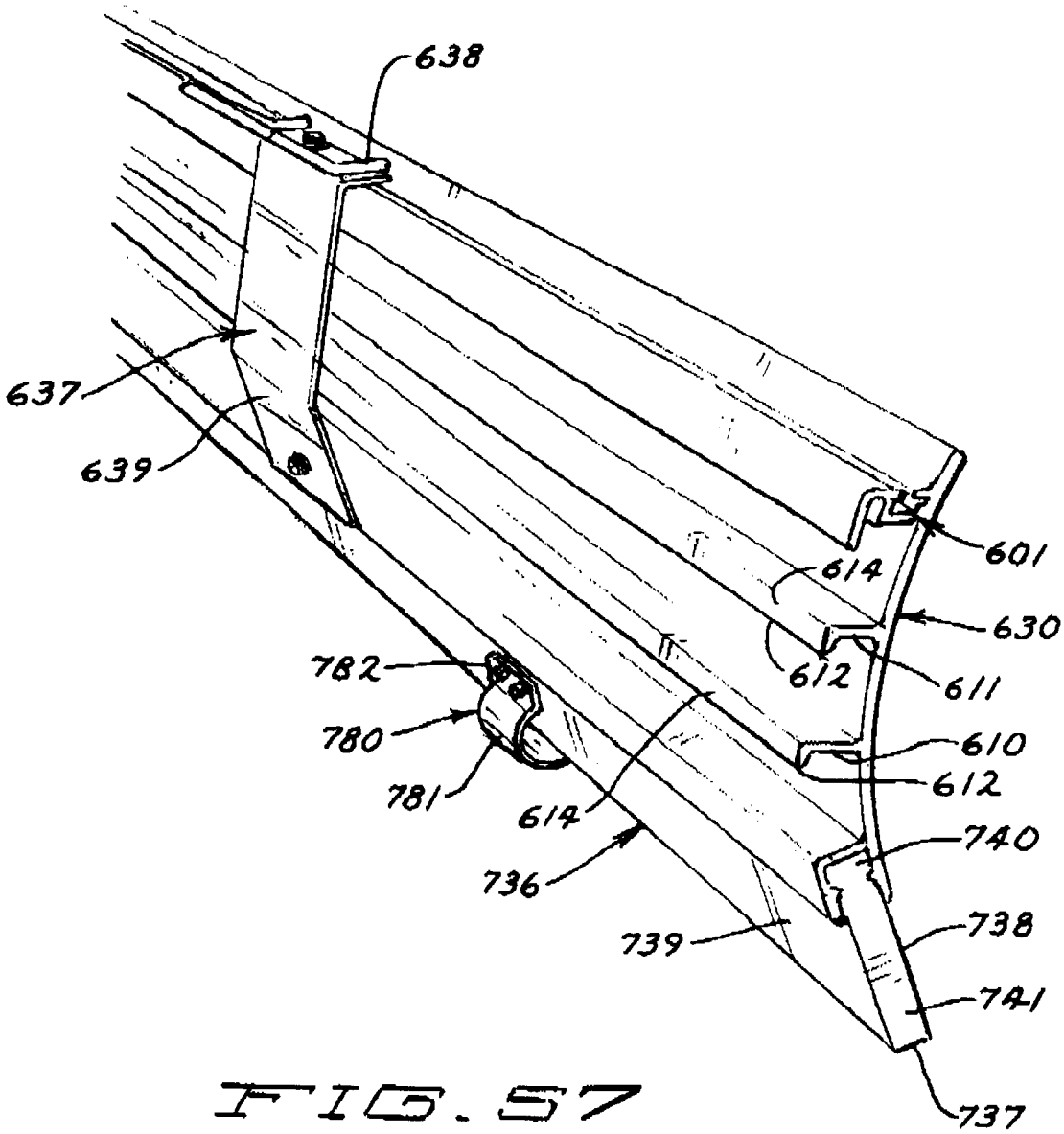
FIG. 57 is a partial, rear perspective view of the plow blade 630 of FIG. 52 as it may be used in conjunction with the scraper blade 736 of FIGS. 55-57.

FIG. 57 is a partial, rear perspective view of the plow blade 630 of FIG. 52 as it may be used in conjunction with the scraper blade 736 of FIGS. 55-57. As shown, the plow blade 630 includes support structures 610, 611, which extend rearwardly and which terminate in feet 612 having force receiving surfaces 614. Note that the support structures are generally, although not necessarily so, parallel, oriented along the longitudinal axis of the plow blade and extend along the width of the plow. The width of the plow blade 630 will be sized appropriately for the intended vehicle to which it will be used. For example, when the snow plow is paired with an all-terrain-vehicle (ATV) it will have a width of about sixty inches, and when the snow plow is paired with a larger vehicle such as a minivan the plow will have a width of about seventy-two inches. As with the previously described embodiments, the plow blade is provided with a retention apparatus 637 that includes a plate 639 having one end that is removably attached to the upper attachment channel 601, preferably a conventional two part fastener 603, 604 (cf. two part fastener 303 and 304 of FIG. 25A). The other end of plate 639 may be fastened to the lower end of the plow blade 630 with a self-tapping screw. The plow blade 630 may be used in conjunction a scraper such as the scraper 736 disclosed in FIGS. 55, 56A and 56B, in which the rear surface 739 is provided with one or more removably attachable skids 780. However, it is understood that any of the other previously discussed scrapers could be used with the plow blade.

Generally, when the snow plow blade is constrainingly connected by one or more retention members to the mounting uprights of a mounting apparatus, it will be free to move vertically between the catch structures or retention pins at the upper lower ends of the mounting uprights, and the interconnection member. FIGS. 58, 59, 60, and 61 illustrate an embodiment of the invention in which the snow plow is provided with a multi-function elongated member 800 having a body 802 with a first end 804 and a second end 806, which is used to adjust a plow blade in one of several positions or modes of operation while the plow blade is constrainingly connected to mounting uprights of a mounting apparatus. The elongated member is designed to be used while the plow blade is attached to a mounting apparatus, which is attached to a subframe 311 (shown in phantom) by fastening elements (not shown) that are inserted through apertures 726 in the interconnecting member 724 and the subframe 311. Although the elongated member 800 is depicted as being in the form of a flexible strap or webbing, it will be appreciated that other flexible materials such as wires, cords and chains can be used.

Figure 58:
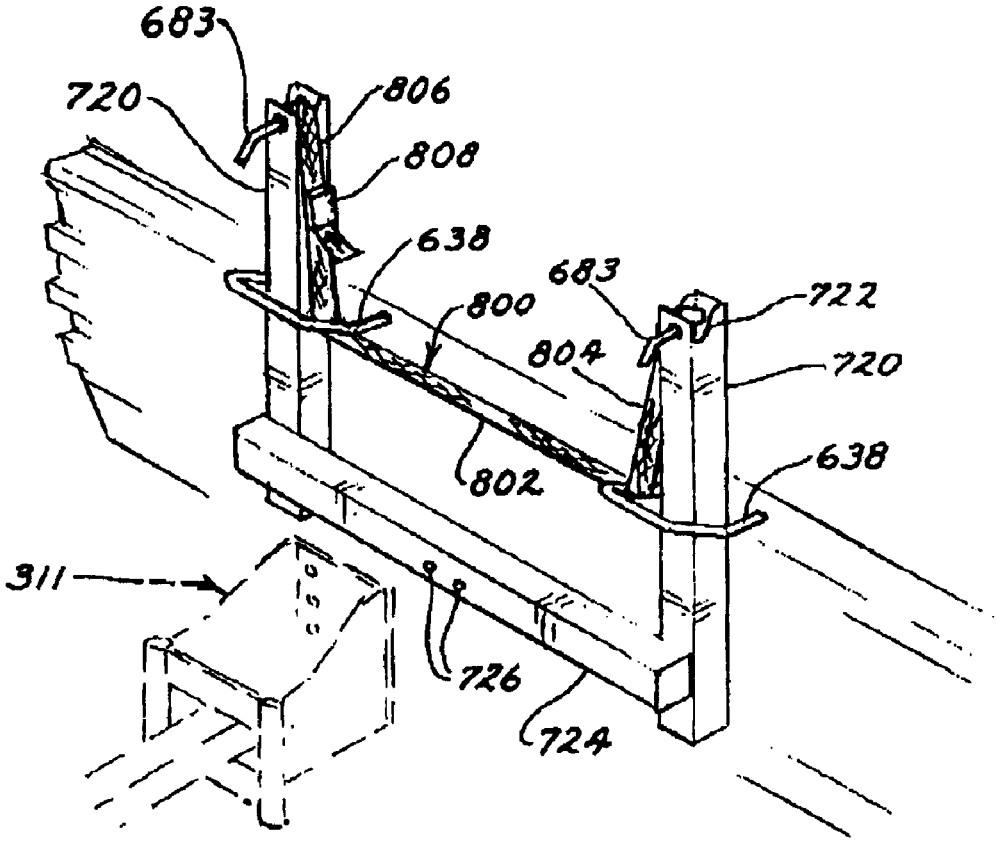
FIG. 58 is a partial, rear perspective view of the a plow blade having retention members 638 and a multi-function elongated member 800 used to connect the plow blade to a mounting apparatus in a first operational mode.
Figure 59:
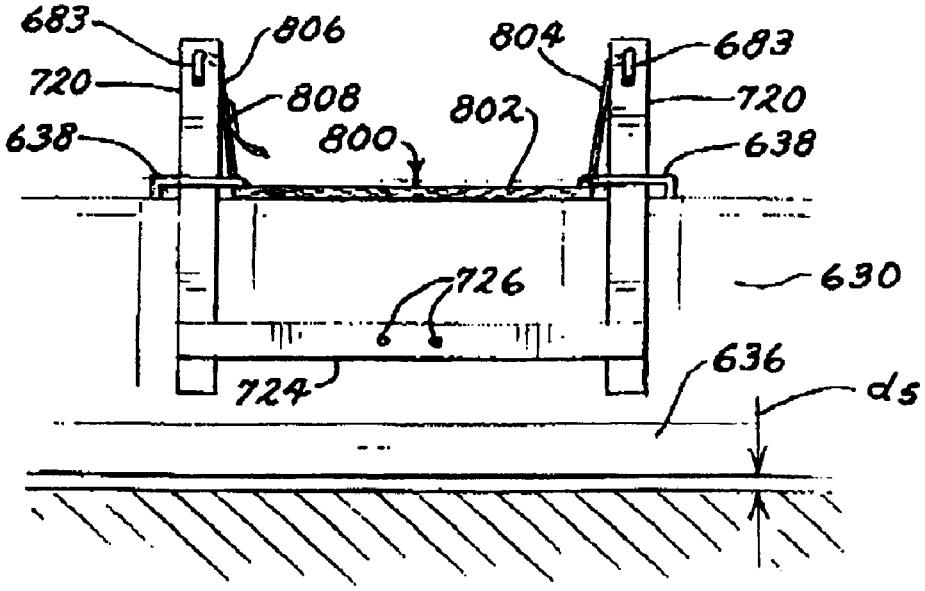
FIG. 59 is a partial, rear elevational view of the plow blade, retention members, and the multi-functional elongated member 800 of FIG. 58.

FIGS. 58 and 59 illustrate a first mode of operation. In the first mode of operation or position, one end 804 of the elongated member 800 is attached to one end of one of the mounting uprights 720 of a mounting apparatus. Preferably, this is achieved by providing the end 804 of the elongated member 800 with a closed loop through which a pin 683 (see, FIGS. 53 and 26-28) may be inserted when the pin is attached to the upper end of the mounting upright 720. The body 802 of the elongated member 800 is then fed downwardly through the space between the mounting upright 720 and the retention member 638 that is constrainingly attached thereto. Next, the body 802 is extended along the rear of the plow blade in a direction that is generally parallel to the interconnecting member 724 until it reaches the second mounting upright 720. The second end 806 is then fed upwardly through the space between the second mounting upright 720 and the retention member 638 that is constrainingly attached thereto and connected to a second pin 683 located at the top of the second mounting upright 720. Preferably, the second pin 683 has already been attached to the upper end of the second mounting upright 720 and the user need only loop the second end about the second pin 683 and secure the loose end to the body 802 with a fastener 808, such as a buckle. Once the elongated member 800 has been attached, the user may adjust the length of the member 800. As the elongated member 800 is shortened, the plow blade will be lifted up from contact with the ground by a distance d5 (shown in FIG. 59). Stated differently, when the elongated member is shortened the plow blade is prevented from contacting the surface being plowed. That is, the elongated member 800 acts to restrict the downward travel of the plow that would otherwise be available without the elongated member 800. When the snow plow is positioned in this first operational mode, the plow blade will still be able to function as a snow plow and move snow, but it will now leave a relatively thin layer of snow on the surface it is clearing. As will be appreciated, this is particularly useful in situations where a surface to be cleared is normally covered with gravel or other loose material, because it permits the loose material to remain on the surface while the snow above it is removed. Preferably, this distance d5 is between ½ to about 4 inches.

Figure 60:
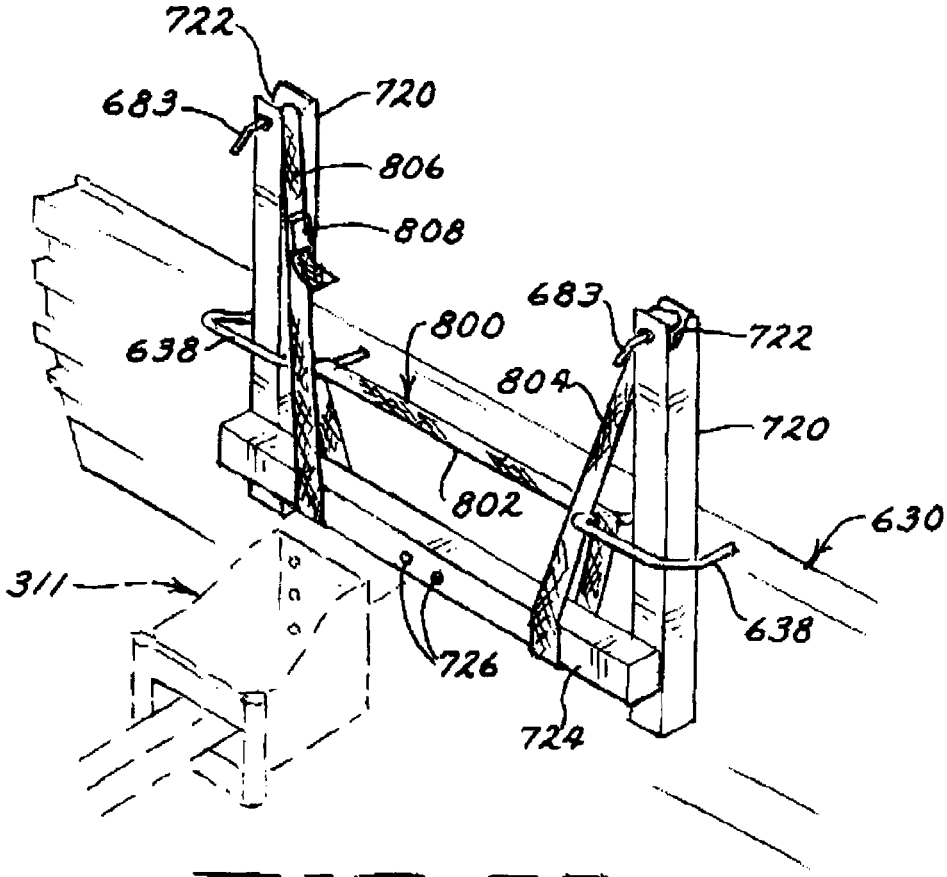
FIG. 60 is a partial, rear perspective view of the a plow blade having retention members 638 and a multi-function elongated member 800 used to connect the plow blade to a mounting apparatus in a second operational mode; and, FIG. 61 is a partial, rear elevational view of the plow blade, retention members, and the multi-functional elongated member 800 of FIG. 60.
Figure 61:
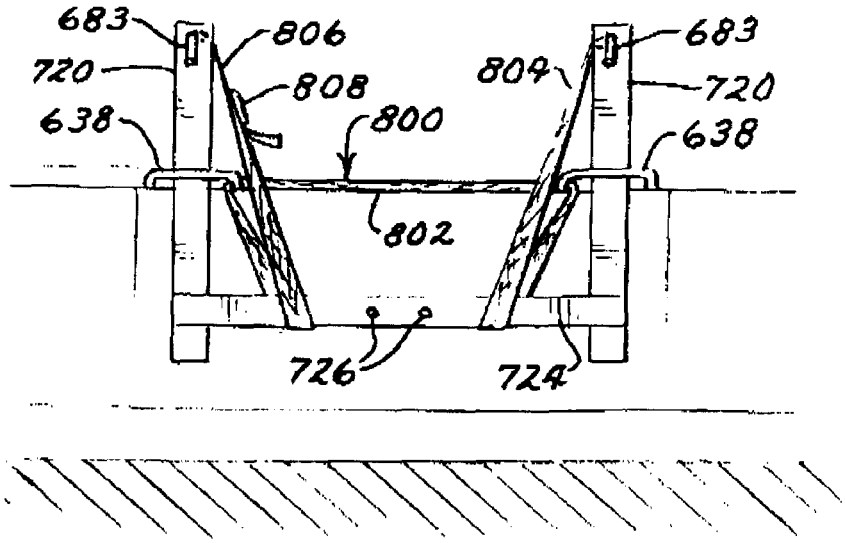

In a second mode of operation or position, as shown in FIGS. 60 and 61, one end 804 of the elongated member 800 is attached to one end of one of the mounting uprights 720 of a mounting apparatus in the manner previously discussed. However, instead of feeding the body 802 downwardly through the space between the mounting upright 720 and the retention member 638, the body is looped behind the interconnecting member 724, and then upwardly through the space between the mounting upright 720 and the retention member 638 that is constrainingly attached thereto. Next, the body 802 is extended along the rear of the plow blade in a direction that is generally parallel to the interconnecting member 724 until it reaches the second retention member 638. Instead of feeding the body 802 upwardly, the body is fed downwardly and looped in front of the interconnecting member 724 and upwardly to the top of the second mounting upright 720, where it is connected to a second pin 683. Preferably, the second pin 683 has already been attached to the upper end of the second mounting upright 720 and the user need only loop the second end about the second pin 683 and secure the loose end to the body 802 with a fastener 808, such as a buckle. Once the elongated member 800 has been attached, the user may adjust the length of the member 800. As the elongated member 800 is shortened, the plow blade will be prevented from contacting the catch structures or retention pins. That is, the elongated member 800 acts to restrict the upward travel of the plow that would otherwise be available without the elongated member 800. As will be appreciated, this will not substantially affect the operation of the snow plow when the snow plow is being dragged in a direction rearward of the plow blade because the plow blade may still pivot about the retention member—mounting upright connections. However, when the snow plow is pushed forwardly and it contacts snow or the surface being cleared, the resistance exerted against the plow blade will tend to pivot it about the retention member connections until the bottom of the plow blade substantially abuts the mounting uprights. As the plow blade pivots into position, its upper range of motion would normally be limited by the catch structures or retention pins. However, when the elongated member is in its second position, the upper range of motion is foreshortened and the snow plow will tend to lift the entire mounting assembly, rather than float relative to the mounting uprights. When this occurs, the weight of the vehicle can be transferred from the wheels to the plow. As will be appreciated, a considerable downward force may be applied to the plow blade; on the order of up to 3-400 pounds. This extra force is particularly useful when the snow plow is used on improved roads or surfaces such as sidewalks.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described herein, the details may be changed without departing from the intended scope of the invention, which is defined by the attached claims.

What is claimed is:

1. A snow plow for attachment to a vehicle for displacing snow on the ground, the snow plow comprising:

a mounting apparatus having a mounting frame, the mounting frame including at least one mounting upright; and a plow blade, the plow blade having a mold board including a main surface, a rubber scraper proximate the main surface and a retention apparatus constructed and arranged to disengageably secure the plow blade with the mounting upright during use; wherein the retention apparatus at least partially encircles the mounting upright and allows the plow blade to pivot with respect to the mounting upright such that the rubber scraper can pivot away from the mounting upright when the plow blade is in a working orientation and the vehicle moves in a direction rearward from the plow blade.

2. The snow plow of claim 1, wherein a projected intersection of a first plane of the mounting upright and a second plane of the main surface of the mold board defines a first angle, such that as the vehicle moves in a direction rearward from the plow blade and the plow blade is in a working orientation, the first angle increases.

3. The snow plow of claim 2, further comprising a set of securing plates located on opposite ends of the mold board that can pivot the snow plow such that the contact between the ground and the rear edge of the rubber scraper is minimized so as to reduce the wear on the rear edge.

4. The snow plow of claim 1, further comprising a set of end caps located on opposite ends of the plow blade; wherein wear on a rear edge of the rubber scraper is minimized as the plow blade pivots on the end caps when the snow plow is being pulled in a direction rearward of the plow blade.

5. The snow plow of claim 4, wherein the rubber scraper extends away from the plane of the main surface of the mold board at an angle of at least about 10 degrees.

6. The snow plow of claim 5, wherein the rubber scraper extends away from the plane of the main surface of the mold board at an angle of at least about 30 degrees.

7. The snow plow of claim 4, wherein the end caps extend below the mold board at least about 2 inches.

8. The snow plow of claim 7, wherein the end caps extend below the mold board at least about 4 inches.

9. The snow plow of claim 1, wherein a rear edge of the rubber scraper pivots towards the vehicle when the vehicle moves in the direction opposite the plow blade to a direction towards the plow blade.

10. The snow plow of claim 1, wherein the mold board has a top half and a bottom half, wherein the retention member is secured to the top half of the mold board.

11. A snow plow for attachment to a vehicle for displacing snow on the ground, the snow plow comprising:

a mounting apparatus having a mounting frame, the mounting frame including at least one mounting upright; and a plow blade, the plow blade having a mold board including a main surface, a back, a rubber scraper proximate the main surface and a retention apparatus constructed and arranged to disengageably secure the plow blade to the mounting upright during use; wherein the retention apparatus at least partially encircles the mounting upright and allows the plow blade to pivot with respect to the mounting upright such that the rubber scraper can pivot away from the mounting upright when the plow blade is in a working orientation and the vehicle moves in a direction rearward from the plow blade and wherein the mounting upright pushes against the back of the mold board to push the plow blade forward when the plow blade is in a working orientation and the plow blade is being pushed forward.

12. The snow plow of claims 11, wherein the mounting apparatus has two mounting uprights interconnected by an interconnecting member; wherein the retention apparatus may not slide downwardly past the interconnecting member.

13. The plow blade of claim 11, wherein a projected intersection of a first plane of the mounting upright and a second plane of the main surface of the mold board defines a first angle, such that as the vehicle moves in a direction rearward from the plow blade and the plow blade is in a working orientation the first angle increases.

14. The plow blade of claim 13, further comprising a set of securing plates located on opposite ends of the mold board that can pivot the snow plow such that the contact between the ground and the rear edge of the rubber scraper is minimized so as to reduce the wear on the rear edge.

15. A snow plow for attachment to a vehicle for displacing snow on the ground, the snow plow comprising:

a mounting apparatus having a mounting frame, the mounting frame including two mounting uprights and the mounting uprights being interconnected by an interconnecting member;

a plow blade, the plow blade having a mold board including a main surface, a rubber scraper proximate the main surface and a retention apparatus constructed and arranged to constantly engage the plow blade to the mounting uprights during use; wherein the retention apparatus includes two retention members each of which at least partially encircle one of the respective mounting uprights and allow the plow blade to pivot with respect to the mounting uprights such that the rubber scraper can pivot away from the mounting uprights when the plow blade is in a working orientation and the vehicle moves in a direction rearward from the plow blade.

16. The snow plow of claim 15, wherein the mold board has a back and the mounting uprights push against the back of the mold board when the plow blade is in a working orientation and the mounting apparatus pushes the plow blade forward.

17. The snow plow of claim 16, wherein the interconnecting member is interconnected with the respective mounting uprights in such a way that the interconnecting member limits the downward slide of the retention members so that a portion of each of the mounting uprights below the interconnecting member will remain in contact with the back when the plow blade is pushed forward even when the retention members are allowed to slide as far down on the mounting uprights as the retention members can slide.

18. The plow blade of claim 17, wherein a projected intersection of a first plane of the mounting uprights and a second plane of the main surface of the mold board defines a first angle, such that as the vehicle moves in a direction rearward from the plow blade and the plow blade is in a working orientation, the first angle increases.

19. The snow plow of claim 18, further comprising a set of securing plates located on opposite ends of the mold board that can pivot the snow plow such that the contact between the ground and the rear edge of the rubber scraper is minimized so as to reduce the wear on the rear edge.

20. A method of minimizing wear damage to a snow plow caused by contact between the snow plow and the ground; wherein the snow plow is attached to a vehicle; the method comprising the steps of:

providing a snow plow having a mounting apparatus and a plow blade, the mounting apparatus having a mounting frame, the mounting frame including a mounting upright; further providing a plow blade, the plow blade having a mold board including a main surface, a rubber scraper proximate the main surface and a retention apparatus constructed and arranged to disengageably secure the plow blade to the mounting upright during use; wherein the retention apparatus allows the plow blade to pivot with respect to the mounting upright; wherein an angle is formed between a first plane of the mounting upright and a second plane of the main surface of the plow blade; and pulling the plow blade in a direction rearward of the plow blade such that the plow blade slides downwardly along the mounting upright such that the angle between the first plane of the mounting upright and the second plane of the main surface of the mold board increases, wherein as the angle increases, contact between a rear edge of the rubber scraper and the ground is minimized.

21. The method of claim 20, wherein a set of securing plates located on opposite ends of the mold board pivot the snow plow such that contact between the ground and a rear edge of the rubber scraper is minimized as to reduce wear on the rear edge.

22. The method of claim 20, wherein a set of end caps located on opposite ends of the mold board pivot the snow plow such that contact between the ground and a rear edge of the rubber scraper is minimized so as to reduce wear on the rear edge.

23. The method of claim 20, wherein the method further comprises the step of attaching the snow plow to the front of the vehicle.

24. A snow plow for attachment to a vehicle. the snow plow comprising:

a mounting apparatus having a mounting frame and the mounting frame having a mounting upright; and a plow blade including a main surface and a rear surface, the plow blade including a retention apparatus having at least one retention member which at least partially encircles the mounting upright when the plow blade is in a working orientation; wherein the plow blade is slideably retained on the mounting frame when the plow blade is in a working orientation; wherein the mounting frame pushes the rear surface of the plow blade when the vehicle is moving in a direction towards the plow blade;

wherein the mounting frame disengages the rear surface when the vehicle moves in a direction rearward of the plow blade;

wherein the rear surface of the plow blade drops down with respect to the mounting frame the mounting frame when the vehicle changes direction from a direction toward the plow blade to a direction rearward of the plow blade.

25. The snow plow of claim 24, wherein the plow blade pivots away from the mounting frame when the vehicle changes direction from a direction toward the plow blade to a direction rearward of the plow blade.

* * * * *

UNITED STATES PATENT AND TRADEMARK OFFICE

CERTIFICATE OF CORRECTION

PATENT NO. : 7,472,499 B2
APPLICATION NO. : 11/556338
DATED : January 6, 2009
INVENTOR(S) : Charles M. Schmeichel It is certified that error appears in the above-identified patent and that said Letters Patent is hereby corrected as shown below:

Title page 1, please insert the following priority information:

-- Related U.S. Application Data

(63) Continuation-in-part of application No. 10/850,151, filed on May 19, 2004, now Pat. No. 7,131,221, which is a continuation-in-part of application No. 10/404,164, filed on Mar. 31, 2003, now Pat. No. 6,817,118.

(30) Foreign Application Priority Data

Nov. 12, 2001 (WO)..... ..... PCT/US01/47125 --.

Column 1, line 6, replace "related to" with -- a continuation-in-part of --.
Column 1, line 9, replace "continuation" with -- continuation-in-part --.
Column 4, line 59, replace "common" with -- commonly --.
Column 11, line 15, replace "the a plow" with -- the plow --.
Column 11, line 22, replace "the a plow" with -- the plow --.
Column 14, line 5, replace "6°" with -- 60 --.
Column 16, line 40, replace "32"" with -- 32"" --.
Column 17, line 37, replace "40 or 50" with -- 40 or 50 --; line 40, replace "are" with -- is --.
Column 19, line 54, replace "and to" with -- and --.
Column 20, line 66, replace "upright" with -- uprights --.
Column 21, line 58, replace "pin is" with -- pin --.
Column 22, line 61, replace "plurality" with -- plurality of --; lines 63-64, replace "were attached" with "where attached".
Column 26, line 8, replace "disengageably" with "disengaging"; line 28, replace "disengage" with -- disengaged --; line 54, replace "eighth" with -- eight --.
Column 28, line 16, replace "long the" with -- long as the --.

Signed and Sealed this
Fifth Day of July, 2011

David J. Kappos

David J. Kappos
*Director of the United States Patent and Trademark Office*

Column 29, line 55, replace “than” with -- to that --.
Column 31, line 7-8, replace “conjunction a scraper” with -- conjunction with a scraper --.
Column 34, line 4, replace “claims” with -- claim --.
Column 36, line 22, replace “the mounting frame the mounting frame” with -- the mounting frame --.